US012070131B2

(12) United States Patent
Nelson et al.

(10) Patent No.: US 12,070,131 B2
(45) Date of Patent: Aug. 27, 2024

(54) RECONFIGURABLE MODULAR FURNITURE ASSEMBLY WITH OVERLAPPING GEOMETRY

(71) Applicant: The Lovesac Company, Stamford, CT (US)

(72) Inventors: Shawn D. Nelson, Washington, UT (US); David M. Underwood, Hurricane, UT (US); Clint Gibson, Saint George, UT (US); Braquel Burnett, Saint George, UT (US); Brian Kuchler, Hurricane, UT (US); Jake Forman, Washington City, UT (US)

(73) Assignee: The Lovesac Company, Stamford, CT (US)

( * ) Notice: Subject to any disclaimer, the term of this patent is extended or adjusted under 35 U.S.C. 154(b) by 214 days.

(21) Appl. No.: 17/348,095

(22) Filed: Jun. 15, 2021

(65) Prior Publication Data

US 2022/0000266 A1 Jan. 6, 2022

Related U.S. Application Data

(60) Provisional application No. 63/046,287, filed on Jun. 30, 2020.

(51) Int. Cl.
*A47C 4/02* (2006.01)

(52) U.S. Cl.
CPC ..... *A47C 4/02* (2013.01)

(58) Field of Classification Search
CPC ..... A47C 4/02; A47C 13/005; A47C 4/028
See application file for complete search history.

(56) References Cited

U.S. PATENT DOCUMENTS 1,236,234 A 8/1917 Troje
2,466,204 A 4/1949 Brown
(Continued)

FOREIGN PATENT DOCUMENTS

AU 2006201979 A1 11/2006
AU 2013267018 A1 6/2014
(Continued)

OTHER PUBLICATIONS

Arold cube 100 from Groupe Lacasse dated Mar. 5, 2017 by web.archive.org, https://www.groupelacasse.com/en/collections/29-cube-100.html (Year: 2017).*
(Continued)

*Primary Examiner* — Terrell L McKinnon
*Assistant Examiner* — Ding Y Tan
(74) *Attorney, Agent, or Firm* — Workman Nydegger

(57) ABSTRACT

A modular furniture assembly is disclosed herein. The assembly includes a base, an upright member, and one or more connector plates configured to selectively couple a bottom portion of the base to a bottom portion of the upright member. The base and the upright member are sized and configured in a particular defined spatial relationship where the length (X) of the base is substantially equal to the sum of the width (Y) of the base and two times a dimension (Z) which is the width ($Z_1$) of the upright member or a separation distance ($Z_2$) between adjacent receiving holes of the base and upright member. Thus, X is substantially equal to Y+2Z.

25 Claims, 31 Drawing Sheets

(56) References Cited

U.S. PATENT DOCUMENTS 2,701,009 A 2/1955 Richard
2,723,896 A 11/1955 Wurtz
2,751,969 A 6/1956 Kruijt
2,793,685 A 5/1957 Spitz
2,870,824 A 1/1959 Le Barre
3,030,146 A 4/1962 Faxon
3,036,864 A 5/1962 Zentaro
3,137,012 A 6/1964 Halterman
3,183,036 A 5/1965 Hill
3,603,546 A 9/1971 Ruffert
3,604,027 A 9/1971 Konno
3,606,461 A * 9/1971 Moriyama ..... A47C 13/00 297/283.1
3,608,959 A 9/1971 Sarvas
3,632,150 A 1/1972 Milakovich
3,669,494 A 6/1972 Lohmeyer
3,706,473 A 12/1972 Mullen
D228,325 S 9/1973 Henning
3,787,909 A 1/1974 Johnson
3,811,728 A 5/1974 Redemske
3,944,281 A 3/1976 Piretti
3,973,800 A 8/1976 Kogan
4,032,188 A 6/1977 Jones
4,045,090 A 8/1977 Fleisch et al.
4,047,773 A 9/1977 Semany
4,062,584 A 12/1977 Pinkham et al.
4,077,666 A 3/1978 Heumann
4,140,065 A 2/1979 Chacon
4,305,616 A 12/1981 Martinez
4,509,219 A 4/1985 Yagi
4,523,787 A 6/1985 Robinson
4,591,289 A 5/1986 Vickers et al.
4,602,817 A 7/1986 Raftery
4,626,218 A 12/1986 Wright
4,682,818 A 7/1987 Morell
4,711,495 A 12/1987 Magder
4,753,480 A 6/1988 Morell
4,893,958 A 1/1990 Wieland
4,932,720 A 6/1990 Sherman
5,064,244 A 11/1991 Sproule
5,092,253 A 3/1992 Grund et al.
5,112,110 A 5/1992 Perkins
5,189,747 A 3/1993 Mundy et al.
5,322,345 A 6/1994 Desser et al.
5,492,399 A 2/1996 Tillack
D370,356 S 6/1996 Natuzzi et al.
5,544,938 A 8/1996 Saul et al.
5,609,112 A 3/1997 Meyer et al.
5,738,414 A 4/1998 Wieland et al.
5,740,564 A 4/1998 Hankins et al.
5,775,778 A 7/1998 Riley et al.
5,867,849 A 2/1999 Pontrello
5,890,767 A 4/1999 Chang
6,050,638 A 4/2000 West, III
6,063,007 A 5/2000 Sithole
6,116,694 A 9/2000 Bullard
6,151,765 A 11/2000 Asplund
6,216,894 B1 4/2001 Hendricks
6,241,317 B1 6/2001 Wu
6,267,446 B1 7/2001 Wieland et al.
6,367,880 B1 4/2002 Niederman et al.
6,595,592 B1 7/2003 Wieland et al.
6,688,699 B1 2/2004 Bowie
6,715,837 B2 4/2004 Niederman et al.
6,739,667 B1 5/2004 Jones
6,796,614 B1 9/2004 Paul
6,824,220 B1 11/2004 Davison
6,942,298 B2 9/2005 Harrison
6,952,906 B2 10/2005 Nelson
6,981,747 B2 1/2006 Wieland et al.
7,020,911 B2 4/2006 Oldham
7,028,859 B2 4/2006 Moon et al.
7,066,548 B2 6/2006 Butler
7,181,783 B2 2/2007 O'Reilly
7,213,885 B2 5/2007 White et al.
D547,087 S 7/2007 Natuzzi
7,252,339 B2 8/2007 Owens
7,255,403 B2 8/2007 Butler
7,296,859 B1 11/2007 Branch, III
7,322,642 B2 1/2008 Bojack
7,322,644 B2 1/2008 Bigolin
7,399,034 B2 7/2008 Fullmer et al.
7,419,220 B2 9/2008 White et al.
7,434,304 B2 10/2008 Owens
7,448,689 B2 11/2008 Carter et al.
7,480,947 B2 1/2009 Patella
7,481,496 B2 1/2009 Smith
7,547,073 B2 6/2009 White et al.
7,553,288 B2 6/2009 Cohen
7,568,767 B2 8/2009 Richardson
7,581,786 B1 9/2009 Wang
7,744,162 B2 6/2010 Griggs, Jr.
7,892,065 B2 2/2011 Vicentelli
7,918,308 B2 4/2011 Cohen
7,941,882 B1 5/2011 Strozer
7,963,612 B2 6/2011 Nelson
8,479,685 B2 7/2013 Sprung
8,528,972 B2 9/2013 Johnsson
8,668,045 B2 3/2014 Cohen
8,689,992 B2 4/2014 Anderson et al.
8,764,114 B1 7/2014 Frank et al.
8,777,319 B2 7/2014 Brandtner et al.
8,783,778 B2 7/2014 Nelson et al.
8,919,885 B2 12/2014 Han
8,950,817 B2 * 2/2015 Iacovoni ..... A47B 13/021 297/135
9,277,813 B2 3/2016 Nelson et al.
9,277,826 B2 3/2016 Nelson et al.
9,420,892 B2 8/2016 Lejcher et al.
9,526,342 B2 12/2016 Thuma et al.
9,596,937 B2 3/2017 Ng
9,603,448 B2 * 3/2017 Nelson ..... A47B 47/0091
9,668,581 B1 6/2017 Hill
9,839,295 B2 12/2017 Robinson et al.
9,936,800 B2 4/2018 Nelson et al.
10,070,725 B2 9/2018 Nelson et al.
10,123,623 B2 11/2018 Nelson et al.
10,143,307 B2 12/2018 Nelson et al.
10,154,733 B2 12/2018 Nelson et al.
10,212,519 B2 2/2019 Nelson et al.
10,236,643 B2 3/2019 Nelson et al.
10,390,610 B2 8/2019 Nelson
10,512,338 B1 12/2019 Hawkins et al.
10,806,261 B2 10/2020 Nelson et al.
11,166,565 B2 * 11/2021 Policicchio ..... A47C 13/005
11,457,745 B1 * 10/2022 Clabots ..... A47C 13/005
2002/0017814 A1 2/2002 Niederman et al.
2003/0139693 A1 7/2003 Swift
2003/0151295 A1 8/2003 Nelson
2004/0021359 A1 2/2004 Chang
2004/0095000 A1 5/2004 Durling
2004/0212240 A1 10/2004 Zwezdaryk
2005/0053252 A1 3/2005 Cohen
2005/0067876 A1 3/2005 Dortch
2005/0146179 A1 7/2005 Murphy
2005/0179303 A1 8/2005 Owens et al.
2005/0225153 A1 10/2005 Ou
2005/0253430 A1 11/2005 George et al.
2006/0061148 A1 3/2006 Pollard et al.
2006/0279124 A1 * 12/2006 White, III ..... A47C 13/005 297/440.14
2007/0001494 A1 1/2007 Hoover
2007/0085406 A1 4/2007 White et al.
2007/0257539 A1 11/2007 White et al.
2007/0287353 A1 12/2007 Vicentelli
2009/0045666 A1 2/2009 Westendorf et al.
2009/0235451 A1 9/2009 Gorkin
2009/0250982 A1 10/2009 Cohen
2009/0251250 A1 10/2009 Tait et al.
2009/0315382 A1 12/2009 Nelson
2010/0050911 A1 3/2010 Rouillard
2010/0093257 A1 4/2010 Elliott
2010/0196088 A1 8/2010 Johnsson
2010/0264715 A1 10/2010 Griggs, Jr.

(56) References Cited

U.S. PATENT DOCUMENTS

| | | | | |
|---|---|---|---|---|
| 2010/0320819 | A1 | 12/2010 | Cohen et al. | |
| 2011/0233976 | A1 | 9/2011 | Hanson et al. | |
| 2011/0298340 | A1 | 12/2011 | Nelson et al. | |
| 2012/0119629 | A1 | 5/2012 | Nelson et al. | |
| 2012/0146382 | A1 | 6/2012 | Griggs, Jr. | |
| 2012/0217784 | A1 | 8/2012 | Griggs, Jr. | |
| 2013/0134763 | A1* | 5/2013 | Koch | A47C 4/028 297/440.23 |
| 2013/0234481 | A1 | 9/2013 | Johnson | |
| 2013/0320741 | A1 | 12/2013 | Brandtner et al. | |
| 2014/0139000 | A1 | 5/2014 | Ogg | |
| 2014/0368010 | A1 | 12/2014 | Nelson et al. | |
| 2016/0174715 | A1 | 6/2016 | Nelson et al. | |
| 2016/0206100 | A1* | 7/2016 | Nelson | F16B 12/00 |
| 2016/0262542 | A1 | 9/2016 | Chung | |
| 2016/0331135 | A1 | 11/2016 | Knudson | |
| 2017/0143122 | A1* | 5/2017 | Nelson | A47C 1/0352 |
| 2017/0367486 | A1* | 12/2017 | Nelson | A47C 13/005 |
| 2018/0000244 | A1* | 1/2018 | Nelson | A47C 13/005 |
| 2018/0041354 | A1 | 2/2018 | Nelson et al. | |
| 2018/0078041 | A1 | 3/2018 | Nelson et al. | |
| 2018/0098631 | A1* | 4/2018 | Nelson | A47C 4/028 |
| 2018/0213943 | A1* | 8/2018 | Kuhl | A47C 7/407 |
| 2019/0142165 | A1 | 5/2019 | Nelson et al. | |
| 2019/0222935 | A1 | 7/2019 | Nelson et al. | |
| 2020/0100030 | A1 | 3/2020 | Nelson et al. | |
| 2020/0100031 | A1 | 3/2020 | Nelson et al. | |
| 2020/0187654 | A1* | 6/2020 | Mutyala | F16B 12/60 |
| 2020/0196751 | A1* | 6/2020 | Wong | A47B 85/04 |
| 2020/0221877 | A1 | 7/2020 | Hirschhaut | |
| 2020/0237098 | A1 | 7/2020 | Vandenbos et al. | |
| 2020/0245773 | A1* | 8/2020 | Policicchio | A47C 1/124 |
| 2020/0260879 | A1 | 8/2020 | Nelson et al. | |
| 2021/0000258 | A1 | 1/2021 | Nelson et al. | |
| 2021/0093087 | A1 | 4/2021 | Zei et al. | |
| 2021/0112341 | A1 | 4/2021 | Nelson et al. | |

FOREIGN PATENT DOCUMENTS

| | | | | |
|---|---|---|---|---|
| CA | 2966127 | A1 * | 5/2016 | A47B 47/0091 |
| CH | 403203 | A | 11/1965 | |
| CN | 2040337 | U | 7/1989 | |
| CN | 2270417 | Y | 12/1997 | |
| CN | 2361174 | Y | 2/2000 | |
| CN | 2516027 | Y | 10/2002 | |
| CN | 2548486 | Y | 5/2003 | |
| CN | 2845583 | Y | 12/2006 | |
| CN | 201019326 | Y | 2/2008 | |
| CN | 201022532 | Y | 2/2008 | |
| CN | 201995991 | U | 10/2011 | |
| CN | 102454668 | A | 5/2012 | |
| CN | 202457379 | U | 10/2012 | |
| CN | 202959613 | U * | 6/2013 | |
| CN | 104757809 | A | 7/2015 | |
| CN | 204797183 | U | 11/2015 | |
| CN | 204908675 | U * | 12/2015 | |
| CN | 205876899 | U | 1/2017 | |
| CN | 106901523 | A | 6/2017 | |
| CN | 206473081 | U | 9/2017 | |
| DE | 1429323 | A1 | 10/1968 | |
| DE | 1931134 | A1 | 1/1971 | |
| DE | 9317453 | U1 | 1/1994 | |
| DE | 20316773 | U1 | 2/2004 | |
| DE | 102006059750 | A1 | 6/2008 | |
| DE | 202009007814 | U1 | 8/2009 | |
| DE | 202012005448 | U1 | 8/2012 | |
| DE | 202011051041 | U1 | 11/2012 | |
| DE | 102011056505 | A1 | 6/2013 | |
| DE | 102016014105 | A1 | 12/2017 | |
| DK | 2213205 | T3 | 4/2013 | |
| EP | 0089934 | A2 | 9/1983 | |
| EP | 1477085 | A1 | 11/2004 | |
| EP | 1916428 | A1 | 4/2008 | |
| EP | 2213205 | A1 | 8/2010 | |
| EP | 2374374 | A1 | 10/2011 | |
| ES | 1019829 | U | 5/1992 | |
| ES | 1136430 | U | 2/2015 | |
| FR | 1391940 | A | 3/1965 | |
| FR | 2293168 | A1 | 7/1976 | |
| FR | 2470277 | A1 | 5/1981 | |
| FR | 2563094 | A * | 10/1985 | A47B 87/00 |
| GB | 1587223 | A | 4/1981 | |
| GB | 1597337 | A | 9/1981 | |
| GB | 2259446 | A | 3/1993 | |
| GB | 2269628 | A | 2/1994 | |
| GB | 2342280 | A | 4/2000 | |
| IT | MI20100602 | A1 | 10/2011 | |
| JP | 53-006411 | A | 1/1978 | |
| JP | 03-118720 | U | 12/1991 | |
| JP | 08-173266 | A | 7/1996 | |
| JP | 2002-045256 | A | 2/2002 | |
| JP | 2008-093253 | A | 4/2008 | |
| JP | 2012-223484 | A | 11/2012 | |
| JP | 2020039823 | A * | 3/2020 | |
| KR | 2012-0000320 | A | 1/2012 | |
| RU | 2553965 | C1 | 6/2015 | |
| TW | M515327 | U | 1/2016 | |
| WO | 95/33395 | A1 | 12/1995 | |
| WO | 01/64081 | A1 | 9/2001 | |
| WO | 2005/027692 | A1 | 3/2005 | |
| WO | 2006/135509 | A2 | 12/2006 | |
| WO | 2006/135855 | A2 | 12/2006 | |

OTHER PUBLICATIONS

Freetown Sofa from Cameric USA, https://www.camerichusa.com/products/sofas/freetown-sofa/, dated 2017 (Year: 2017).*

Decosoup.com online article titled "Sofa dimensions" dated by archive.org at Jan. 13, 2019, https://www.decosoup.com/knowhow/1258-two-seater-sofa-dimensions (Year: 2019).*

Restriction Requirement dated Mar. 28, 2013 from U.S. Appl. No. 12/967,671, filed Dec. 14, 2010.

Restriction Requirement received for U.S. Appl. No. 11/449,074, mailed on Oct. 7, 2008.

Screen capture from homereserve.com website, https://web.archive.org/web/20180812044005/http://homereserve.com/#, Home Reserve—Adaptable Furniture for Everyday Life, Aug. 12, 2018 (22 pgs).

Tegu Magnetic Blocks, https://home.woot.com/plus/tegu-magnetic-blocks-13?ref=w_cnt_wp_5, accessed Feb. 2, 2018, copyright notice: 2004-2018 (2 pages).

U.S. Appl. No. 11/745,325, Mail Date Jun. 13, 2008, Notice of Allowability.

U.S. Appl. No. 12/967,671, Mail Date Mar. 5, 2015, Advisory Action.

U.S. Appl. No. 12/967,671, Mail Date May 1, 2014, Advisory Action.

U.S. Appl. No. 16/189,859, Mail Date Nov. 22, 2019, Office Action.

U.S. Appl. No. 16/189,859, Mail Date Sep. 30, 2020, Issue Notification.

Website pages from www.westelm.com, "West Elm," printed Jun. 2, 2016 (4 pgs).

Corrective Notice of Allowance received for U.S. Appl. No. 11/149,913, mailed on Jan. 12, 2007.

Final Office Action received for U.S. Appl. No. 12/967,671, mailed on Feb. 14, 2014.

Final Office Action received for U.S. Appl. No. 12/967,671, mailed on Jan. 12, 2015.

Issue Notice received for U.S. Appl. No. 15/836,020, mailed on Oct. 24, 2018.

Issue Notification dated Aug. 23, 2018 from U.S. Appl. No. 14/993,533, filed Jan. 12, 2016.

Issue Notification dated Nov. 28, 2018 from U.S. Appl. No. 15/826,090, filed Nov. 29, 2017.

Issue Notification received for U.S. Appl. No. 11/149,913, mailed on Apr. 18, 2007.

Issue Notification received for U.S. Appl. No. 11/449,074, mailed on May 27, 2009.

Issue Notification received for U.S. Appl. No. 11/745,325, mailed on Aug. 13, 2008.

(56) References Cited

OTHER PUBLICATIONS

Issue Notification received for U.S. Appl. No. 12/484,931, mailed on Jan. 5, 2011.
Issue Notification received for U.S. Appl. No. 12/484,931, mailed on Jun. 1, 2011.
Issue Notification received for U.S. Appl. No. 12/967,671, mailed on Feb. 17, 2016.
Issue Notification received for U.S. Appl. No. 13/164,721, mailed on Feb. 12, 2014.
Issue Notification received for U.S. Appl. No. 13/164,721, mailed on Jul. 2, 2014.
Issue Notification received for U.S. Appl. No. 14/332,705, mailed on Feb. 17, 2016.
Issue Notification received for U.S. Appl. No. 15/058,656, mailed on Aug. 23, 2017.
Japanese Utility Model Application No. SHO 56-102375 (Japanese Utility Model Application laid-open No. Sho 58-8364), filed 1981, published 1983 and one page English Statement of Relevance (20 Pages).
Non-Final Rejection Mailed on Sep. 8, 2021 for U.S. Appl. No. 17/028,738.
Notice of Allowance and Fees Due (PTOL-85) Mailed on Mar. 5, 2020 for U.S. Appl. No. 16/189,859.
Notice of Allowance dated Oct. 30, 2018 from U.S. Appl. No. 15/826,090, filed Nov. 29, 2017.
Notice of Allowance issued in U.S. Appl. No. 14/993,533 dated May 10, 2018.
Notice of Allowance received for U.S. Appl. No. 11/149,913, mailed on Dec. 12, 2006.
Notice of Allowance received for U.S. Appl. No. 11/449,074, mailed on May 6, 2009.
Notice of Allowance received for U.S. Appl. No. 11/745,325, mailed on May 28, 2008.
Notice of Allowance received for U.S. Appl. No. 12/484,931, mailed on Feb. 11, 2011.
Notice of Allowance received for U.S. Appl. No. 12/484,931, mailed on Oct. 21, 2010.
Notice of Allowance received for U.S. Appl. No. 12/967,671, mailed on Nov. 9, 2015.
Notice of Allowance received for U.S. Appl. No. 13/164,721, mailed on Mar. 18, 2014.
Notice of Allowance received for U.S. Appl. No. 13/164,721, mailed on Oct. 15, 2013.
Notice of Allowance received for U.S. Appl. No. 14/332,705, mailed on Oct. 30, 2015.
Notice of Allowance received for U.S. Appl. No. 15/058,656, mailed on Apr. 25, 2017.
Notice of Allowance received for U.S. Appl. No. 15/058,656, mailed on Sep. 18, 2017.
Notice of Allowance received for U.S. Appl. No. 15/836,020, mailed on Sep. 26, 2018.
Notice of Allowance received for U.S. Appl. No. 16/189,859, mailed on Jun. 17, 2020.
Notice of Allowance received for U.S. Appl. No. 16/707,571, mailed on Aug. 3, 2021.
Office Action dated Sep. 7, 2018 from U.S. Appl. No. 15/826,090, filed Nov. 29, 2017.
Office Action received for U.S. Appl. No. 11/149,913, mailed on Aug. 15, 2006.
Office Action received for U.S. Appl. No. 11/449,074, mailed on Mar. 3, 2009.
Office Action received for U.S. Appl. No. 11/745,325, mailed on Oct. 12, 2007.
Office Action received for U.S. Appl. No. 12/484,931, mailed on Sep. 10, 2010.
Office Action received for U.S. Appl. No. 12/967,671, mailed on Jul. 19, 2013.
Office Action received for U.S. Appl. No. 12/967,671, mailed on Jun. 19, 2014.
Office Action received for U.S. Appl. No. 12/967,671, mailed on May 6, 2015.
Office Action received for U.S. Appl. No. 13/164,721, mailed on Feb. 27, 2013.
Office Action received for U.S. Appl. No. 13/164,721, mailed on Jul. 11, 2013.
Office Action received for U.S. Appl. No. 14/332,705, mailed on Jun. 15, 2015.
Office Action received for U.S. Appl. No. 14/993,533, mailed on Oct. 6, 2017.
Office Action received for U.S. Appl. No. 15/058,656, mailed on Oct. 21, 2016.
Office Action received for U.S. Appl. No. 16/707,571, mailed on Feb. 19, 2021.
Pages from Homereserve.com website, https://web.archive.org/web/10180812044005/http://homereserve.com/#, Aug. 12, 2018 (10 pgs).

* cited by examiner

RECONFIGURABLE MODULAR FURNITURE ASSEMBLY WITH OVERLAPPING GEOMETRY

CROSS-REFERENCE TO RELATED APPLICATIONS

This application claims the benefit of and priority to U.S. Provisional Patent Application Ser. No. 63/046,287 filed on Jun. 30, 2020, and entitled "RECONFIGURABLE MODULAR FURNITURE ASSEMBLY WITH OVERLAPPING GEOMETRY," which application is expressly incorporated herein by reference in its entirety.

BACKGROUND

A variety of shapes and sizes of furniture have been developed over the years to provide comfort and decoration. Consumers appreciate furniture that can serve multiple purposes and withstand the wear of everyday use without requiring much attention. Thus, what is desirable is furniture that is versatile, durable, and relatively maintenance free.

Once purchased, consumers expect furniture that is already assembled or can be easily assembled. Once assembled, however, most furniture cannot be easily disassembled. Most furniture is assembled using nails, staples, epoxy, or some other type of fastener. Further, various types of furniture have upholstery covering the fasteners, thus making it difficult to disassemble the furniture. This presents a challenge for consumers, especially when the furniture needs to be transported from one location to another. While some modular furniture systems are available, many of these require tools for assembly, are often not particularly durable, and exhibit other shortcomings.

One aspect that makes furniture cost-prohibitive is shipping and packaging. For example, a large piece of furniture requires an even larger amount of space during shipping. The non-solid or non-uniform shape of most furniture makes it difficult to maximize the space utilized when packaging and shipping furniture. This adds increased costs of shipping due to the amount of space the furniture requires, regardless of whether or not the furniture fills all or most of the required space.

Another aspect that makes furniture cost-prohibitive is the difficulty in stacking furniture. When large pieces of furniture are stacked, damage frequently occurs to the furniture on the bottom of the stack. This damage may result from the shape and non-solid nature of the packaged furniture. Even when furniture is disassembled and boxed in order to facilitate stacking, often there is still much wasted space. The wasted space not only increases the cost of shipping, but also provides for a less stable base on which to stack other pieces of furniture.

For those consumers who cannot afford many pieces of furniture, it is also desirable to have furniture which can provide multiple functions, or which can be reconfigured. For example, a couch with a relatively deep and soft seating surface can be desirable when lounging, watching television, or listening to music. In contrast, a couch with a relatively shallow seating surface is often more desirable when sitting upright while in conversation with others. Further, different shapes, sizes, and footprint configurations of furniture may be desired depending on the space which the furniture is to fill, such as a large living room, a small office space, or a home theatre setting.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

The disclosed embodiments relate to a modular furniture assembly that can be assembled, disassembled, and rearranged in a quick and efficient manner with minimal effort. In an exemplary embodiment, the modular furniture assembly includes a rectangular base (having a long side (X) and a short side (Y)), at least one transverse or upright member (having a thickness ($Z_1$)). The rectangular base, and the upright member, has holes used to mount adjacent rectangular bases (a separation distance of the holes being $Z_2$). Connector leg assemblies, with connector legs that are designed to be longer or greater in height than traditional modular designs, facilitate coupling the upright member to the base and can also facilitate coupling of adjacent bases when the modular furniture assembly includes a plurality of bases. In accordance with the disclosed principles, the dimensions of the long side of the base satisfy the following relationship: $X=Y+2Z$, where Z can be either $Z_1$ or $Z_2$. When the dimensions of the long side of the base satisfies the relationship $X=Y+2Z_2$, it is still possible to adjust a $Z_1$ dimension of the transverse or upright member while maintaining the capability to assemble, disassemble, and rearrange the modular furniture assembly. Using the identified relationship, lends itself to use of slimmer, thinner upright members, while preserving a significant difference in seat depth between a shallow-seat orientation, such as where the (X) dimension is oriented perpendicular to the user's legs seated on the base, and the deep-seat orientation of the base, such as where the (Y) dimension of the base is oriented perpendicular to the user's legs seated on the base. The $X=Y+2Z$ geometry lends itself to maintaining spacing of the components of the modular furniture assembly, such as but not limited to the bases, upright members, and connector leg assemblies, when uprights members are replaced or changed. For instance, by maintaining $X=Y+2Z_2$ when the $Z_1$ is larger than $Z_2$, for instance, the coupling locations for the connector leg assemblies with the base and the upright members remains substantially the same, thus allowing for enhanced interchangeability for the components of the modular furniture assembly.

The disclosed embodiments bring about substantial benefits, improvements, and practical implementations to the technical field. By way of example, the improved design presented herein provides connector leg assemblies that provide secure connection, little lateral translation, while also allowing a cantilevered end of the base to tilt without placing stress on the coupling structures, or base itself. Allowing the seat end to tilt in this manner while supported on only one side both prevents internal damage to the seat structure while also simplifying assembly, as a user does not need an extra hand to hold the free end of the seat up.

The new $X=Y+2Z$ geometry also better lends itself to slimmer, thinner upright members (for a unique and particular aesthetic appearance or style), while preserving a significant difference in seat depth between a shallow-seat orientation (where the (X) dimension of the base is oriented perpendicular to the user's legs seated on the base) and the deep-seat orientation of the base (where the (Y) dimension of the base is oriented perpendicular to the user's legs seated on the base). In other words, if using another geometry, such as a geometry governed by the equation $X=Y+Z$, the difference between the (X) and the (Y) dimension of the base becomes far less pronounced, where the rectangle base approaches a square shape, resulting in no significant difference between a resulting shallow-seat orientation and a deep-seat orientation of the base.

With thinner upright members, the embodiments also offer an improved, modern design, look, and feel. Thinner members also result in smaller and lighter overall packaging for shipping. Furthermore, using the new spatial relationship of the base disclosed herein (e.g., X=Y+2Z), the embodiments beneficially permit use of a thinner upright member, while preserving a more elongate rectangular-like shape, for the horizontal members, thereby increasing the seat depth difference between various different orientations and thereby making those orientations more distinct from one another. For instance, customers can change the length or depth of their modular furniture assembly more significantly than in traditional designs, while having the aesthetics of slim upright members.

In particular, in some embodiments, a modular furniture assembly includes a rectangular base and an upright member. The base has a dimension of a long side (X) and a dimension of the short side (Y). The upright member has a thickness, width, or dimension ($Z_1$), and also has a length dimension, which may be substantially equal to the dimension of the long side (X), substantially equal to the dimension of the short side (Y), substantially equal to (X)+(Z). Multiple upright members, of different such dimension, may be provided and used in the present modular furniture assemblies. The base and the upright member have a defined spatial relationship in which the dimension of a long side (X) of the base, such as a length of the base, is substantially equal to the sum of the dimension of a short side (Y) of the base, such as a width of the base, and two times a dimension Z that can be the thickness or width ($Z_1$) of the upright member or a separation distance of the holes in the base and the upright member and a separate distance between holes in the base and holes the upright members ($Z_2$). The dimension $Z_2$ can match $Z_1$ or $Z_1$ can be larger or smaller than $Z_2$; as a result of this improved spatial relationship, different furniture configurations can be formed.

Optionally, the modular furniture assembly further includes a connector leg assembly that couples the base and the upright member together. The connector leg assembly includes one or more protruding members that each include a top end and a base portion. The top end is narrower than the base portion to thereby allow tilting of the base when the modular furniture assembly is in a partially assembled state. The protruding member can form part of the connector leg assembly or can extend from the base to be received in a complementary opening or hole provided by the connector leg assembly.

In some embodiments, a modular furniture assembly includes a base and an upright member. Here, the base is configured to have a dimension of a long side (X), such as a length, in a horizontal plane and a dimension of a short side (Y), such as a width, in that same plane. The upright member is configured to have a length as noted above in the horizontal plane and a thickness or width ($Z_1$) also in that horizontal plane. The upright member is also configured to be positioned such that a height ($H_U$) of the upright member is substantially greater than a height (H) of the base. The height ($H_U$) can be within a vertical plane transverse to the horizontal plane, with the upright member being in the vertical plane or being inclined in relation to horizontal planer. The base and the upright member also have a spatial relationship defined in a manner so that the dimension of a long side or length (X) of the base is substantially equal to the sum of the dimension of a short side or width (Y) of the base and two times a dimension Z, such as $Z_1$ or $Z_2$ where $Z_1$ can be a dimension or width of any one of the upright members and $Z_2$ can be a separation distance of the holes in the base and upright members and a separate distance between holes in the base and holes in the upright members. Using this new spatial relationship, numerous different furniture configurations can be formed.

Some embodiments of a modular furniture assembly are structured to include a base and multiple upright members. Here, the base is configured to have a dimension of a long side or length (X), a dimension of a short side or width (Y), and a height (H). Each of the upright members has a dimension of a dimension or long side (X'), a dimension or width ($Z_1$), and a dimension or height ($H_U$). The height ($H_U$) of each upright member is substantially greater than the height (H) of the base. Additionally, the base and the multiple upright members have a defined spatial relationship defined as indicated herein, where: the dimension of a long side or length (X) of the base is substantially equal to the sum of the dimension of a short side or width (Y) of the base and two times a dimension Z that can be the width ($Z_1$) of any one of the upright members or a separation distance of the holes in the base and upright members and a separate distance between holes in the base and the holes in the upright members ($Z_2$).

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Figure 1A:
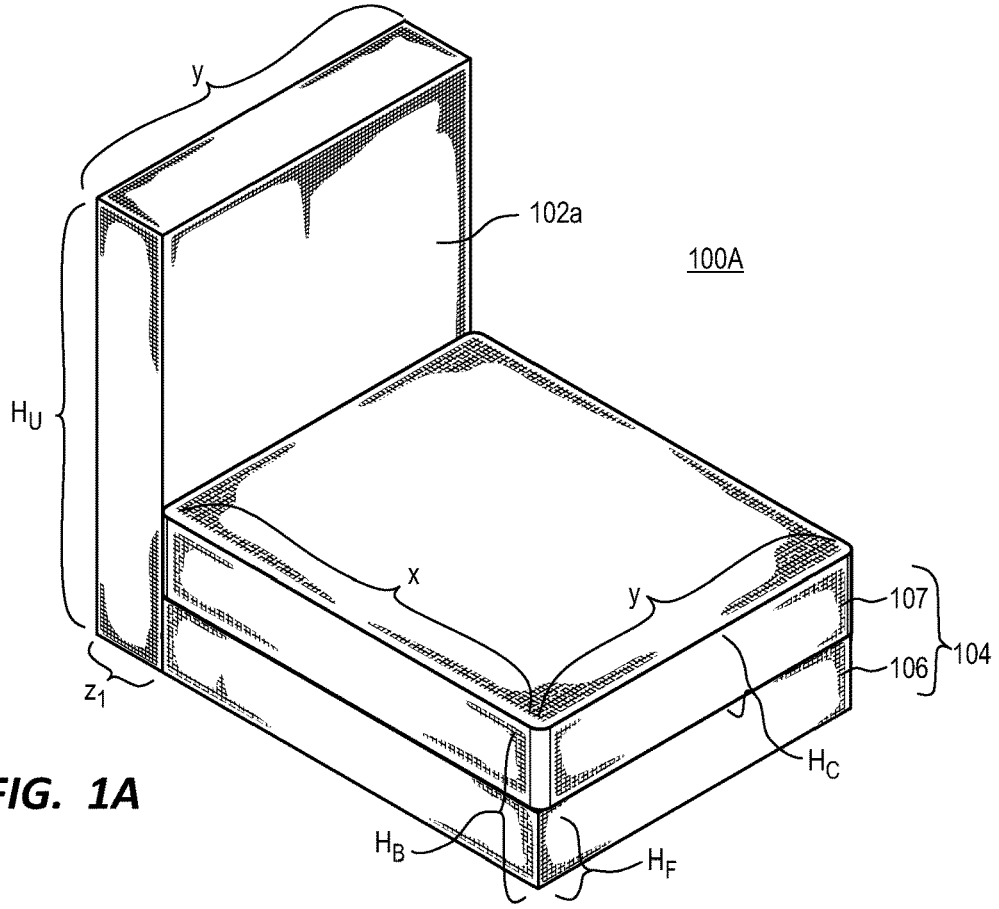
FIGS. 1A, 1B, and 1C are perspective views illustrating a modular furniture assembly having a base coupled to a transverse/upright member to form a chair.

One or more specific embodiments of the present disclosure will be described below where like reference characters or numerals designate the same or similar parts throughout the figures. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

One or more embodiments of the present disclosure may generally relate to modular furniture assembly that can be assembled, disassembled, and rearranged in a quick and efficient manner with minimal effort. While the present disclosure will describe a particular implementation of modular furniture assembly that can be assembled, disassembled, and rearranged, it should be understood that any of the modular furniture assemblies, and methods described herein may be applicable to other uses. Additionally, elements described in relation to any embodiment depicted and/or described herein may be combinable with elements described in relation to any other embodiment depicted and/or described herein.

In some embodiments, a modular furniture assembly as disclosed herein includes a base and an upright or transverse member. The base has a dimension of a long side or length (X) and a dimension of a short side or width (Y). The upright member has a dimension, thickness or width ($Z_1$), and a length, which may vary depending on need. As used herein, the X dimension refers to a long side or dimension of the base and the Y dimension references a short side or dimensions of the base, whether or not the terms "length" or "width" are used in association with the particular X and Y dimension. Additionally, even when the base is rotated for use with or to form different modular furniture assemblies, the X and Y dimensions still refer to, respectively, to the long side or dimension and short side or dimension.

In an embodiment, the length of the upright member is (X'), equal or substantially equal to (X). The base and the upright member have a defined spatial relationship in which the length (X) of the base is substantially equal to the sum of the width (Y) of the base and two times or twice a dimension Z that can be the dimension, thickness, or width ($Z_1$) of the upright member or a separation distance of the holes in the base and the upright member and a separate distance between holes in the base and the holes in the upright members ($Z_2$), the separation distance being illustrated and discussed hereinafter. The dimension $Z_2$ can match $Z_1$ or $Z_1$ can be larger or smaller than $Z_2$ so long as $Z_2$ in the base and the upright members match. With the dimension $Z_1$ larger than $Z_2$ wider upright members can be used with the modular furniture. With the dimension $Z_2$ matching $Z_1$ the coupling locations for connector leg assemblies, which connect adjacent bases and the upright members, remain substantially the same, thus allowing for enhanced interchangeability for the components of the modular furniture assembly. As a result of this improved spatial relationship, various different furniture configurations can be formed, from a small number of the same basic components.

In some embodiments, a modular furniture assembly includes a base and an upright member. The base has a length (X) in a horizontal plane and a width (Y) in that same plane. The upright member also has a length in the horizontal plane and a width (Z) in that plane. The height ($H_U$) of the upright member is substantially greater than a height (H) of the base. The base and the upright member also have a spatial relationship defined in a manner so that the length (X) of the base is substantially equal to the sum of the width (Y) of the base and two times a dimension Z that can be the dimension, thickness, or width ($Z_1$) of the upright member or the separation distance of the holes in the base and the upright members and a separate distance between holes in the base and the holes in the upright members ($Z_2$). As mentioned above, with the dimension $Z_2$ matching $Z_1$ enhanced interchangeability for the components of the modular furniture assembly is achieved. Using this new spatial relationship, numerous different furniture configurations can be formed, while using relatively slim upright members, while maintaining a distinct rectangular configuration to the base. Additionally, such as when Z is $Z_2$, the new spatial relationship provides for a geometry lends itself to maintaining spacing of the components of the modular furniture assembly, such as but not limited to the bases, upright members, and connector leg assemblies, when uprights members are replaced or changed. For instance, by maintaining $X=Y+2Z_2$ when the $Z_1$ is larger than $Z_2$, for instance, the coupling locations for the connector leg assemblies with the base and the upright members remains substantially the same, thus allowing for enhanced interchangeability for the components of the modular furniture assembly.

Some embodiments of a modular furniture assembly are structured to include a base and multiple upright members. The base has a length (X), a width (Y), and a height (H). Each of the upright members has a length, a width (Z), and a height ($H_U$). The height ($H_U$) of each upright member is substantially greater than the height ($H_B$) of the base. The base and the multiple upright members have a defined spatial relationship defined in the following manner: the length (X) of the base is substantially equal to the sum of the width (Y) of the base and two times a dimension Z that can be the dimension, thickness, or width ($Z_1$) of any one of the upright members or the separation distance of the holes in the base and the upright members and a separate distance between holes in the base and the holes in upright members ($Z_2$). In one configuration, the dimension $Z_1$ is the same as the dimension $Z_2$ although in other configurations $Z_1$ can be larger or smaller than $Z_2$. With the dimension $Z_1$ larger than $Z_2$ wider upright members can be used with the modular furniture. With the dimension $Z_2$ matching $Z_1$ enhanced interchangeability for the components of the modular furniture assembly is achieved. Using this new spatial relationship, multiple different configurations can be formed from the same basic components.

Optionally, the modular furniture assembly further can include a connector leg assembly that couples together one or more bases and optionally one or more bases to one or more upright members. The connector leg assembly includes one or more protruding members that each include a top end and a base portion. The top end is narrower than the base portion to thereby allow tilting of the base when the modular furniture assembly is in a partially assembled or disassembled state. The protruding member can form part of the connector leg assembly or can extend from the base to be received in a complementary opening or hole provided by the connector leg assembly.

The disclosed embodiments bring about substantial benefits, improvements, and practical implementations to the technical field. While some example improvements and practical applications provided by the disclosed embodiments are provided herein, it will be appreciated, however, that these are just examples only and that the embodiments are not limited to only these improvements. By way of example and not limitation, the improved structure of the modular furniture assembly provides for improved sitting comfort while maintaining modularity. Smaller components facilitating improved shipping characteristics can be used without decreasing seating area, thereby leading to decreased shipping costs, improved maneuverability, improved assembly, and improved rearrangement.

During assembly, one seat end of the modular furniture assembly can be left unsupported on one end in a cantilevered manner, thereby causing stress and tension on the coupling components. As will be discussed in more detail herein, the improved modular furniture assembly presented herein provides connector leg assemblies that provide secure connection and little lateral translation, while also allowing the seat end to tilt, such as in a cantilevered manner, without placing stress on the coupling components. Allowing the seat end to tilt in this manner while supported on only one side both prevents internal damage to a structure of the modular furniture assembly while also simplifying assembly.

With thinner upright members, the embodiments also offer an improved, modern design, look, and feel. Thinner upright members also result in smaller and lighter overall packaging for shipping. Furthermore, using a new spatial relationship of the base and upright members, and the overall orientation of the modular furniture assembly, in addition to achieving a thinner upright member, the new spatial relationship causes the horizontal members or the base to approach a more elongate rectangular shape, thereby increasing a seat depth difference between various different orientations and thereby making those orientations more distinct from one another. For instance, customers can change the length or seat depth of their modular furniture assembly more significantly than in traditional designs. Additionally, such as when Z is $Z_2$, the new spatial relationship provides a geometry that lends itself to maintaining spacing of the components of the modular furniture assembly, such as but not limited to the bases, upright members, and connector leg assemblies, when uprights members are replaced or changed. For instance, by maintaining $X=Y+2Z_2$ when the $Z_1$ is larger than $Z_2$, for instance, the coupling locations for the connector leg assemblies with the base and the upright members remains substantially the same, thus allowing for enhanced interchangeability for the components of the modular furniture assembly.

The new special relationship of dimensions, X=Y+2Z, lends itself to using the thinner upright members and provide for a unique and particular aesthetic appearance or style, while preserving a significant difference in seat depth between a shallow-seat orientation, where the (X) dimension is oriented perpendicular to the user's legs seated on the base, and the deep-seat orientation of the base, where the (Y) dimension of the base is oriented perpendicular to the user's legs seated on the base.

Additionally, the new spatial relationship enables the modular furniture assembly to accommodate a wider range of human body sizes and a wider range of preferences. A short or narrow depth may be comfortable for some while a long or deep depth may be comfortable for others. The disclosed embodiments provide increased customizability, thereby leading to substantial improvements in the technical field. These and numerous other benefits will now be discussed in more detail with regard to the Figures presented by this disclosure.

With this background, and with reference to FIGS. 1A-1C and 2, illustrated are various modular furniture assemblies, such as a modular furniture assembly 100A, a modular furniture assembly 100B, and a modular furniture assembly 100C. The modular furniture assemblies described here are generally referenced as modular furniture assembly or assemblies 100. Each of the modular furniture assemblies 100A, 100B, include a horizontal member or base 104 and one or more transverse or upright members 102 (such as transverse or upright members 102*a*, 102*b*), with the transverse or upright members 102*a*, 102*b* being selectively and detachably coupled to the base 104. With the upright members 102*a*, 102*b*, acting as a resting surface for a user's back or arm, a single base, such as the base 104, can be used with differently sized and orientated transverse or upright members 102*a*, 102*b*, to achieve or form different configurations of modular furniture assemblies. Many bases 104 and upright members 102*a*, 102*b* can be utilized to form a variety of differing furniture assemblies. In addition, the bases 104 and upright members 102 disclosed and contemplated by this disclosure can be proportionately sized to accommodate different sizes of individuals. As such, a variety of types, sizes, and configurations of furniture assembly can be made in a quick and convenient fashion by utilizing the disclosed embodiments.

With reference to FIG. 1A, the modular furniture assembly 100A includes a transverse or upright member 102*a* and a horizontal member or base 104 that is selectively and detachably coupled to the upright member 102*a*. The upright member 102*a* acts as a resting surface for a user's back or arm. The upright member 102*a* is shown as having various dimensions, including a dimension ($Z_1$), such as a thickness or width, a short side or dimension (Y), and a height $H_U$ (it being understood that the height $H_U$ can also be considered as a long side or dimension of the upright member 102*a*).

The base 104 serves as a support surface on which a user can sit or rest. The base 104 is configured such that the upright member 102*a* can be positioned adjacent to or perpendicularly to the base 104 in a variety of positions and detachably coupled thereto to form different types of furniture assemblies. The upright member 102*a* can be coupled to any of the 4 sides of base 104 by way of a coupler mechanism or coupler, which will be described in more detail hereinafter, that allows a user to quickly couple or decouple the upright member 102*a* and the base 104 with minimal effort, potentially even without the use of a tool, such as a screwdriver, wrench, hammer, etc. The ease of coupling the upright member 102*a* to the base 104 provides for the capability of easily forming many configurations of furniture assemblies.

As shown in FIG. 1A, base 104 is configured to provide a comfortable sitting or resting surface for a user. Base 104 has various dimensions, including a dimension of a long side or length (X), a dimension of a short side or width (Y), and a height ($H_B$). Base 104 is also configured to be easily disassembled for rearranging, moving, storing, and/or shipping. In the illustrated configuration, base 104 includes a frame assembly 106, which has the same dimension of the base 104, such as the same width (Y), the same length (X), and a height ($H_F$), and a cushion 107. Frame assembly 106 is configured to support the weight of a user while the user is sitting or resting on base 104. The cushion 107 is configured to be mounted on the frame assembly 106 so as to provide a useful and comfortable sitting or resting area for a user. The cushion 107 can be easily mounted on or removed from the frame assembly 106, with the mounting being achieved through hook-and-loop fastener mounted to the cushion 107 and the frame assembly 106, for instance, or another fastener having complementary structures mounted on the cushion 107 and the frame assembly 106. Additionally, varying a height ($H_C$) of the cushion 107 can vary the overall height ($H_B$) of the base 104.

Figure 1B:
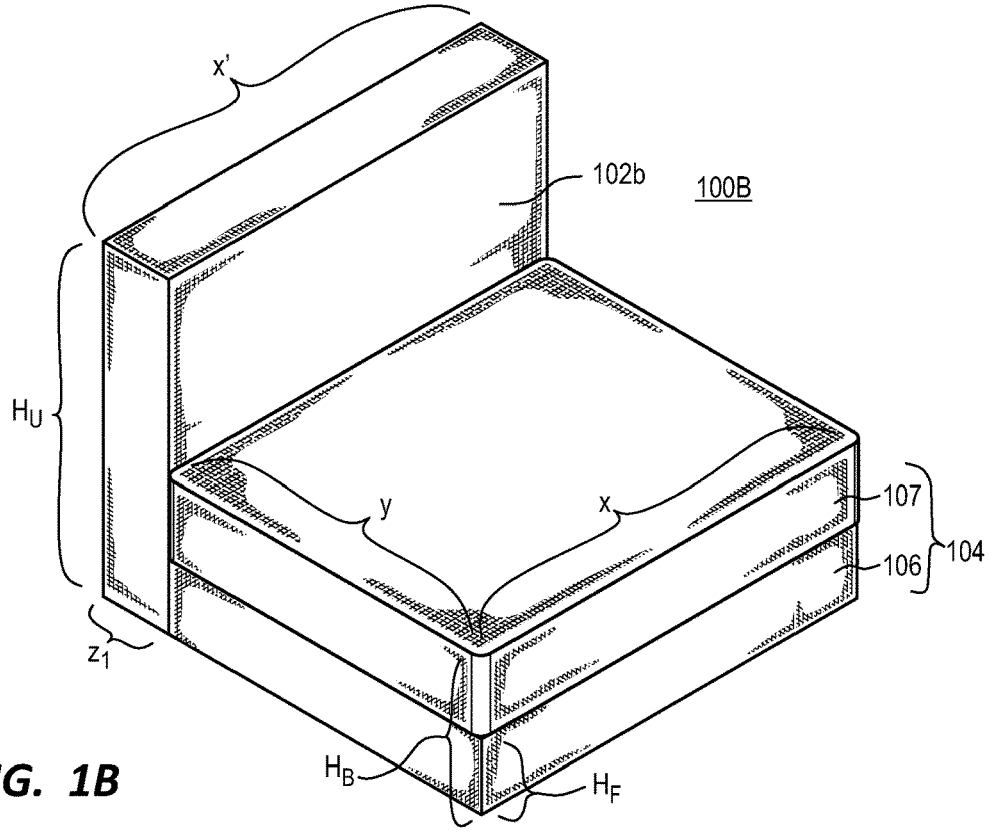
Figure 2:
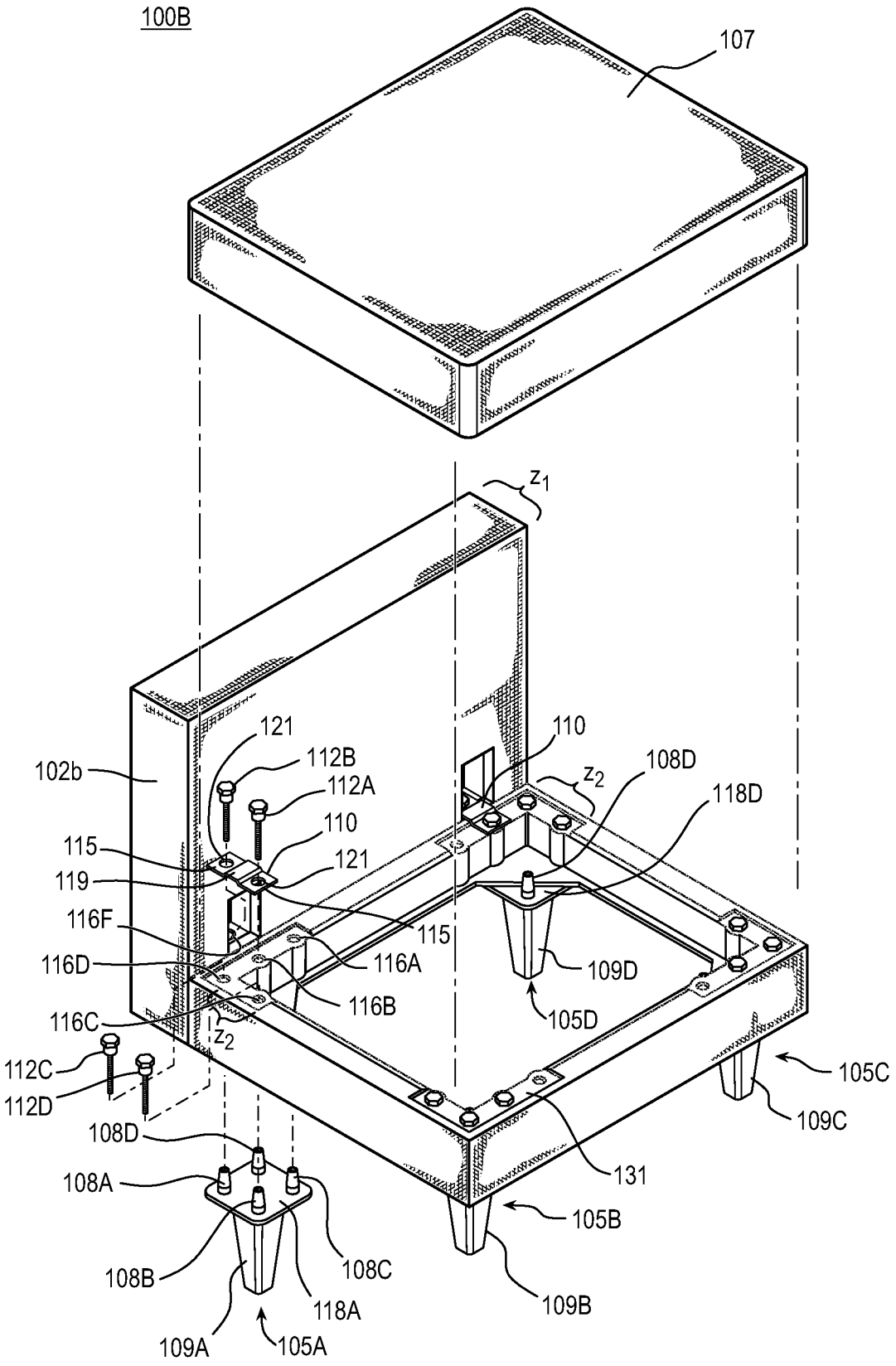
FIG. 2 is an exploded cutaway view illustrating the base, adjacent to a coupled upright member.

As mentioned above, the modular furniture assemblies may include differently configured upright members, of varying dimensions, such as lengths, for use in different positions relative to base 104. FIG. 1A shows how one upright member 102*a* is adapted to be detachably coupled to the base 104 in a variety of ways and configurations so as to form a variety of unique and custom furniture assemblies, such as furniture assembly 100A. No matter the particular length, for example, associated with the upright member, generally speaking the upright member and base can be sized and configured according to a defined spatial relationship, wherein the dimension of a long side or length (X) of the base is substantially equal to the dimension of a short side or width (Y) of the base plus two times a dimension Z that can be the thickness ($Z_1$) of the upright member or a separation distance of the holes in the base and the upright members and a separate distance between holes in the base and holes in the upright members ($Z_2$)(FIG. 2). The upright members may be provided in varying lengths or dimensions, e.g., where the short side or dimension (Y) of the upright member 102*a*, for instance, may be equal, or substantially equal to the short side or dimension (Y) of the base 104. Another upright member, such as upright member 102*b* of modular furniture assembly 100B in FIG. 1B, may be slightly longer, where the long side or dimension (X') of the upright member may be equal, or substantially equal to the dimension of the long side or length (X) of the base 104, as shown in FIG. 1B. Another upright member, such as upright member 102*c* shown in FIG. 9A and FIG. 11A, may be even longer, where the long side or dimension of the upright member 102*c* may be equal, or substantially equal to the dimension of the long side or length (X) of the base 104 plus the dimension or thickness ($Z_1$) of the upright member 102*a*. Another upright member, such as upright member 102*d* shown in FIG. 9B and FIG. 11B, may have a length of equal or substantially equal to the dimension of the short side or width (Y) of the base 104 plus the dimension or thickness ($Z_1$) of the upright member 102*d*.

In the disclosed embodiments, no matter the employed upright member, such as upright members 102*a*, 102*b*, 102*c*, 102*d*, the base 104 and upright member 102*a*, 102*b*, 102*c*, 102*d* are configured in such a manner so as to satisfy the following spatial relationship between the X, Y, and Z dimensions:

$$X=Y+2Z$$

In other words, by following this spatial relationship, the long side of the horizontal member or base 104 is equal to the short side of the base 104 plus two times the dimension or thickness or width ($Z_1$) of any of the upright members, such as for example upright members 102*a*, 102*b*, 102*c*, or 102*d* or, alternatively, a separation distance of the holes in the base and upright members and a separate distance between holes in the base and holes in the upright ($Z_2$) (FIG. 2). One result of following this spatial relationship is that the base 104 remains distinctly "rectangular" (i.e., more elongate) as compared to traditional "square-like" configurations, particularly where the (Z or $Z_1$) dimension of the upright member 102 is relatively thin, such as when the (Z or $Z_1$) dimension is less than about 6 inches. Maintaining a more rectangularly-shaped horizontal member or base 104 using the defined spatial relationship of X=Y+2Z results in enhanced modularity and customizability, particularly for such slim upright members 102*a*, 102*b*, 102*c*, 102*d*, because the difference in the dimensions of the two edges of the base 104 are maintained, rather than collapsing towards a more square-shaped base design. With a more rectangularly-shaped base 104, customers can change the length of the modular furniture assembly more significantly, as shown by FIG. 1B and various of the other figures, by simply rotating the orientation of the base, such as base 104, from a "deep seat" orientation as shown in FIG. 1A, to a "shallow seat" orientation as shown in FIG. 1B. FIG. 1A also shows use of the upright member 102*a* having a long side or dimension equal to the dimension of the short side or width (Y) of base 104, while FIG. 1B shows use of the upright member 102*b* having a long side or dimension equal to the dimension of the long side or length (X) of base 104. All such upright members 102*a*, 102*b*, 102*c*, or 102*d* may more generically be referred to herein simply as upright members, with or without a reference designation.

For instance, whereas the configuration in FIG. 1A illustrated the modular furniture assembly 100A with a deep seat configuration with the long side of the base 104 being perpendicular to the upright member 102*a*, the configuration shown in FIG. 1B illustrates the modular furniture assembly 100B with a shallow seat configuration with the long side of the base 104 parallel to the upright member 102*b*.

The modular furniture assembly 100B, which is representative of the modular furniture assembly 100A of FIG. 1A but in a new configuration, includes upright member 102*b*, having a long side (X') that is equal, or substantially equal to the dimension of the long side or dimension (X) of base 104, a thickness or width Z'1, which is substantially equal to the width ($Z_1$), and a height $H_U$ (which can be considered a short side of the upright member 102*b*). In this example configuration, the upright member 102*b* is referred to herein as a "longer" upright member while the upright member 102*a* is referred to as a "shorter" upright member. Additional details on the variously sized upright members will be provided hereinafter.

The modular furniture assembly 100B includes the same base 104 as the modular furniture assembly 100A having a dimension of the long side or length (X), a dimension of the short side or width (Y), and a height ($H_B$). As a result of the rectangular-shaped base 104, a customer is able to change the depth or seating length of the modular furniture assembly by rearranging the assembly's constituent parts in different ways.

Accordingly, FIGS. 1A and 1B illustrate a modular furniture assembly that includes a base 104 and an upright member, respectively upright member 102*a* and upright member 102*b*. Here, the base 104 has a dimension of the long side or length (X) and a dimension of the short side or width (Y). The upright member 102*a* has a length (Y) equal to the base dimension of the short side or width in FIG. 1A, and the upright member 102*b* has a length (X'), equal or substantially equal to the base dimension of the long side or length (X) in FIG. 1B. For both upright members 102*a*, 102*b*, a width ($Z_1$) or ($Z'_1$), where ($Z'_1$) is substantially equal to ($Z_1$), is provided. The base 104 and the upright members 102*a*, 102*b* have a defined spatial relationship relative to one another. This defined spatial relationship is as follows: the dimension of the long side or length (X) of the base 104 is substantially equal to the sum of the dimension of the short side or width (Y) of the base 104 and two times the dimension or width ($Z_1$) of the upright member 102*a*, 102*b*. As a result of using this spatial relationship, numerous different furniture configurations can be formed. As noted, this spatial relationship is provided, whether the upright member is of the shorter configuration, such as the upright member 102*a* of FIG. 1A, the longer configuration, such as the upright member 102*b* of FIG. 1B, or other configuration, such as upright members 102*c* or 102*d* of FIGS. 1C, 9B, 10B, and 11B), as the dimension, thickness, or width ($Z_1$) of the upright member is the same, for all such upright members.

In some embodiments, the long side or length (X') of the upright member 102*b* is substantially equal to the dimension of the long side or length (X) of the base 104, as shown in FIG. 1B. As shown in FIG. 1A, in some embodiments a shorter upright member is provided, where the length or short side of the upright member 102*a* is equal or substantially equal to the dimension of the short side or width (Y) of the base 104. In some embodiments an upright member having even a greater length than that of FIG. 1B may be provided, where the upright member 102*c*, FIG. 1C, has a length that is substantially equal to the sum of the dimension of the long side or length (X) of the base 104 and the dimension, thickness or width ($Z_1$) of the upright member 102*c*. Such differently sized upright members are advantageously employed as backrest members, and/or armrest members, depending on the particular arrangement of bases and upright members employed, to form any of a wide variety of furniture assembly configurations, as disclosed herein.

In some cases, a height ($H_U$) of the upright member (e.g., 102*a* or 102*b* in FIGS. 1A-1B) is substantially greater than a height ($H_B$) of the base 104. Additionally, the height ($H_U$) of the upright member may be perpendicular to the long side or the short side of the upright member. In some implementations, the long side of the upright member is a dimension or length in a horizontal plane, and the long side or length (X) of the base 104 is a dimension or length in the same horizontal plane. Here, the short side or width (Y) of the base 104 would also be in the same horizontal plane, and the dimension, thickness or width ($Z_1$) of the upright member is also in the same horizontal plane. The height ($H_F$) refers to the height of the frame assembly 106 and is included in the height ($H_B$).

Figure 1C:
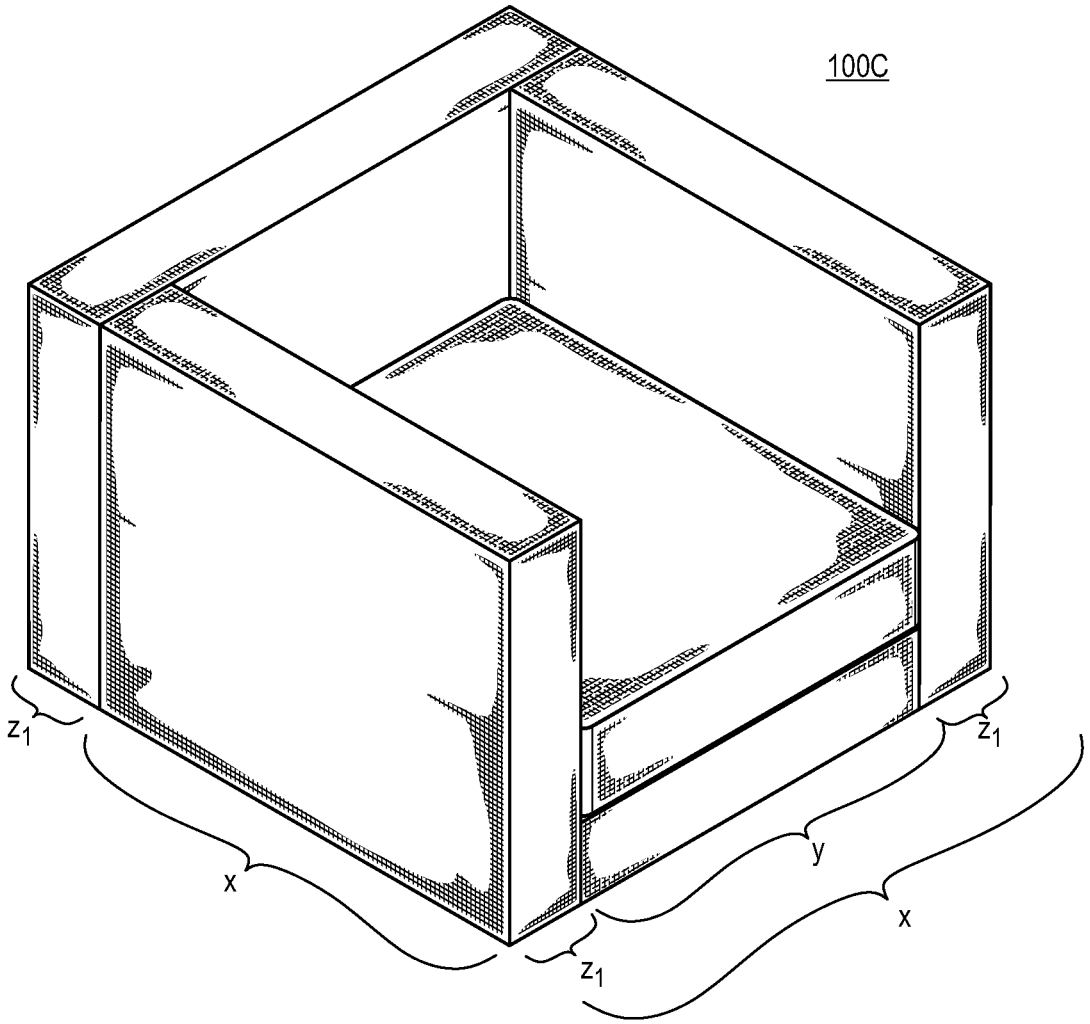

FIG. 1C shows a modular furniture assembly 100C with a slightly different configuration than those described in FIGS. 1A and 1B. Specifically, FIG. 1C shows the relationship between the X-Y-Z dimensions. In addition to the base and upright members shown in FIG. 1A, the modular furniture assembly 100C also includes two armrests, each of which has a dimension, thickness or width ($Z_1$). In this example configuration, the entire width of the modular furniture assembly 100C is now (X), where the dimension (X) is the dimension (Y) plus two times the dimension ($Z_1$). With this configuration, the modular furniture assembly 100C is approaching (but not fully) a square-like shape. In other words, the modular furniture assembly 100C, as a whole, is still rectangular in shape, but it is more closely approaches a square as compared to the previous configurations. In particular, the dimensions in FIG. 1C are (X) and ($X+Z_1$), which is approaching a square-like configuration.

Figure 3:
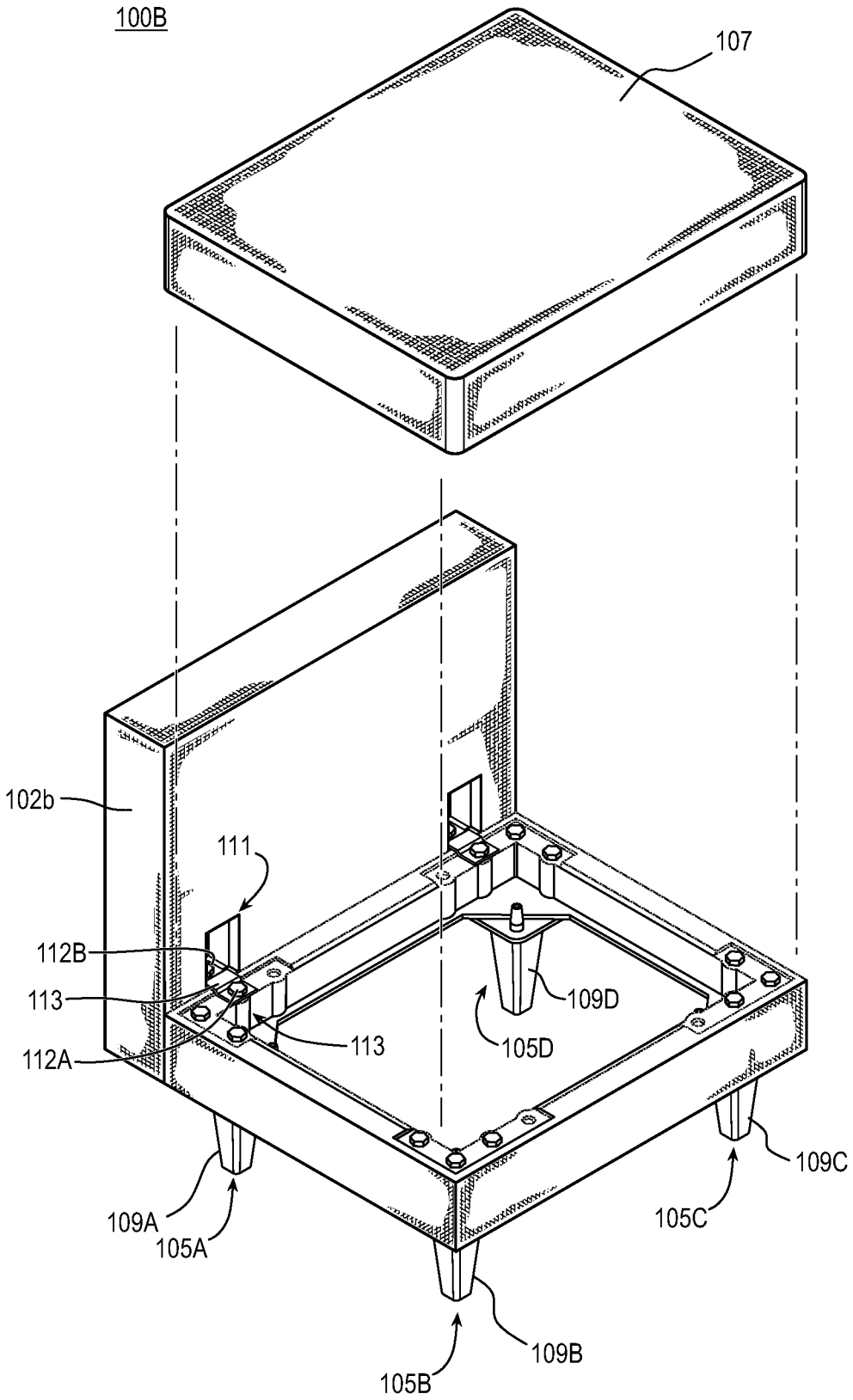
FIG. 3 is another exploded cutaway view illustrating the base, adjacent to the upright member.

Having introduced the spatial relationship between the base and the upright member of the modular furniture assembly, attention will now be directed to FIGS. 2 and 3, which illustrate the modular furniture assembly 100B, showing additional features thereof. Such is representative of the modular furniture assemblies illustrated in FIGS. 1A and 1B, as well as other assemblies shown herein. Modular furniture assembly 100B includes upright member 102*b*, base 104 (comprising cushion 107 and frame assembly 106), and multiple connector leg assemblies 105A-105D, each including a connector leg 109A-109D, and an associated connector member 118, such as a connector plate 118. The connector legs 109B-109D are illustrated as being in a connected or attached state to the base 104 (particularly frame assembly 106), via an associated connector member or plates 118B-118D. The connector leg 109A, with its associated connector plate 118A, on the other hand, is illustrated as being in a detached or uncoupled state relative to the base 104.

In accordance with the disclosed principles, the connector legs 109A-D are designed to be taller than conventional furniture legs. As a result of being taller, the taller legs utilize a new method for connecting horizontal and upright members. For instance, in some implementations, the height of each connector leg 109A-D is approximately 7 inches. In some implementations, the height is from about 6 inches to about 8 inches. In some implementations, the height can be higher than about 8 inches, such as about 10 inches, or more than about 10 inches).

Each connector leg assembly 105A-105D includes a connector plate 118A-118D, with connector plates 118A and 118D being illustrated in FIG. 2, with a number of protruding members, such as protruding members 108A-108D. These protruding members 108A-108D are used to secure the connector leg assembly 105A-105D to the base 104, such as the frame assembly 106. That is, the protruding members are first coupling units or first coupler, and the base 104 has a number of corresponding second coupling units or second coupler into which the protruding members are inserted in a secure manner so as to affix the connector leg to the base 104. In another embodiment, the location of first and second coupling structures could be reversed such that protruding members 108A-108D extend from the frame assembly 106 are received within second coupling units or second coupler in the connector plates 118A-118D (such as holes or recesses, optionally threaded). In still another configuration, the coupling units or couplers can omit protruding members 108A-108D and the connector plates 118A-118D can include holes or recesses that cooperate, such as threaded, mechanical or interference fit connections, with a fastener 112A-112D without the protruding members 108A-108D. Details of the second coupling with be provided hereinafter.

FIG. 2 illustrates this coupling process using a fastener coupling mechanism, though other mechanisms are also possible, as will be discussed hereafter. To facilitate the coupling process, a clamp assembly 110 including coupling plate 113 (e.g., a metal plate, polymeric plate, composite plate, combination and/or modifications thereof or other structures) may be used in conjunction with a fastener 112A and a fastener 112B. The coupling member or plate 113 can include a first and second legs 115 separated by a raised portion 119. Holes 121 are disposed in the first and second legs 115 to receive the fasteners 112A and 112B. While reference is made to the clamp assembly 110 including the coupling plate 113 and the fastener 112A, 112B, it will be understood that in other configurations the clamp assembly 110 can include other coupling members or plates and other fasteners that facilitate mounting of the upright member 102 to the frame assembly 106. For instances, the fasteners can be bolts, however, in other configurations the fasteners 112A, 112B can be screws, friction fit connectors, interference fit connectors, threaded or non-threaded connectors or dowels, combination and/or modifications thereof.

In the illustrated configuration, the coupling plate 113 and the fasteners 112A and 112B are inserted into an opposite end of a number of passthrough or receiving holes, such as holes 116A, 116B, 116C, 116D, and 116E, from the end where the protruding members 108A-108D are inserted into corresponding holes in the frame assembly 106. For instance, the frame assembly 106 (and/or frame assembly of upright member 102*b*) includes the passthrough or receiving holes, such as holes 116A, 116B, 116C, 116D, and 116E. The holes 116A, 116B, 116C, 116D, and 116E terminate in a pocket or recessed portion 131 of the frame assembly 106. The pocket 131 also accommodating a portion of the coupling plate 113, such as one of the first and second legs 115 when the fasteners 112A and 112B are used to mount the upright member 102 to the base 104.

The modular furniture assembly 100B can be assembled in various different ways by selecting different ones of the holes 116A, 116B, 116C, 116D, and 116E to insert the protruding members 108A-108D of the connector leg assembly 105A-105D into. That is, the protruding members 108A-108D may be inserted into corresponding ones of the holes 116A, 116B, 116C, 116D, and 116E in a versatile manner to enable different resulting configurations. The holes 116A-116E can be sized to accommodate the protruding members 108A-108D. In one configuration, a diameter of at least a portion of each of the one or more of the holes 116A-116E approximately matches a diameter of a corresponding protruding member of the protruding members 108A-108D. In other configurations, a diameter of at least a portion of each hole 116A-116E is oversized in relation to a diameter of a corresponding protruding member 108A-108D, such that the diameter of the hole 116A-116E is between about 5% to about 200% larger than the diameter of the corresponding protruding member 108A-108D. This aids with tilting the connector leg assembly 105A-105D in relation to the base 104 or vice versa by providing additional space between the wall of the hole 116A-116E and the protruding member 108A-108D receive within the hole 116A-116E, and as will be discussed in more detail hereinafter. While the diameter of one or more of the holes 116A-116E is indicated as being between about 5% to about 200% larger than a diameter of the corresponding protruding member 108A-108D, in other configurations the holes 116A-116E are larger than a diameter of each of the protruding members 108A-108D by about 10% to about 150%, from about 15% to about 100%, from about 20% to about 75%, from about 30% to about 50%, or about 30%. Stated another way, the diameter of the one or more of the holes 116A-116E can be less than or equal to about 90% of the $Z_2$ dimension, less than or equal to about 80% of the $Z_2$ dimension, less than or equal to about 70% of the $Z_2$ dimension, less than or equal to about 60% of the $Z_2$ dimension, less than or equal to about 50% of the $Z_2$ dimension, less than or equal to about 40% of the $Z_2$ dimension, from about 30% to about 90% of the $Z_2$ dimension, from about 45% to about 75% of the $Z_2$ dimension, or from about 55% to about 65% of the $Z_2$ dimension.

The fasteners 112A-112D are also inserted into the same holes 116A, 116B, 116C, 116D, and 116E as the protruding members 108A-108D and are inserted through the corresponding holes 121 of the coupling plate 113. The fasteners 112A-112D are then inserted into the protruding members 108A-108D and are tightened to secure the connector leg assembly 105A-105D corresponding to leg 109A to the frame assembly 106 (and/or upright member 102*b*), optionally with a head of the fastener 112A-112D or other upper portion of the fastener 112A-112D within the pocket 131, this preventing the fastener 112A-112D impeding mounting of the cushion 107 to the frame assembly 106. More or less than the fasteners 112A-112D may be used for the connection process.

The other connector leg assemblies 105B-105D corresponding to legs 109B-109D are connected to the frame assembly in a similar manner. FIG. 3 shows a resulting connection. Specifically, FIG. 3 shows modular furniture assembly 100B including upright member 102*b*, base 104 (including the cushion 107 and the frame assembly 106), and one or more connector leg assemblies 105A-105D with associated connector legs 109A-D. The connector leg 109A is shown connected to the frame assembly 106 using a clamp assembly 110 (coupling plate 113 and a first fastener 112A and a second fastener 112B), it being understood that the connector leg 109D is similarly mounted or connected to the frame assembly 106. In the illustrated configuration, the upright member 102*b* includes a recessed area or recessed portion 111 in the inside major planar face of upright member 102*b*) in which the second fastener 112B and a portion of the coupling plate 113 are disposed within. The combination of the coupling plate 113 and the first and second fasteners 112A and 112B not only allow the connector leg 109A (and the entire associated connector leg assembly 105A) to be attached or coupled to the base 104 (or upright member 102*b*), but they also enable the upright member 102*b* to be physically attached or coupled to the base 104. In this regard, the connecting or coupling units, such as the coupling plate 113, the first and second fasteners 112A and 112B, and even the connector leg assembly 105A of which leg 109A forms a part, have a dual purpose of connecting multiple units (e.g., the upright member 102*b* and the base 104) to one another in an easy and efficient manner.

Figure 4A:
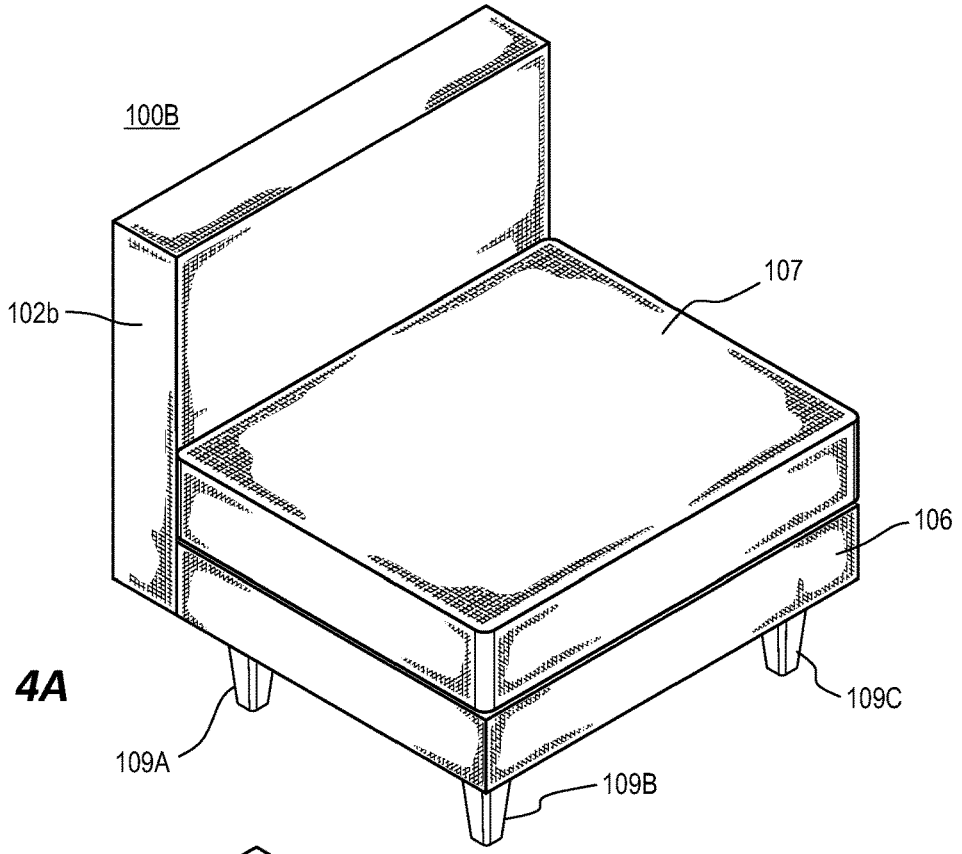
FIGS. 4A and 4B are perspective views illustrating how the modular furniture assembly is assembled.

FIG. 4A shows an example modular furniture assembly 100B that includes an upright member 102*b*, a base 104 (including a cushion 107 and a frame assembly 106), and multiple connector legs 109A-109C (connector leg 109D is hidden). In this configuration, the long end or side (i.e., length (X)) of the base 104 runs parallel to the length of the upright member 102*b*. As a result of using the spatial relationship defined earlier, the configuration or alignment of the modular furniture assembly 100B in FIG. 4A illustrates a shallow seat orientation.

Figure 4B:
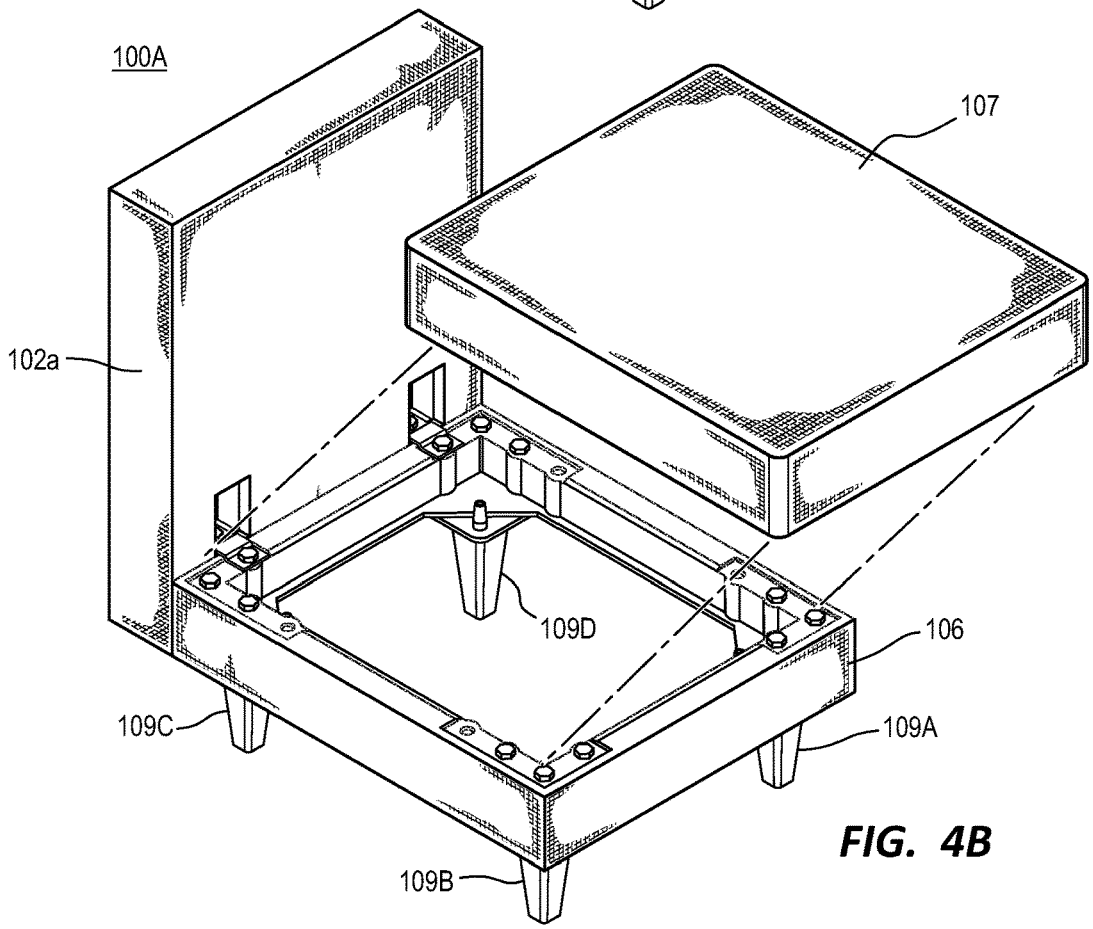

FIG. 4B, on the other hand, illustrates a similar modular furniture assembly 100A (similar to that of FIG. 1A), that employs the shorter upright member 102*a*, the same base 104 (including the cushion 107 and a frame assembly 106), and connector leg assemblies 105A-105D corresponding to legs 109A-109D. Compared to FIG. 4A now, however, the configuration of the modular furniture assembly 100A has been altered so that the long side (X) of the base 104 runs perpendicularly to the length of the upright member 102*a* to thereby provide a deep seat configuration.

Figure 5:
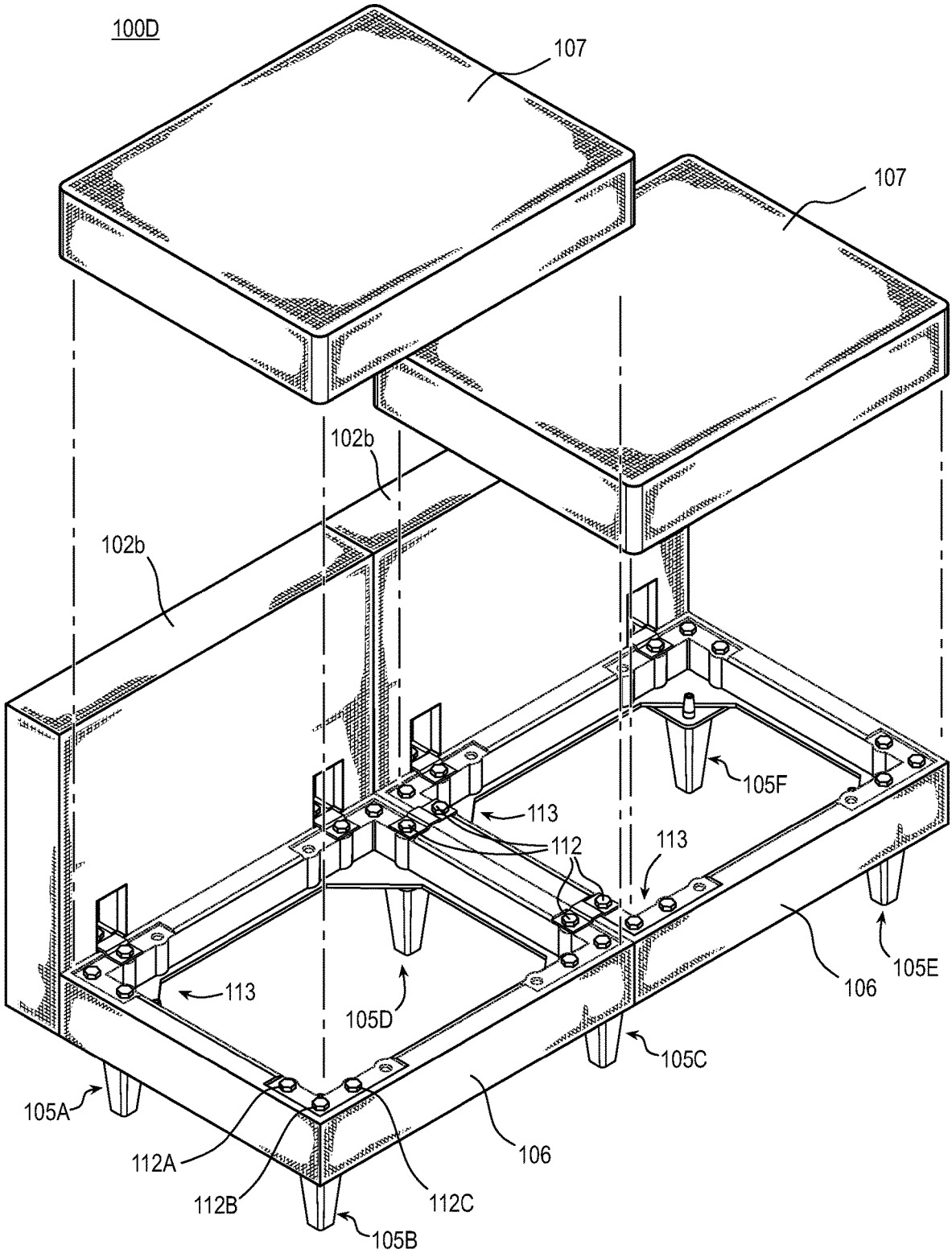
FIG. 5 is another perspective view illustrating how the modular furniture assembly is assembled.

FIG. 5 illustrates an example configuration in which multiple modular furniture components (bases and upright members) are joined together to form a modular furniture assembly 100D. For instance, FIG. 5 shows two upright members 102*b*, two cushions 107, and two frame assemblies 106 (the combination of each cushion 107 and its corresponding frame assembly 106 constitute the base 104). FIG. 5 also shows connector legs 109A-109F of corresponding connector leg assemblies 105A-105F, with the connector leg assembly 105B of exemplary connector leg 109B connected to one of frame assemblies 106 via fastener 112A, 112B, and 112C. The first and second frame assemblies 106 are connected to one another via coupling plates 113 and fastener 112 as well. The fasteners 112 may be multi-purposed in that they are not only connecting the frame assemblies 106 together but they are also connecting connector leg assemblies 105A-105F to the frame assemblies 106. Additional details regarding these connections will be provided in FIGS. 6A and 6B.

Figure 6A:
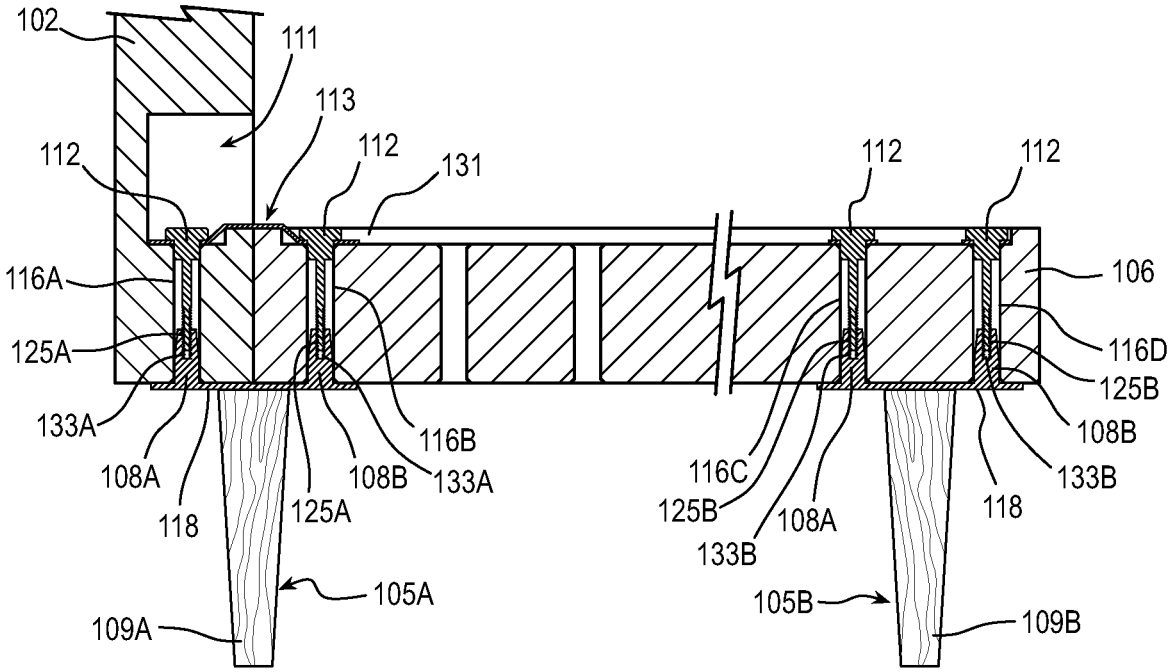
FIGS. 6A and 6B illustrate various features of connector legs connected to connector plates.

FIG. 6A shows a cross-sectional view depicting an upright member 102 (102*a*, 102*b*, 102*c*, or 102*d*), a frame assembly 106 of base 104, a first connector leg 109A of a first connector leg assembly 105A, and a second connector leg 109B of a second connector leg assembly 105B. The upright member 102 is shown as including a recessed portion (coupling hole 111) from which a hole 116A extends through the frame assembly of upright member 102. The first connector leg assembly 105A is shown as including a first protruding member 108A, which is partially inserted into the hole 116A. On the opposite end of the hole 116A through which the first protruding member 108A is inserted, a first fastener 112B is also inserted into the hole 116A and is used to secure the first connector leg assembly 105A to the upright member 102. For instance, when the first protruding member 108A has a threaded hole 133A, the first fastener 112B can screwed into the threaded hole 133A in a top portion or end 125A of the protruding member 108A. It will be understood that other coupling or connecting mechanisms other than threaded engagement between the fastener 112A and the first protruding member 108A are possible, such as other mechanical or interference fit connections. In another configuration, the threaded holes 133A and 133B can be formed directly in the connector member or plate 118 without protruding members 108A and 108B.

FIG. 6A shows a second hole 116B, which is disposed within a region of the frame assembly 106, such as extending from the pocket 131 to an underside or bottom of the frame assembly 106. Also shown is a second protruding member 108B on the connector leg assembly 105A and a second fastener 112A. Here, the second fastener 112A is inserted into an opposite end of the hole 116B than the end of the hole 116B through which the second protruding member 108B is inserted. The second fastener 112A screws into a top portion 125B of the second protruding member 108B, such as into the threaded hole 133B, to thereby secure the connector leg assembly 105A to the frame assembly 106.

As a result of these connections, the connector leg assembly 105A is now connected to both the upright member 102 and the frame assembly 106. That is, the connector leg assembly 105A operates as a coupling mechanism or a coupler between the upright member 102 and the frame assembly 106, thereby providing a secure connection between those two modular components. In some embodiments, coupling plate 113 is provided between the two fastener 112A, 112B to help further secure the modular components in place.

The connecting leg assemblies, the coupling plates, and the fasteners described herein can be considered as examples of coupling units or couplers that aid in connecting adjacent bases and upright members. Individual portions of any of the connecting leg assemblies, the coupling plates, and the fasteners can also be considered examples of coupling units or couplers that aid in connecting adjacent bases and upright members. For instance, the protruding members and the cooperating or corresponding receiving holes can each be considered as a coupling unit or coupler. Additional details regarding the connector member or plate 118 and coupling plate 113 are provided in subsequent figures.

FIG. 6A also shows how the frame assembly 106 includes another hole 116C. A protruding member 108A of the connector leg assembly 105B is inserted into a first end of the hole 116C, and a fastener 112A is inserted into the other end of the hole 116C. Similar to the other fasteners mentioned thus far, the fastener 112A screws into a thread hole 133A of a top portion or end 125A of the protruding member 108A to secure the connector leg assembly 105B in place. Likewise, FIG. 6A shows another hole 116D, another protruding member 108B, and another fastener 112B, which are used to further secure the connector leg assembly 105B in the manner just described.

Figure 6B:
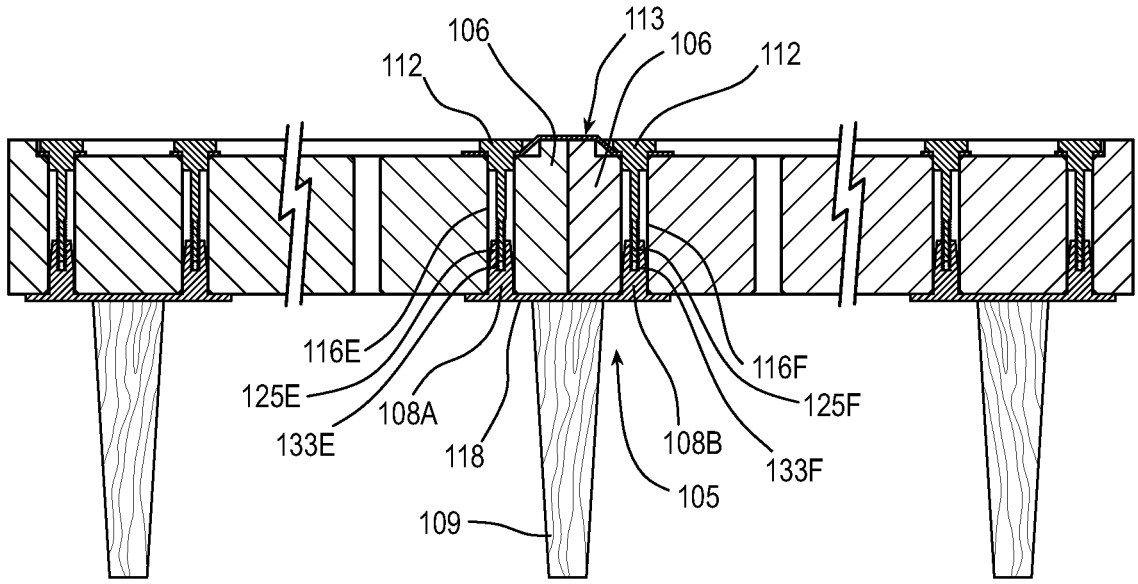

FIG. 6B provides another cross-sectional view focusing on a connection between two different frame assemblies 106. A coupling plate 113, which is configured in the manner discussed earlier, is also illustrated and is shown as bridging the two frame assemblies 106. The coupling plate 113 is secured in place, such as within the pocket 13 and to the connector leg assembly 105, by two fasteners 112 (e.g., similar or identical to the other identified fasteners 112A, 112B, etc.) coupled into corresponding protrusions of another connector leg assembly 105.

Connector leg assembly 105, including leg 109, is also shown as providing a connection, link, or bridge between the two frame assemblies 106, where the connector leg assembly 105 also operates as a securing member to securely connect those two frame assemblies 106. The frame assembly 106 shown on the left includes a hole 116E, and the connector leg assembly 105 includes a protruding member 108A. The protruding member 108A is shown as being inserted into a first end of the hole 116E while a corresponding fastener 112 is shown as being inserted into a second, opposite end of the hole 116E. The fastener 112 screws into a threaded hole 133E, provided on a top portion or end 125E of the protruding member 108A. FIG. 6B also shows a hole 116F provided in the frame assembly 106 shown on the right, a protruding member 108B provided on the connector leg assembly 105, and a fastener 112. The fastener 112 and the protruding member 108B are inserted into opposite ends of the hole 116F and are coupled together in the manner described earlier, such as the fastener 112 screws into a threaded hole 133F provided on a top portion or end 125F of the protruding member 108B.

The fasteners 112 are inserted into corresponding holes provided in the coupling plate 113, which is disposed within the pocket 131 (FIG. 6A), to thereby secure the coupling plate 113 in place. Therefore, not only do the connection mechanisms (e.g., the fastener 112, and the protruding members 108) operate to secure the frame assemblies 106 together but the coupling plate 113 also operates to secure the frame assemblies 106 together, clamping them between plate 113 and connector member or plate 118. In some cases, the coupling plate 113 operates in a washer-like manner to assist the fastener 112 in being securely screwed or coupled to the connector leg assembly 105. In some cases, the coupling plate 113 may operate as a locking washer.

Figure 7A:
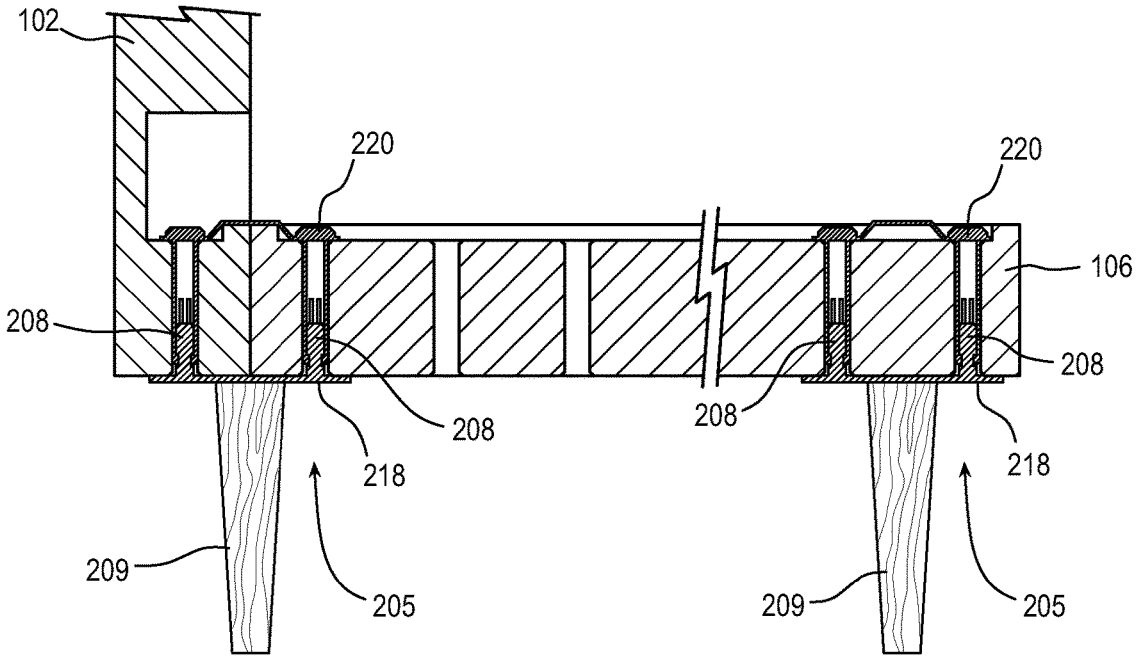
FIGS. 7A and 7B show additional features of connector legs and connector plates.
Figure 7B:
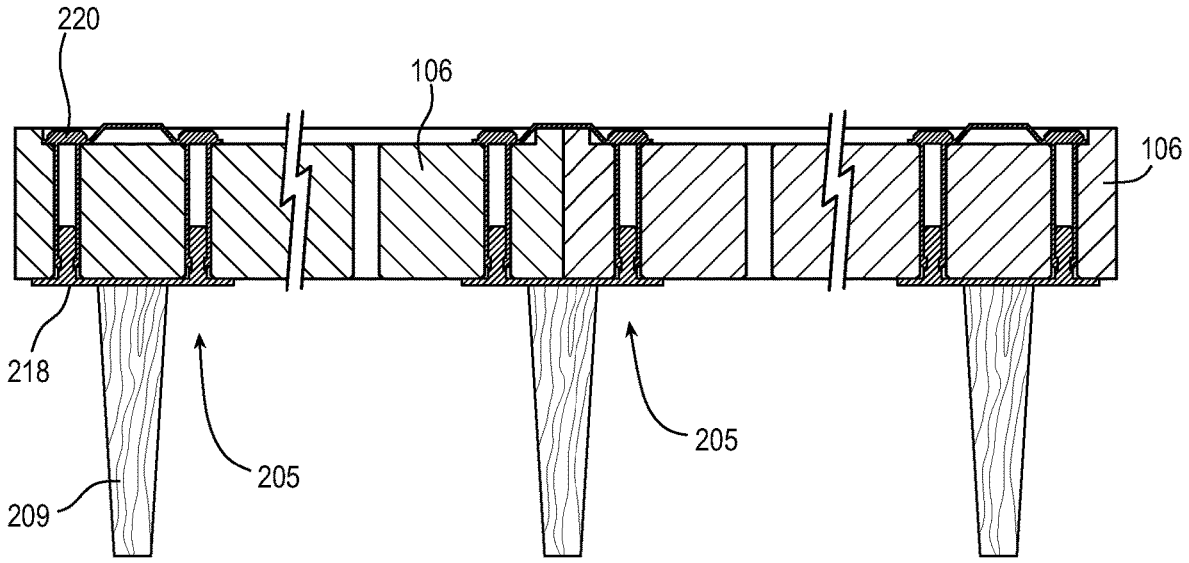

FIGS. 7A and 7B illustrate another type of connection mechanism that may be used to connect connector legs to the base frame assemblies and upright members. Specifically, FIG. 7A shows a cross-sectional view illustrating an upright member 102, a frame assembly 106, and a connector leg assembly 205. The connector leg assembly 205 includes a connector plate 218 that includes a number of protruding members 208 (e.g., similar or identical to those described previously). Typically, the connector plate 218 includes four protruding members 208, though more or less may also be used. A snap fastener 220 is also illustrated and is shown as snapping onto one of the protruding members 208 disposed on the connector plate 218. Similarly, FIG. 7A shows a second connector leg assembly 205, a second connector plate 218, and a snap fastener 220. These members are connected in a similar fashion. The snap fastener 220 and the corresponding protruding member 208 are additional examples of coupling units or couplers that can be used as part of the connection mechanisms or assemblies that allow removable attachment of adjacent bases and upright members. In another configuration, the snap fastener 220 can be received directly within holes or recessed portions, such as holes 133A and 133B from a connector leg assembly of FIGS. 7A-7B (the holes being optionally threaded), without the protruding members 208. It will be understood that the snap fastener 220 can either receive the protruding member or be received by the protruding member or a structure, such as a hole or recess, in the plate 218 of the connector leg assembly 205. Other coupling or connecting mechanisms other than snap engagement between the snap fastener and the protruding member are possible, such as other mechanical or interference fit connections.

FIG. 7B shows a related embodiment in which the snap fastener members are being used to not only connect connector legs to either a base frame assembly or an upright member but they may also be used to connect multiple base frame assemblies together, as was described previously. Specifically, FIG. 7B shows a connector leg assembly 205 including a leg 209, and a plate 218 comprising a number of protruding members 208, as well as and a snap fastener 220 for connecting the frame assembly 106 to the connector leg assembly 205. The middle connector leg assembly 205 connects two frame assemblies 106 together, as has been described previously. Accordingly, numerous different connection mechanisms may be used. Additional mechanisms will be discussed in some of the later Figures.

Figure 8A:
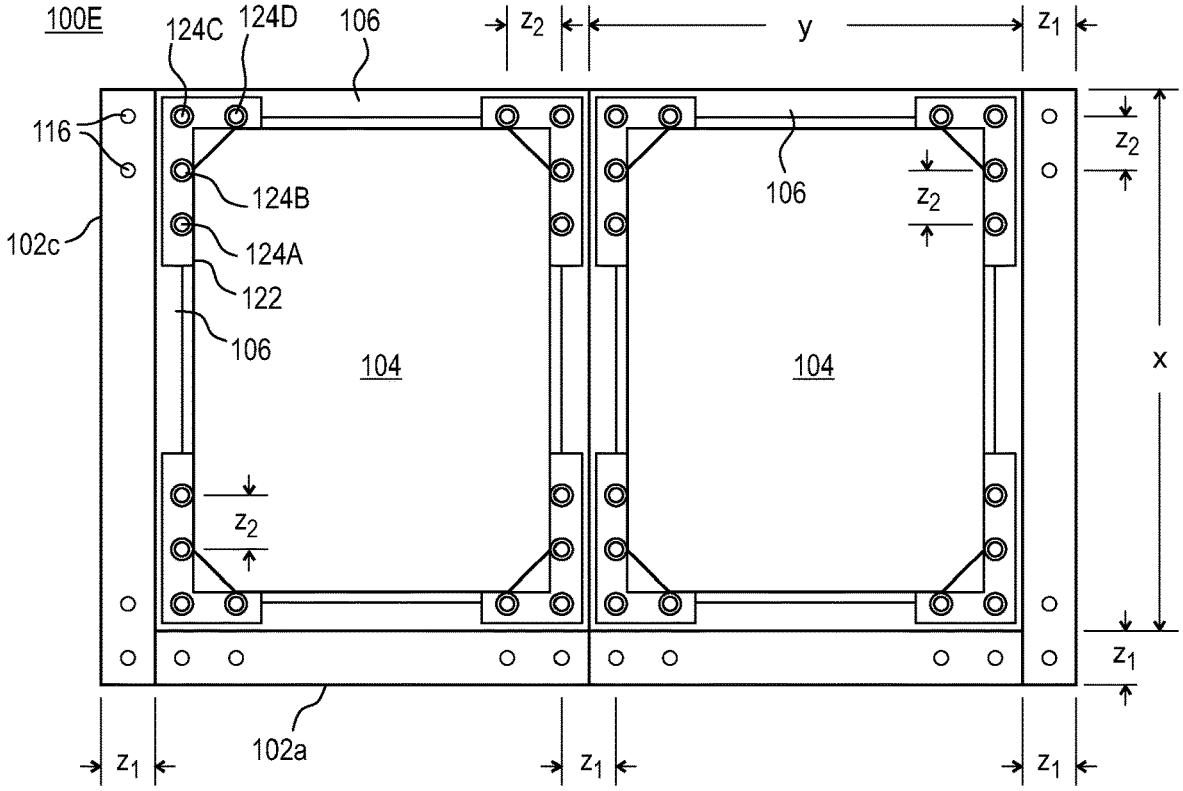
FIGS. 8A through 8F illustrate specific features relative to operation of the connector plates, and the frame assemblies of the bases and upright members.
Figure 8B:
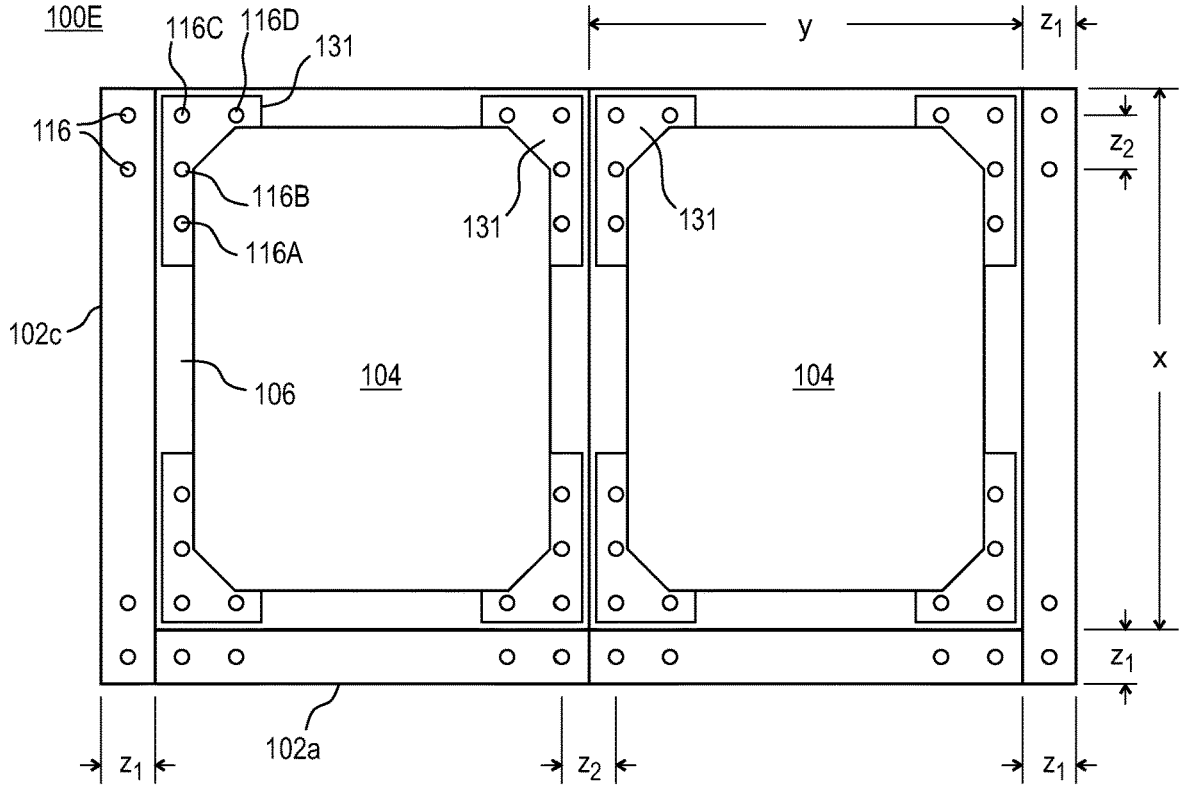

FIGS. 8A and 8B illustrate example base frame assemblies and upright member frame assemblies that are provided with holes for connection to the connector plates and other components of the coupling mechanism, to allow coupling of the various modular components to one another. The base frame assembly and upright member frame assembly provide a secure and robust structure to enable external components, such as the connector leg assemblies, to attach to the base frame assembly and upright member frame assembly. That is, to connect the individual furniture components together, one design uses a connector plate of a connector leg assembly, that attaches to the various components. The connector plate has a geometry that can mate into holes in both horizontal and upright furniture components, thereby enabling the connector plate to connect the furniture components to one another.

In particular, FIGS. 8A-8B shows a modular furniture assembly 100E, such as one of any of the modular furniture assemblies described herein, having a number of interconnected units, including two upright members 102*c*, two upright members 102*a* (corresponding to upright members 102*a* in FIG. 1A), and a frame assembly 106 of a base 104. FIG. 8A is a bottom view of the modular furniture assembly 100E, while FIG. 8B is a top view of the modular furniture assembly 100E.

Upright member 102*c* is illustrated as having a dimension or width ($Z_1$), a dimension or length equal to (X) plus ($Z_1$), and a distance between adjacent receiving holes 116A-116D (and receiving holes 124A-124D) being a separation distance ($Z_2$). Upright member 102*a* has a dimension or width ($Z_1$) and a dimension or length equal to (Y). The base frame assembly has a dimension or length (X) and a dimension or width (Y). The dimensions (X), (Y), and (Z) correspond to the (X), (Y), and (Z) dimensions earlier with regard to the defined spatial relationship X=Y+2Z, where dimension Z can be the dimension, width or thickness ($Z_1$) of the upright member or the separation distance ($Z_2$) between adjacent receiving holes 116A-116D receiving holes 124A-124D. For instance, with the dimension $Z_2$ matching $Z_1$ enhanced interchangeability for the components of the modular furniture assembly can be achieved. The dimension $Z_2$ can match $Z_1$ or $Z_1$ can be larger or smaller than $Z_2$ so long as $Z_2$ the spacing of receiving holes in the base and the upright members match.

As illustrated by the modular furniture assembly 100E shown in FIG. 8A, there may be multiple different types of upright members, with each having different length dimensions (e.g., upright members 102*c* have a length dimension equal to (X+Z) while the other upright members 102*a* have a length dimension equal to (Y). Another upright member may have a length dimension equal to (Y+Z). The thickness of all upright members may be equal to ($Z_1$). In addition, they all may have the same height (e.g., $H_U$ of FIG. 1B). These differently configured upright members may be used differently depending on the configuration of the modular furniture assembly. For instance, when a deep seat configuration is assembled, the longer upright members, such as the upright members 102*c* in FIG. 8A, may be used as an armrest and the shorter upright members, such as the upright members 102*a* in FIG. 8A, may be used as a backrest. When a shallow seat configuration is assembled (e.g., see FIG. 5), the medium length upright member, such as the upright member 102*b* in FIG. 8A, may be used as a backrest and an upright member having a length equal to (Y+Z) may be used as an armrest. Accordingly, in some embodiments, at least one of the upright members is configured to function as a backrest or armrest.

The modular furniture assembly 100E in this scenario is formed from two separate bases 104, and associated frame assemblies 106, which can be identical or substantially the same. For instance, the left base 104, and associated frame assembly 106, is shown next to a right based 104, and associated frame assembly 106.

The frame assembly 106 includes a reinforcing member or plate 122 disposed on a lower portion of the frame assembly 106. The reinforcing member 122 can have a number of holes, including hole 124A, hole 124B, hole 124C, and hole 124D. These holes 124A-124D of the reinforcing member 122 correspond with or are aligned with the holes mentioned earlier, such as holes 116A-116D of FIGS. 6A and 8A-8B. In one configuration, portions of a protruding member from a connector leg can be inserted into these holes 124A-124D along with portions of fasteners that are used to secure the connector leg assembly in place. A diameter of each hole 124A-124D can match a diameter of the corresponding protruding members 108A-108D or be oversized in relation to a diameter of a corresponding protruding member 108A-108D, such that a diameter of each hole 124A-124D is between about 0.5% to about 50% larger than a diameter of the corresponding protruding member 108A-108D. This aids with tilting the connector leg assembly 105A-105D in relation to the base 104 or vice versa by providing additional space for tilting the protruding member 108A-108D received within the hole 124A-124D, and as will be discussed in more detail hereinafter. While the diameter of one or more of the holes 124A-124D is indicated as being between about 0.5% to about 50% larger than a diameter of the corresponding protruding member 108A-108D, in other configurations the holes 124A-124D are larger than a diameter of each of the protruding members 108A-108D by 1.0% to about 40%, from about 1.5% to about 30%, from about 2.0% to about 25%, from about 3.0% to about 10%.

Figure 8C:
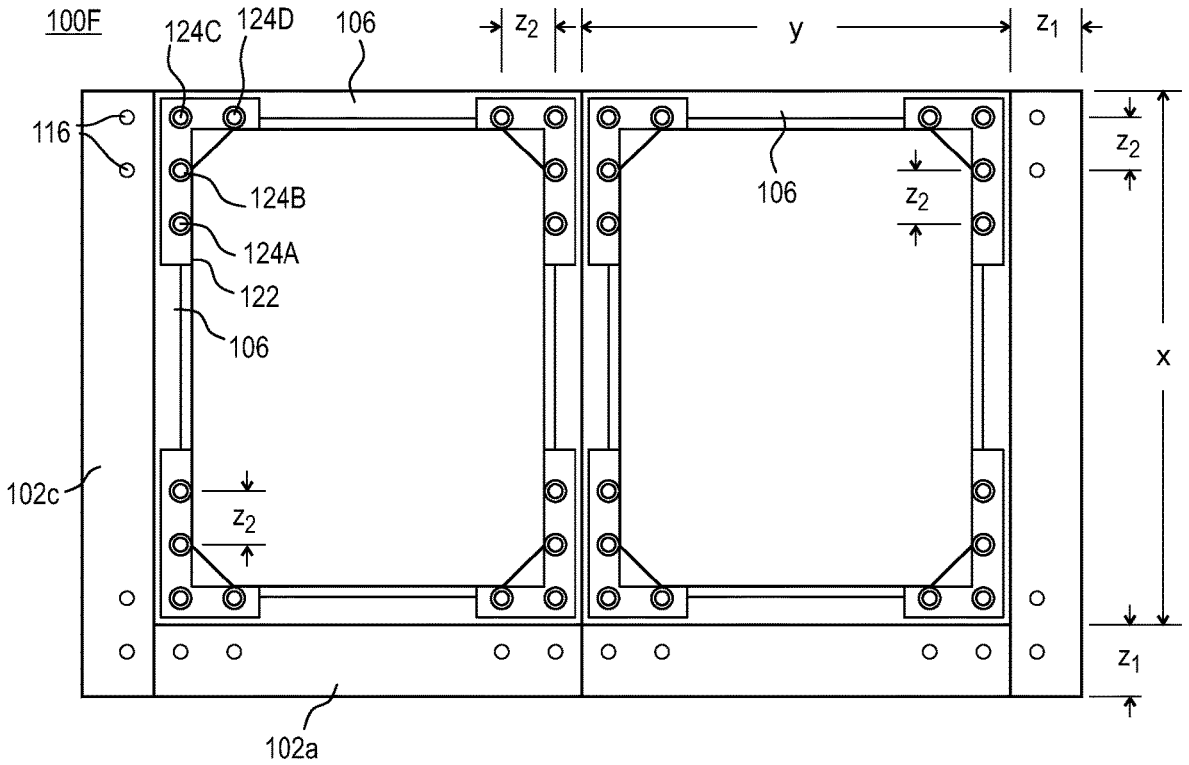
Figure 8D:
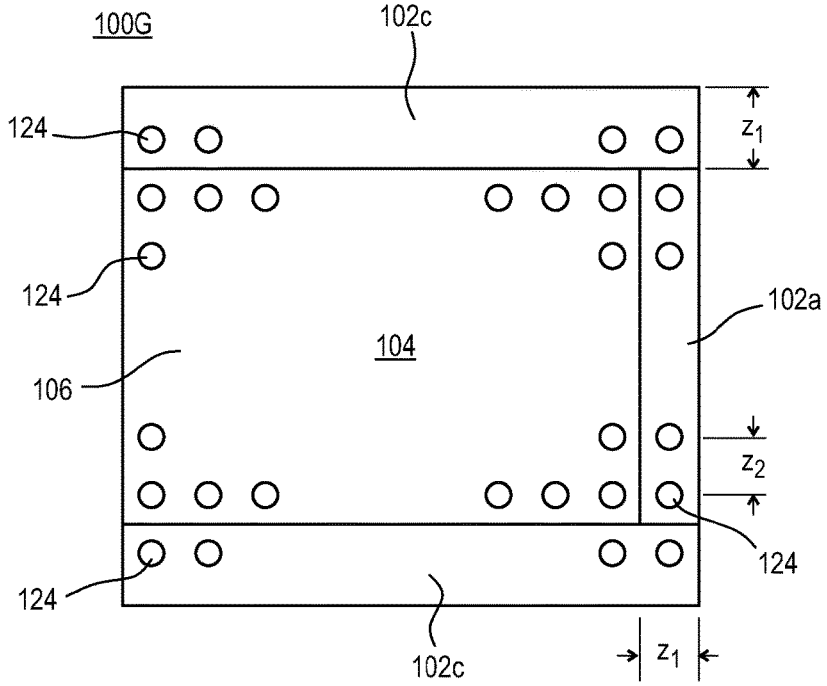
Figure 8E:
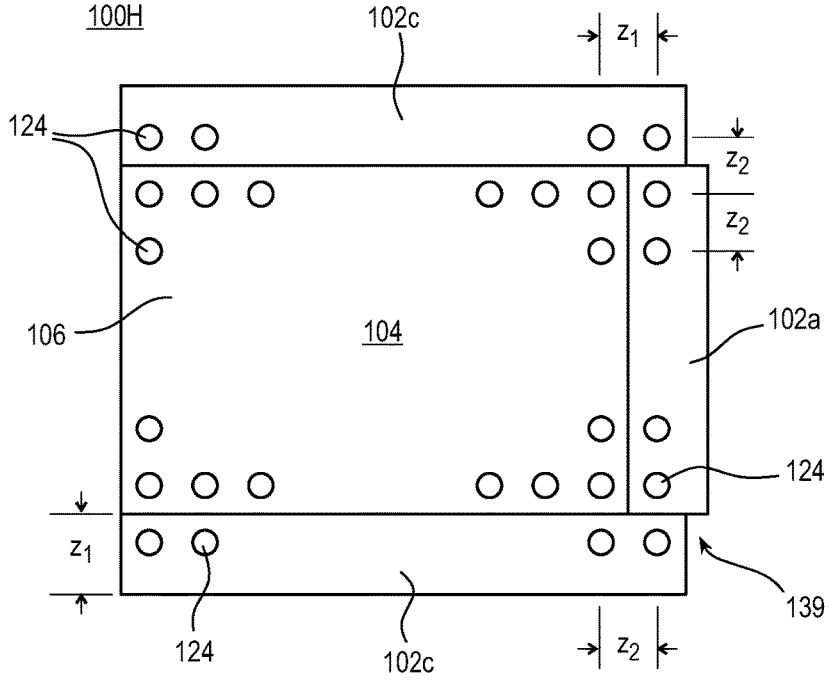
Figure 8F:
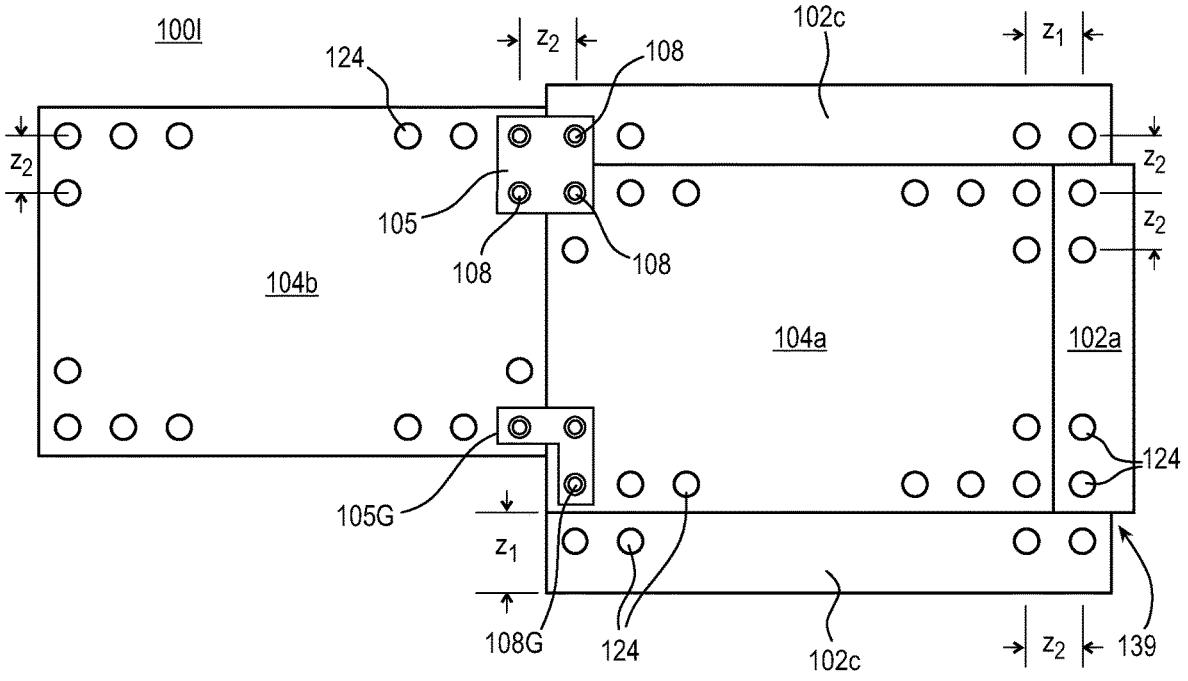

Particular spacing between the different holes 124A-124D, and so holes 116A-116D, is provided. Specifically, the spacing between any one hole 124A-124D and another adjacent hole 124A-124D, between any one hole 116A-116D and another adjacent hole 116A-116D, and between one hole 124A-124D and an adjacent hole 116A-116D) is the dimension ($Z_2$), which in some configuration corresponds to the thickness of each upright member, such as upright members 102, i.e., $Z_1$=Z2. That is, the spatial relationship X=Y+2Z provides that the distance between the center of the receiver holes (e.g., holes 124A-124D and holes 116A-116D) is equal to the dimension ($Z_1$), i.e., the width of the upright member described herein. The dimension $Z_2$ can match $Z_1$ or $Z_1$ can be larger or smaller than $Z_2$ so long as $Z_2$ of receiving holes 124A-124D and holes 116A-116D in the base and the upright members match. Modular furniture assemblies using the spatial relationship X=Y+2Z can have a slimmer and aesthetically pleasing form because the upright members interface the corners of the modular furniture assembly without gaps or overlapping surfaces. Modular furniture assemblies using the spatial relationship X=Y+2Z, where Z is $Z_2$, lends itself to maintaining spacing of the components of the modular furniture assembly, such as but not limited to the bases, upright members, and connector leg assemblies, when uprights members are replaced or changed. For instance, by maintaining X=Y+2$Z_2$ when the $Z_1$ is larger than $Z_2$, such as illustrated with the modular furniture assemblies 100F and 100G in FIG. 8C-8D, the spacing of receiving holes 124A-124D and holes 116A-116D in the base and the upright members remain the same, thus allowing for enhanced interchangeability for the components of the modular furniture assembly, but the $Z_1$ dimension of upright members 102*c*, for example, are larger than the $Z_2$ dimension. This configuration provides a design benefit of wider arm-type upright members 102*c* and optionally back-type upright members 102*a*. For instance, FIG. 8C illustrates both the arm-type upright members 102*c* and optionally back-type upright members 102*a* having the same $Z_1$ dimension, while FIG. 8D illustrates the arm-type upright members 102*c* having a larger $Z_1$ dimension than the back-type upright members 102*a*. FIG. 8E illustrates a modular furniture assembly 100H where $Z_1$ dimensions are selected to achieve an offset 139 between the arm-type upright members 102*c* and the back-type upright members 102*a*, while maintaining the $Z_2$ dimension for each of the bases 104 and upright members 102*a* and 102*c* to aid with coupling of the base 104 and upright members 102*a* and 102*c*. The offset 139 can be the difference between the $Z_1$ and $Z_2$ dimensions. A similar offset 139 is also illustrated with the modular furniture assembly 100I of FIG. 8F in which a second frame assembly 106*b* of base 104*b* is positioned in relation to the first frame assembly 106*a* of base 104*a* having attached upright members 102*a* and 102*c*; the long sides of the second frame assembly 106*b* and the first frame assembly 106*a* are orientated in the same direction. The connector leg assemblies 105 (FIG. 2) mount to the receiving holes 124 in the upright members and bases as described herein. Optionally, and in relation to the modular furniture assembly 100I of FIG. 8F, the connector leg assembly 105, which can be similar to any of the other connector assemblies described herein, can be used to connect the second frame assembly 106*b* to the upper upright member 102*c* and the first frame assembly 106*a*, while a connector leg assembly 105G having three protruding members 108G used to connect the second frame assembly 106*b* to only the first frame assembly 106*a*. The connector leg assembly 105G can include a generally L-shaped connector member or plate 118E or other shape that accommodates the three rather than four protruding members 108G.

When upper members have a dimension, thickness, width ($Z_1$) that is larger than a separation distance ($Z_2$), maintaining the spatial relationship of X=Y+2Z, where Z is $Z_2$ prevents unwanted lengthening or increasing a size of the coupling units or couplers, such as increasing a length of the coupling plate 113 (FIG. 2) and/or size of the connector plates 118A-118D, that could weaken the connection between adjacent bases and upright members. Lengthened coupling plates 113 (FIG. 2), while maintaining the same dimensional thickness to allow the coupling plate 113 (FIG. 2) to be received within the pocket 131 and the coupling hole 111 would increase cantilevered loads upon the legs (115) from, for instance, an upper member, during use if the dimension, thickness, width ($Z_1$) was used instead of the separation distance ($Z_2$). This is also the case when the upper members are inclined in relation to the base 104, i.e., inclining away from the base 104. By maintaining the spatial relationship of X=Y+2Z, where Z is $Z_2$, increased strength is provided at the junction of the base and upper member.

FIG. 8B illustrates another view (e.g., reverse or flipped over) of the assembly 100 relative to the view provided in FIG. 8A. By way of example, FIG. 8A may show the bottom view, while FIG. 8B shows the reverse or flipped over, top view. Again, FIG. 8B shows the upright member 102*c*, the upright member 102*a*, the pocket 131, and the holes 124A-124D. FIG. 8B also shows the various (X), (Y), and (Z) dimensions.

It will be appreciated that while the reinforcing member 122 is mounted to the base frame assemblies as illustrated, the base frame assemblies and/or upright member frame assemblies may incorporate other reinforcing members or components (e.g., metal inserts or the like) in or around the various defined coupling holes or where additional stiffness, rigidity, or strength is desired, rather than an embodiment where such holes are simply formed through the bare frame members themselves (formed from wood, plastic, metal, or other desired material). Additionally, while the reinforcing member 122 is disposed on the bottom of the frame assembly, it will be understood that reinforcing members can be disposed on the top of the frame assembly, on the bottom of the upright member, within the recessed portion of the upright member, and other locations. Furthermore, while the frame assemblies are illustrated within the pocket 131 (FIG. 2) disposed in the top of the frame assemblies, it will be understood that pockets can also be formed in the bottom of the frame assembly, on the bottom of the upright member, within the recessed portion of the upright member, and other locations.

Figure 9A:
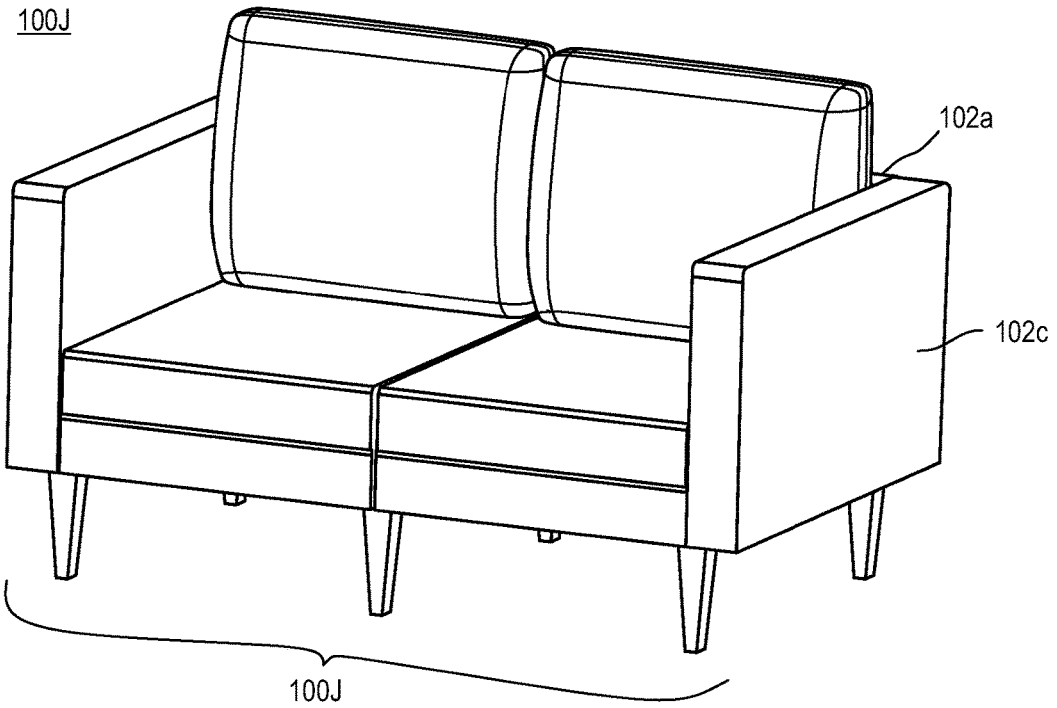
FIGS. 9A and 9B illustrate modular furniture assemblies in the configuration of a sofa, in a deep-seat configuration, and a shallow-seat configuration, respectively.
Figure 9B:
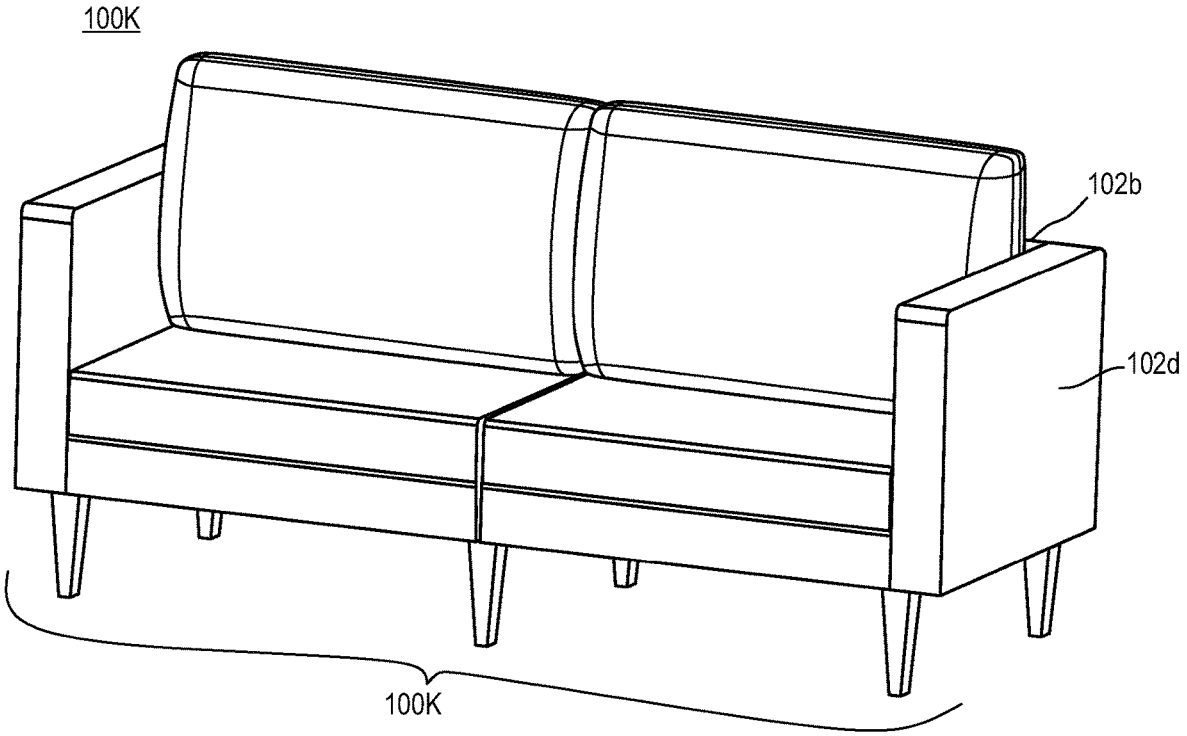

FIGS. 9A, 9B, 10A, 10B, 11A, and 11B illustrate various different arrangements or configurations of the disclosed modular furniture assembly. FIG. 9A illustrates modular furniture assembly 100J having a deep-seated configuration, where the long end of the base is positioned to be perpendicular to the upright member. As a result of this configuration, the length 100J-L of the modular furniture assembly 100J is shorter than what is depicted in FIG. 9B. In modular furniture assembly 100J, the longer upright member, such as the upright member 102*c*, is operating as an armrest while the shorter upright member 102*a* is operating as a backrest.

FIG. 9B illustrates modular furniture assembly 100K having a shallow-seated configuration (similar to FIG. 5), where the long edge of the base having length (X) is positioned to be parallel to the backrest upright member. As a result of this configuration, the length 100*k*-L of the modular furniture assembly 100K is longer than the length 100J-L. In this configuration, a middle length upright member 102*b* (having a length equal to (X)) is operating as a backrest while the shorter upright member 102*d* having a length equal to (Y+Z) is operating as an armrest.

Figure 10A:
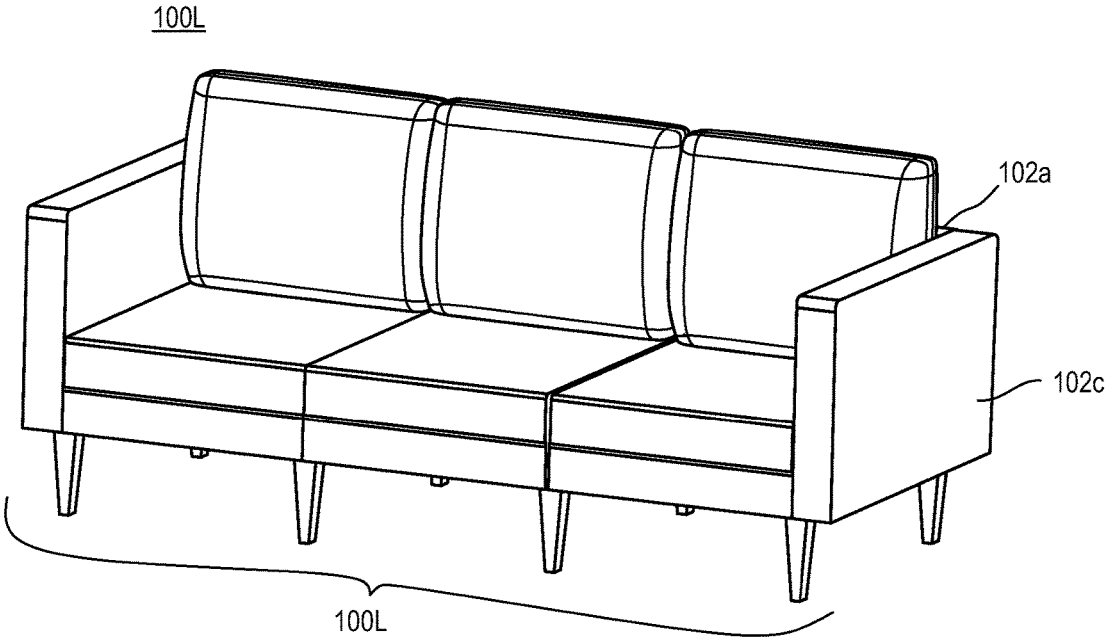
FIGS. 10A and 10B provide additional illustrations of the modular furniture assemblies in the configuration of a sofa, in a deep-seat configuration, and a shallow-seat configuration, respectively.
Figure 10B:
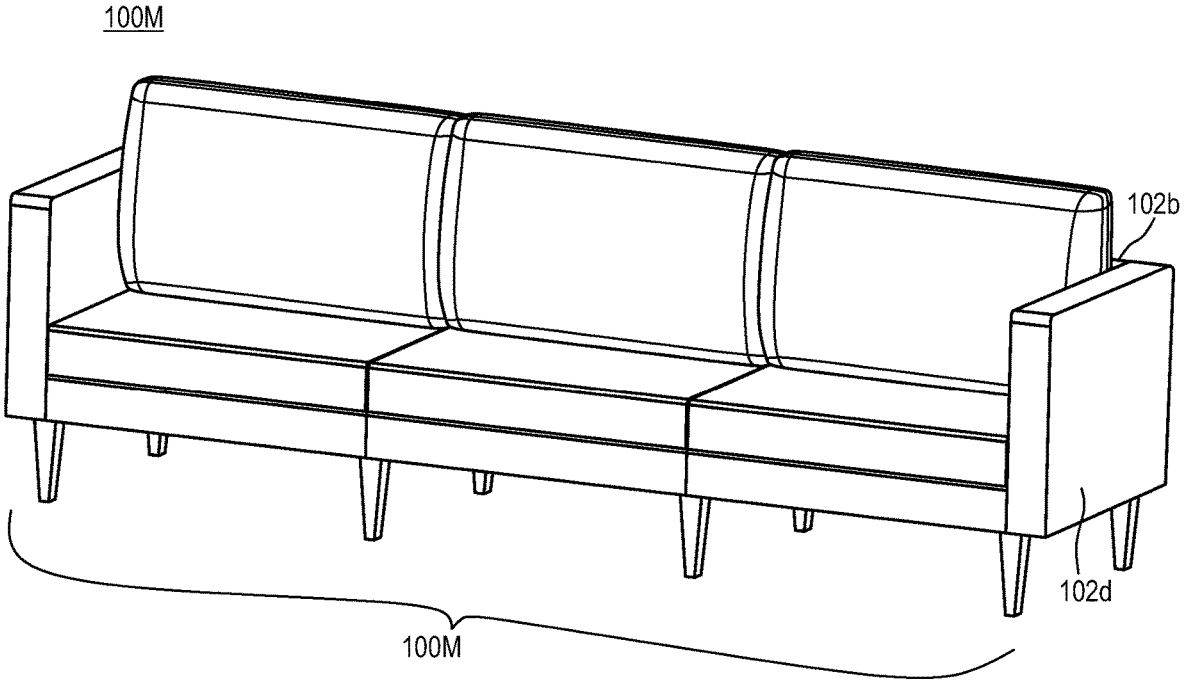

FIGS. 9A and 9B illustrate a modular furniture assembly having two seats, or two bases. FIGS. 10A and 10B, illustrates modular furniture assemblies having three seats, or three bases.

Specifically, FIG. 10A illustrates modular furniture assembly 100L having a deep-seated configuration, where the long end of the base is positioned to be perpendicular to the backrest upright member. As a result of this configuration, the length 100L-L of the modular furniture assembly 100L is shorter than what is depicted in FIG. 10B. Also, in this configuration, the longer upright member (e.g., upright member 102*c* from FIG. 8A) is operating as an armrest while the shorter upright member 102*a* is operating as a backrest.

FIG. 10B illustrates modular furniture assembly 100M having a shallow-seated configuration, where the long end of the base is positioned to be parallel to the backrest upright member. As a result of this configuration, the length 100M-L of the modular furniture assembly 100M is longer than the length 100M-L. In this configuration, the longer upright member 102*b* is operating as a backrest while a shorter upright member 102*d* is operating as an armrest.

Figure 11A:
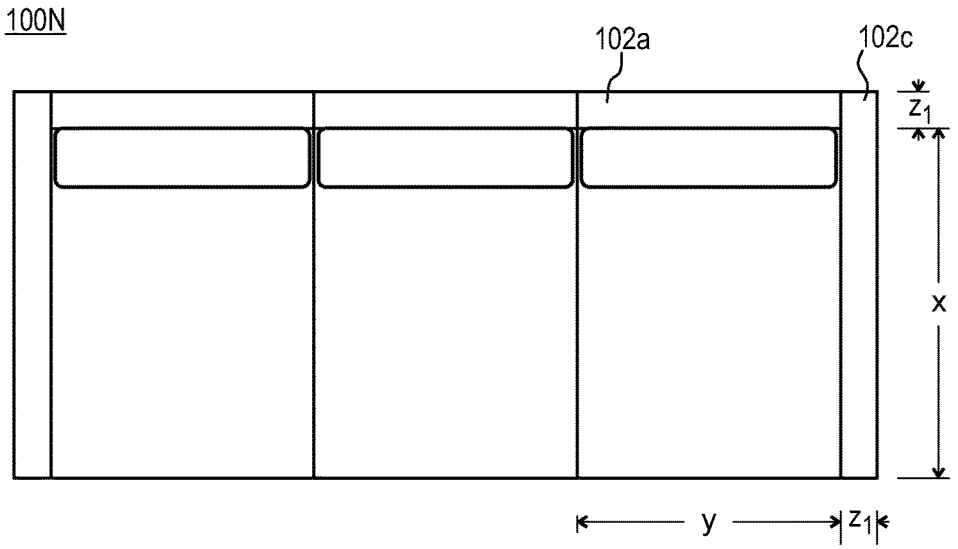
FIGS. 11A, 11B, and 11C illustrate top plan view dimensions of the modular furniture assembly, in a deep-seat configuration (FIGS. 11A and 11C) and a shallow-seat configuration (FIG. 11B).
Figure 11B:
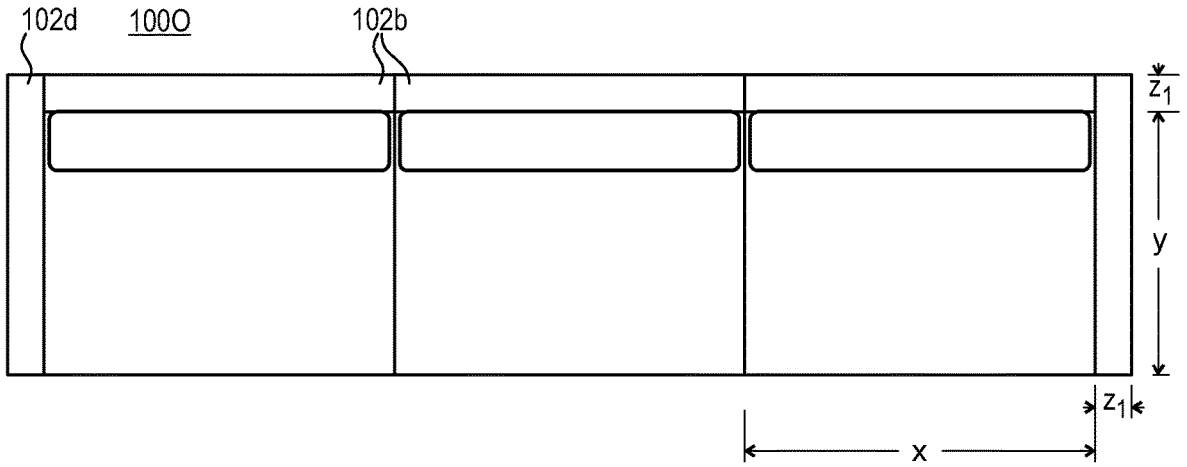

FIGS. 11A and 11B also illustrates the same three-seat configurations of the modular furniture assemblies 100N and 100O. Specifically, FIG. 11A shows modular furniture assembly 100N illustrating a deep-seated configuration, where the long end of the base is positioned perpendicularly to the backrest upright member. The dimensions (X), (Y), and (Z) are also illustrated. Recall, the spatial relationship recited herein states that X=Y+2Z, where (X) is the long side or length of the base, (Y) is the short side or width of the base, and (Z) is the thickness or width of the upright member or a separation distance between holes in the base or upright member. In this configuration of the modular furniture assembly 100N, the longer upright member 102*c* is operating as an armrest while the shorter upright member 102*a* is operating as a backrest. The length of the longer upright member is equal to (X+Z). As such, the length of the longer upright member 102*c* is even longer than the length of the base.

FIG. 11B illustrates the modular furniture assembly 100O having a shallow-seated configuration, where the long end of the base is positioned in parallel to the backrest upright member. Again, the dimensions (X) (Y) and (Z) are illustrated, where those dimensions are designed in accordance with the defined spatial relationship. In this configuration, the longer upright member 102*b* is operating as a backrest while the shorter upright member 102*d* having a length equal to (Y+Z) is operating as an armrest.

Figure 11C:
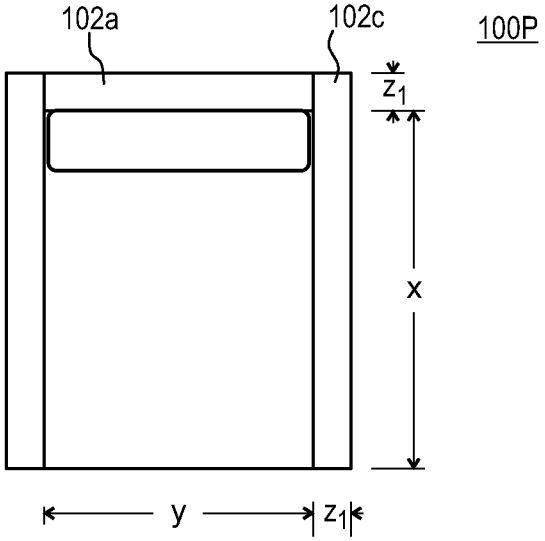

FIG. 11C illustrates a modular furniture assembly 100P having a deep-seated configuration, where the long end of the base is positioned perpendicularly to the backrest upright member. The modular furniture assembly 100P of FIG. 11C is similar to the modular furniture assembly 100N of FIG. 11A but FIG. 11C shows only a single seat and two armrests. Notice the dimensions of this configuration. Specifically, the entire width of this modular furniture assembly 100P is now (X), where X=Y+2Z. The dimension (Y) is obtained from the base and the dimensions (Z) are obtained from the armrests. Similar to the discussion of FIG. 1C, the modular furniture assembly 100P produces or approaches a more square-like configuration for the entire modular furniture assembly 100P. For example, the dimensions of the configuration are now (X) by (X+Z), which is approaching a more square-like shape.

Figure 12A:
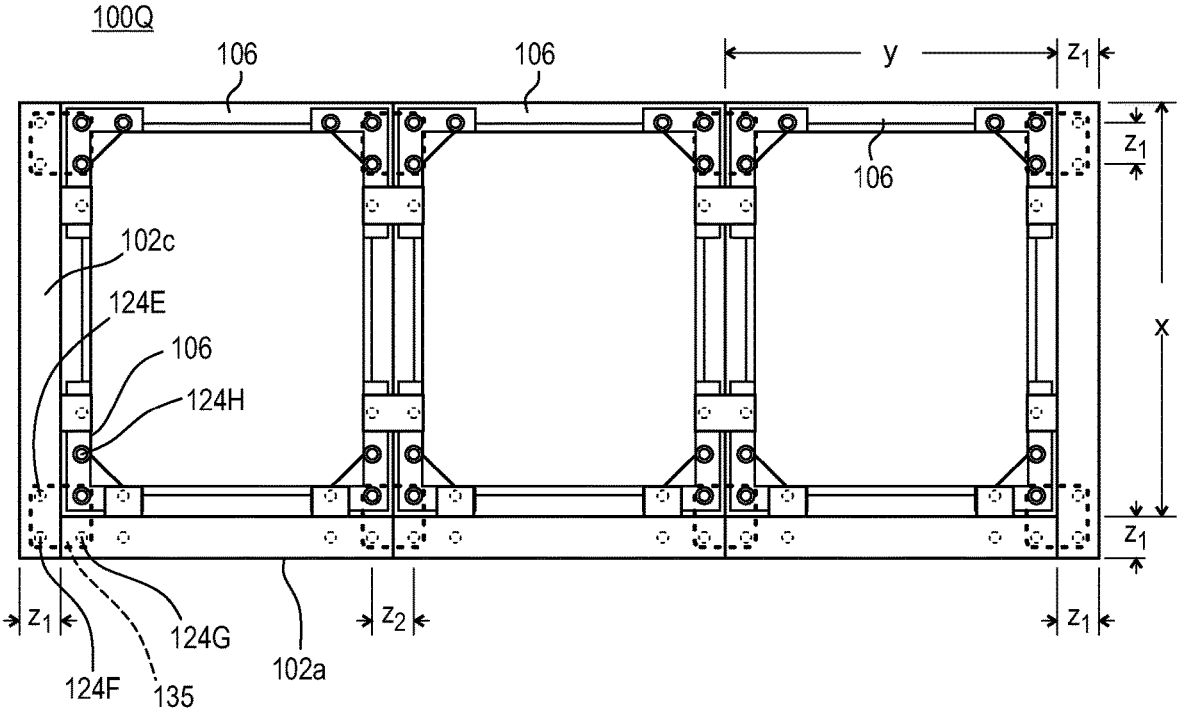
FIGS. 12A and 12B illustrate additional features relative to how connector plates can be used to couple adjacent bases to one another, and to couple a base to an adjacent upright member.
Figure 12B:
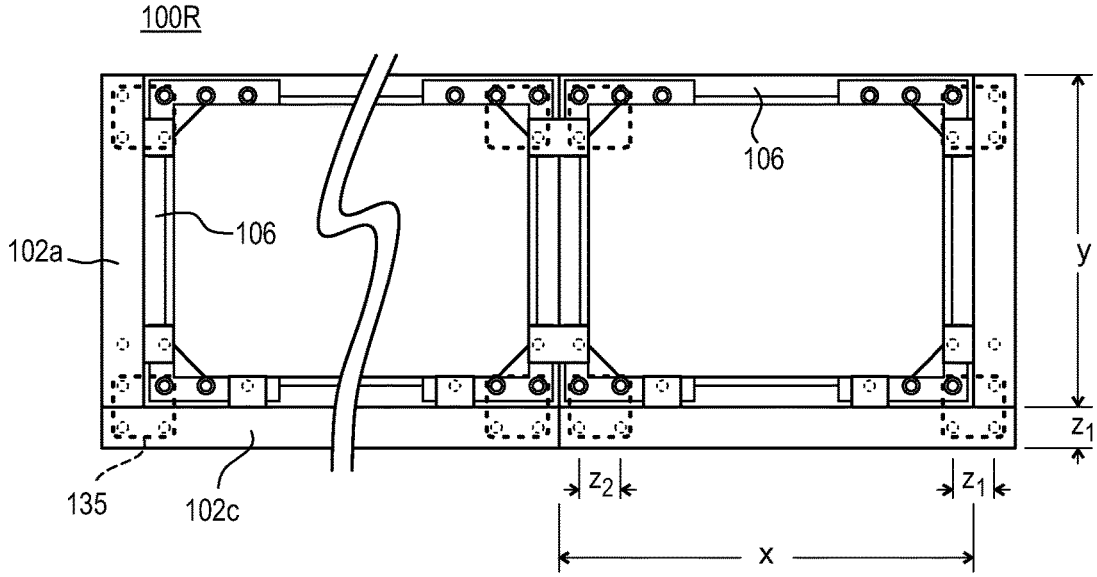

FIGS. 12A and 12B illustrate the connector plate that is provided in conjunction with the base for connecting multiple modular furniture members together. Specifically, FIG. 12A shows assembly 100Q, which in this case includes three separate frame assemblies 106 that are connected together using the coupling techniques mentioned earlier (e.g., multi-purposing the connector leg assemblies). The assembly 100Q includes a first and second upright members 102*c* (e.g., having a length equal to (X+Z)), positioned as armrests, three upright members 102*a* (e.g., having a length equal to (Y)), positioned as backrests, and three frame assemblies 106. The upright members 102*c* have dimensions (X+Z) as the length and (Z) as the thickness or width. The upright members 102*a* have dimensions (Y) as the length and (Z) as the thickness or width. The frame assemblies 106 have dimensions (X) as the length and (Y) as the width. The (X), (Y), and (Z) dimensions correspond to those same dimensions mentioned earlier.

The frame assembly 106 of the base 104 includes multiple holes, including hole 124H which are similar to holes 124A-124D referenced before. Holes 124E and 124F are included in the upright member 102*c*, and hole 124G is included as a part of the upright member 102*a*. The frame assembly 106 includes additional holes (not labeled), e.g., one of which is shown between holes 124H and 124G.

The portion labeled 135 represents an area where the connector member or plate 118 of the connector leg assembly 105 may be attached to the frame assembly 106 and the upright members 102*c* and 102*a*, though other locations may also be used by the connector leg assembly 105. Indeed, any of the holes may be used to connect a connector leg assembly 105 to the remainder of the furniture assembly 100J.

Whereas the configuration illustrated in FIG. 12A illustrated a configuration in which the long lengths (X) of the bases were oriented or arranged in a manner so as to provide a deep-seated modular furniture assembly, the configuration presented in FIG. 12B illustrates an alternative configuration. Specifically, FIG. 12B shows an assembly 100R having, in this example case, at least two separate frame assemblies 106 with corresponding upright members 102*a* and 102*c*. This configuration provides a shallow-seated modular furniture assembly, as has been described in previous figures. Again, the dimensions (X), (Y), and (Z) are illustrated.

Figure 13A:
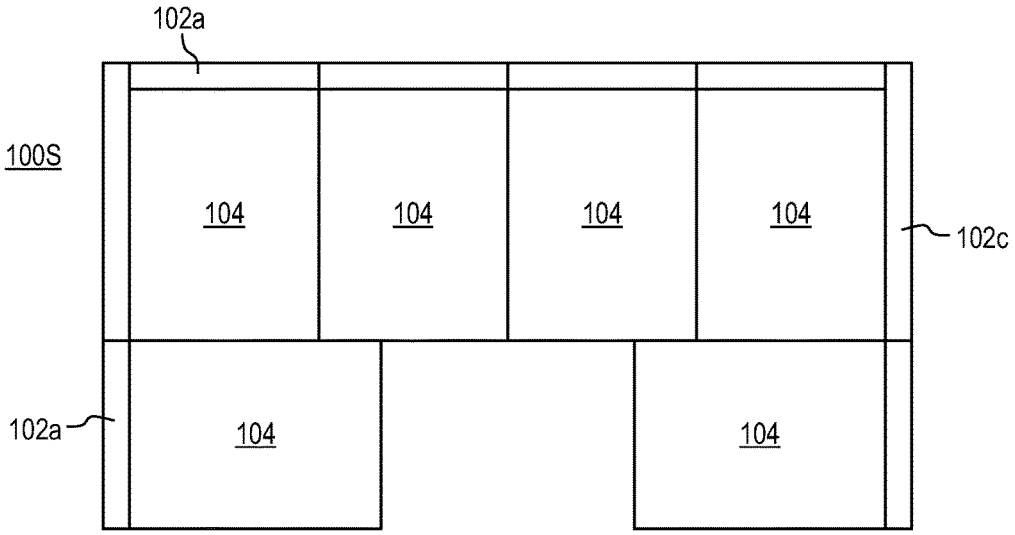
FIGS. 13A, 13B, and 13C illustrate various arrangements or configurations of exemplary modular furniture assemblies.
Figure 13B:
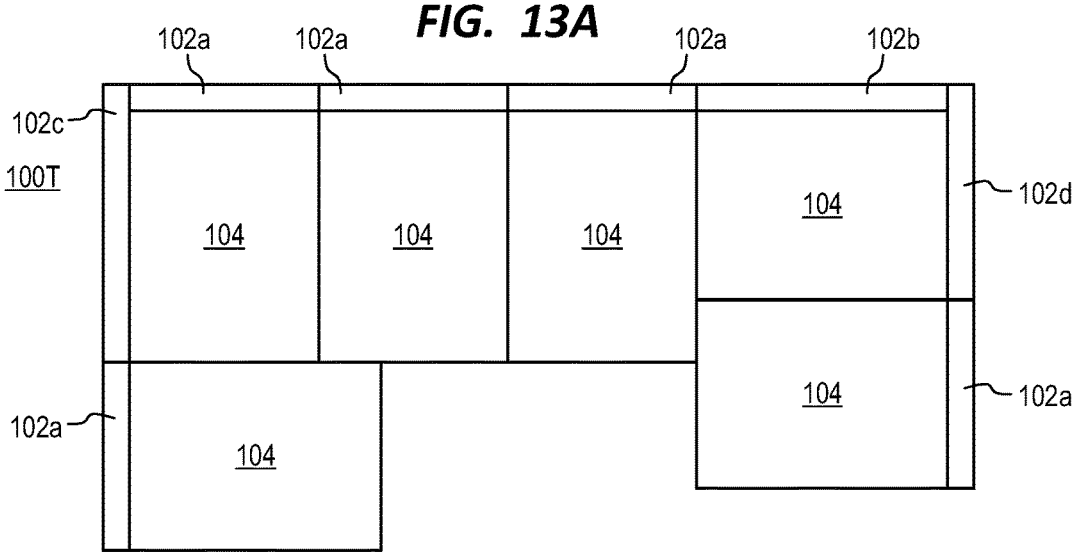
Figure 13C:
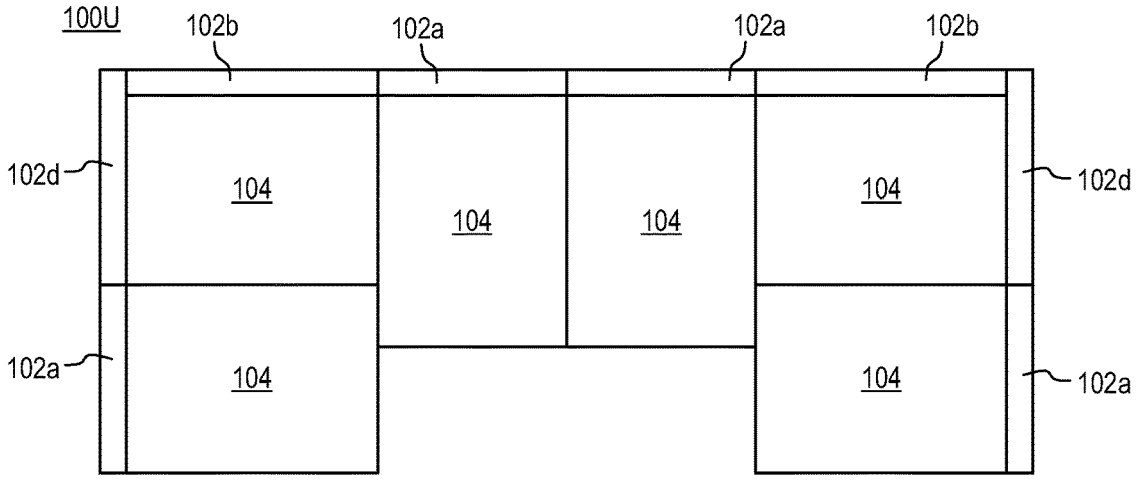

FIGS. 13A, 13B, and 13C illustrate some additional configurations for the disclosed modular furniture assembly. In particular, FIG. 13A illustrates modular furniture assembly 100S having six bases 104 arranged in a first manner. Notice, the four shorter upright members 102*a* along the back of the assembly are used as backrests. Two longer upright members 102*c* are used as armrests, or side supports, and two shorter upright members 102*a* are also shown towards the front of the sides of the assembly, used as side supports, or backrests, depending on the orientation of a seated user.

FIG. 13B shows a modular furniture assembly 100T formed from exactly the same bases, where the six bases 104 are arranged differently than in the modular furniture assembly 100S. This configuration also uses various different combinations of longer and shorter upright members. Different upright members, including upright members 102*a*, 102*b*, 102*c*, and 102*d* are being used.

Relatedly, FIG. 13C shows yet another modular furniture assembly 100U showing another arrangement of the same six bases 104. Again, this configuration uses different combinations of longer and shorter upright members, such as the upright members 102*a*, 102*b*, 102*c*, and 102*d*. Any number of different arrangements or configurations may be used, and the arrangements illustrated in FIGS. 13A-C are simply a few example arrangements.

Figure 14A:
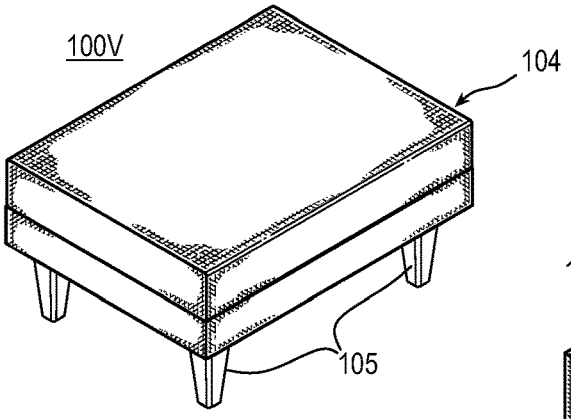
FIGS. 14A, 14B, 14C, 14D, 14E, 14F, 14G, 14H, 14I, and 14J illustrate additional arrangements of exemplary modular furniture assemblies.
Figure 14B:
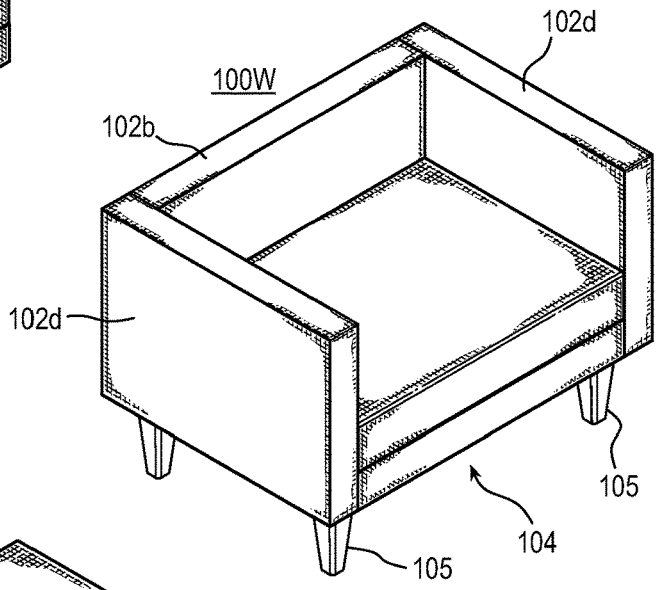
Figure 14C:
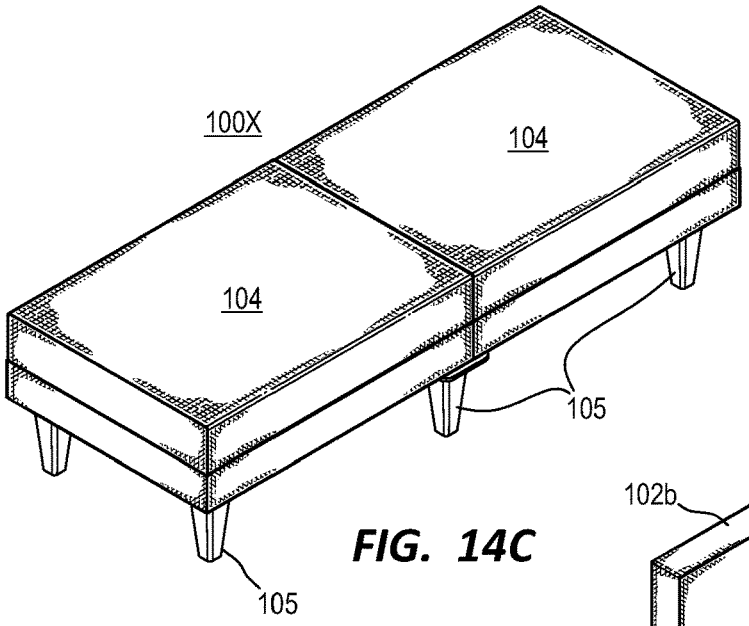
Figure 14D:
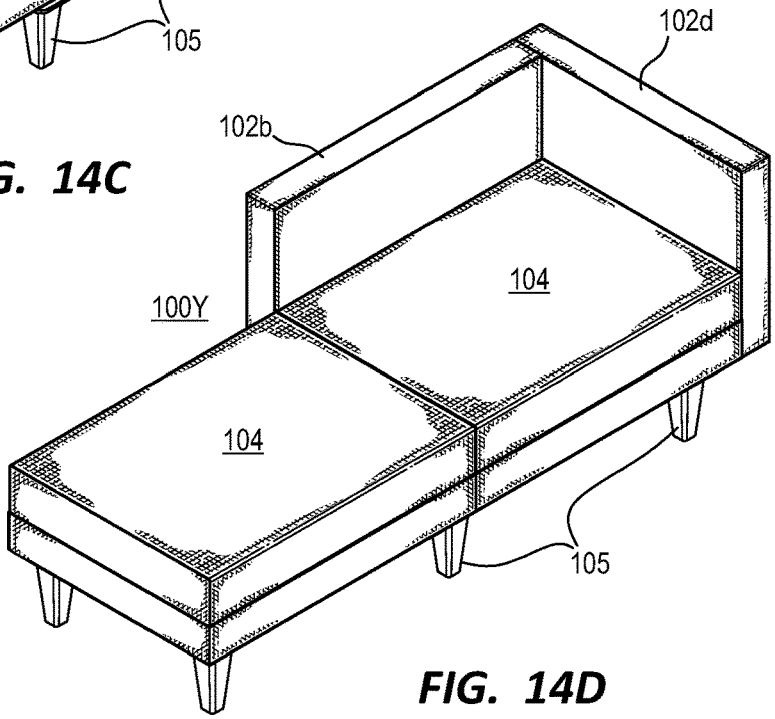

FIGS. 14A, 14B, 14C, and 14D illustrate some additional modular furniture assemblies. Notably, FIG. 14A illustrates a modular furniture assembly 100V (formed from a single base 104, with attached connect leg assemblies 105, using an associated connector member or plate 118, hidden from view), FIG. 14B illustrates modular furniture assembly 100W (similar to that of FIG. 4A, but with 2 additional upright members 102*d*), FIG. 14C illustrates modular furniture assembly 100X, formed by connecting two bases 104 together, with visible legs 109 of an associated connector leg assembly 105, and FIG. 14D illustrates modular furniture assembly 100Y, similar to that of FIG. 14C, but in which upright members 102*b* and 102*d* have been added. Some of these configurations, such as modular furniture assemblies 100V and 100X, do not include upright members while the modular furniture assemblies 100W and 100Y do include upright members.

Figure 14E:
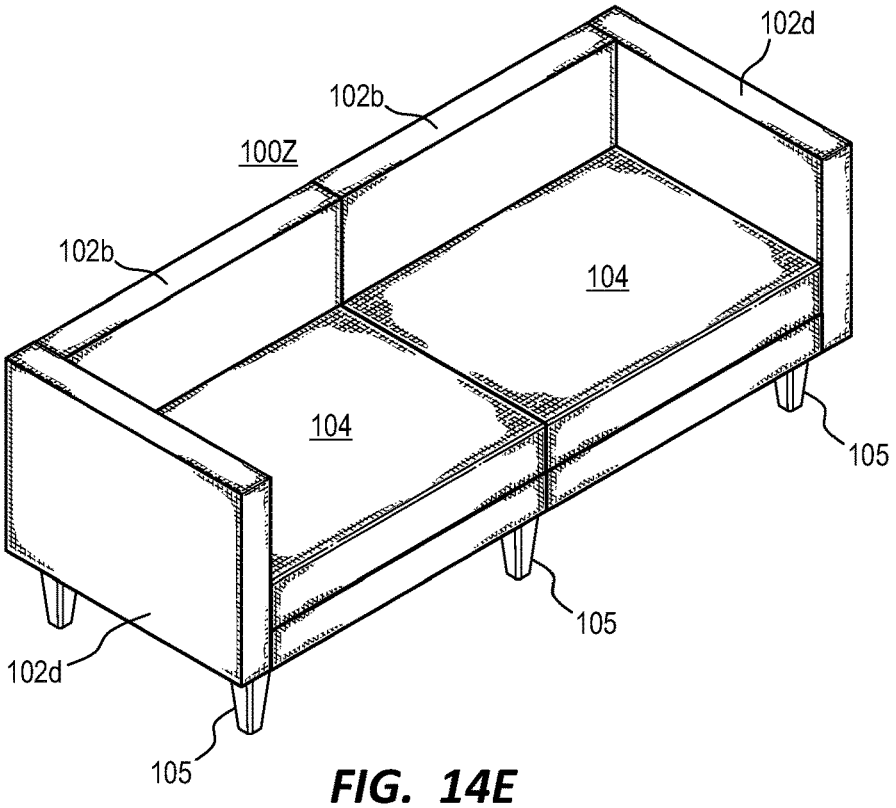
Figure 14F:
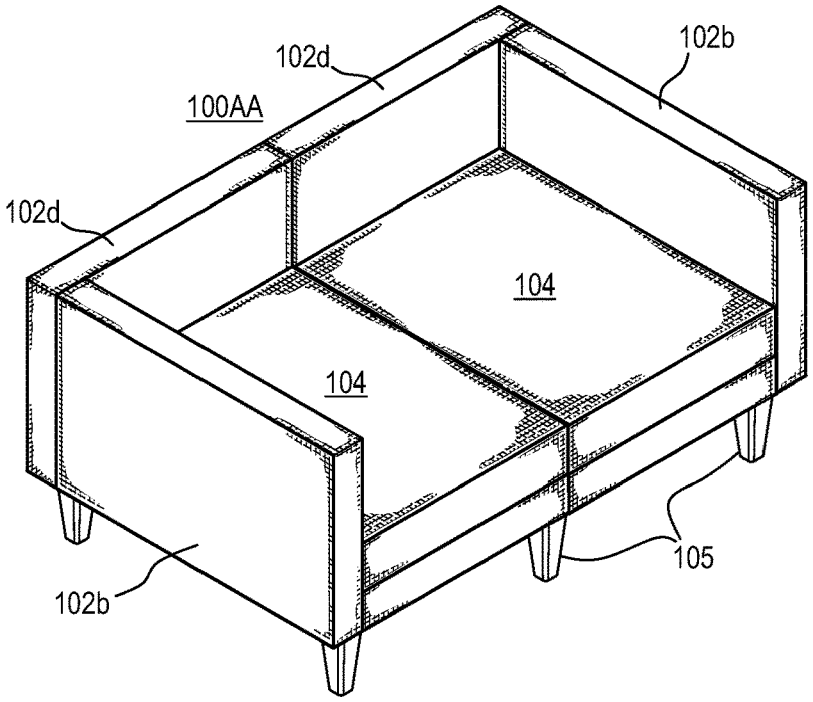
Figure 14G:
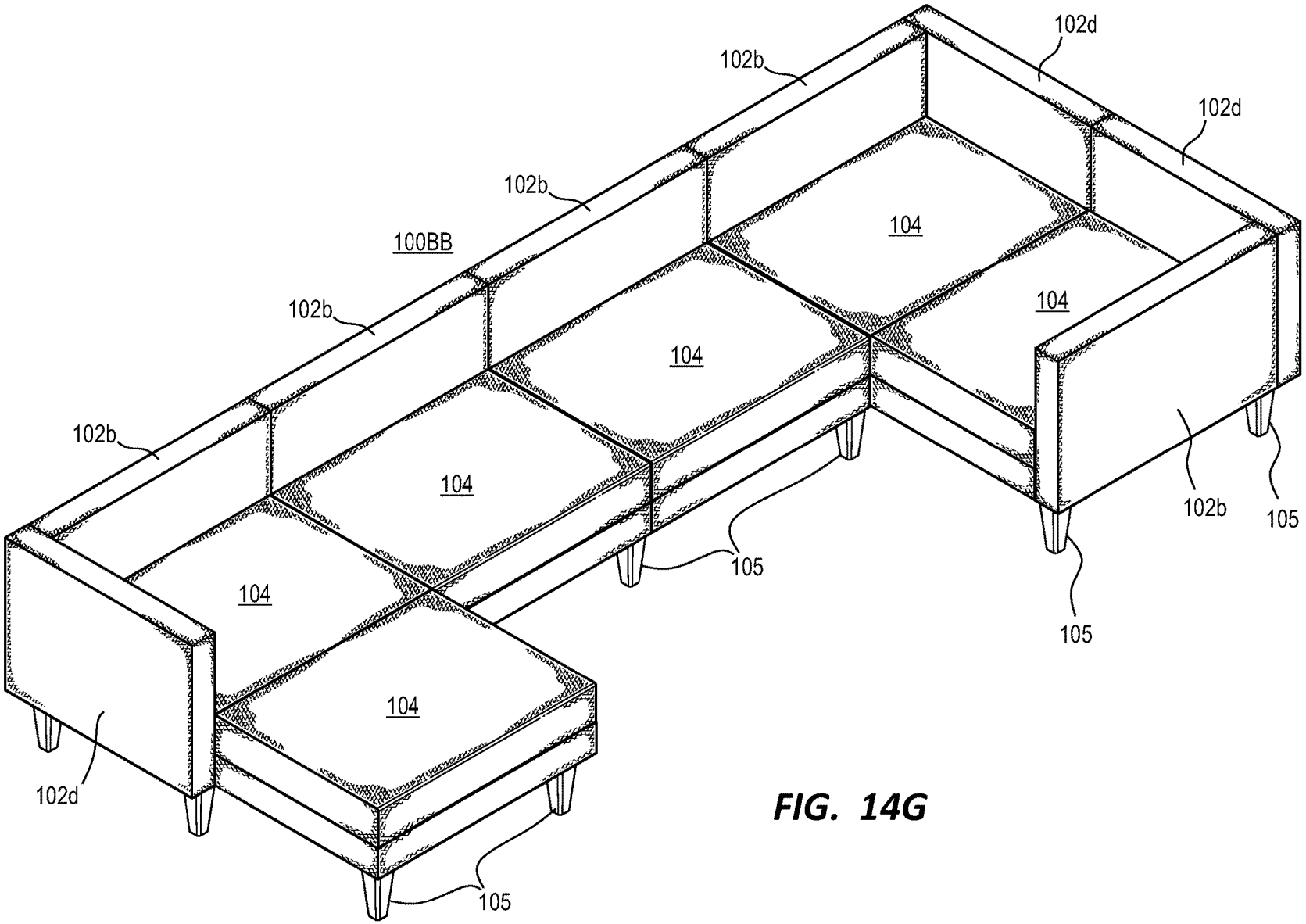
Figure 14H:
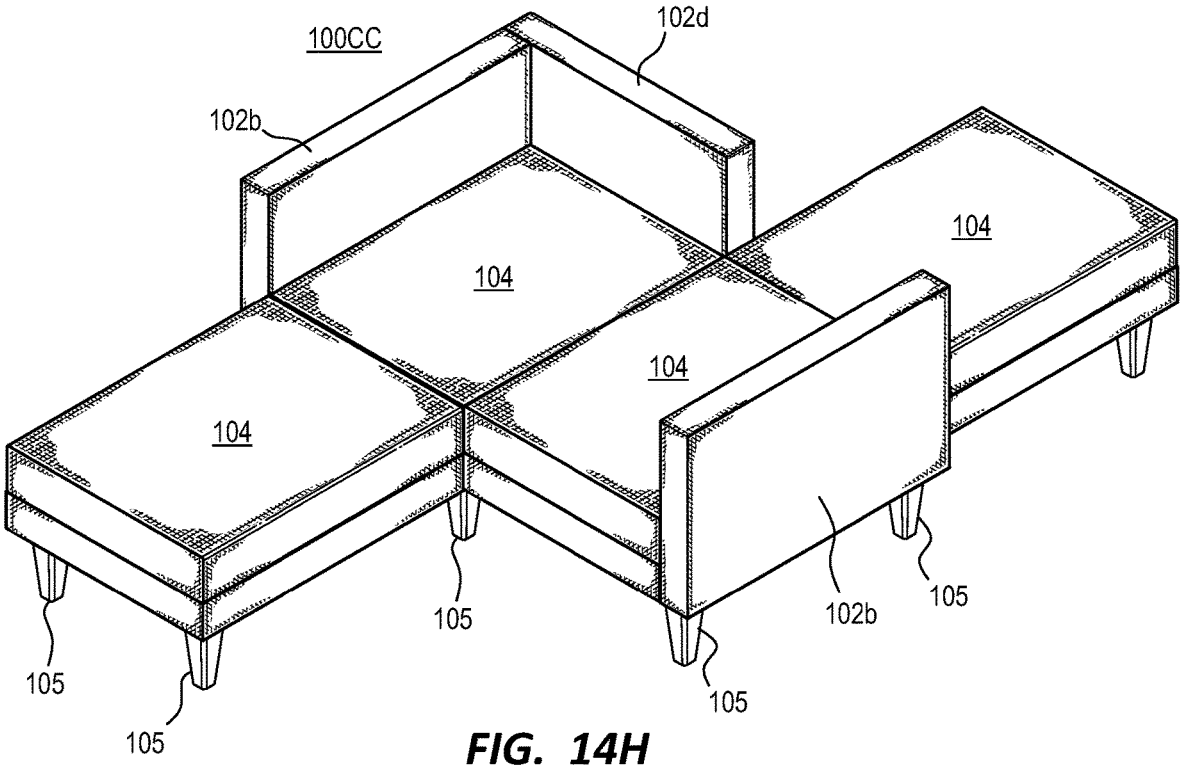
Figure 14I:
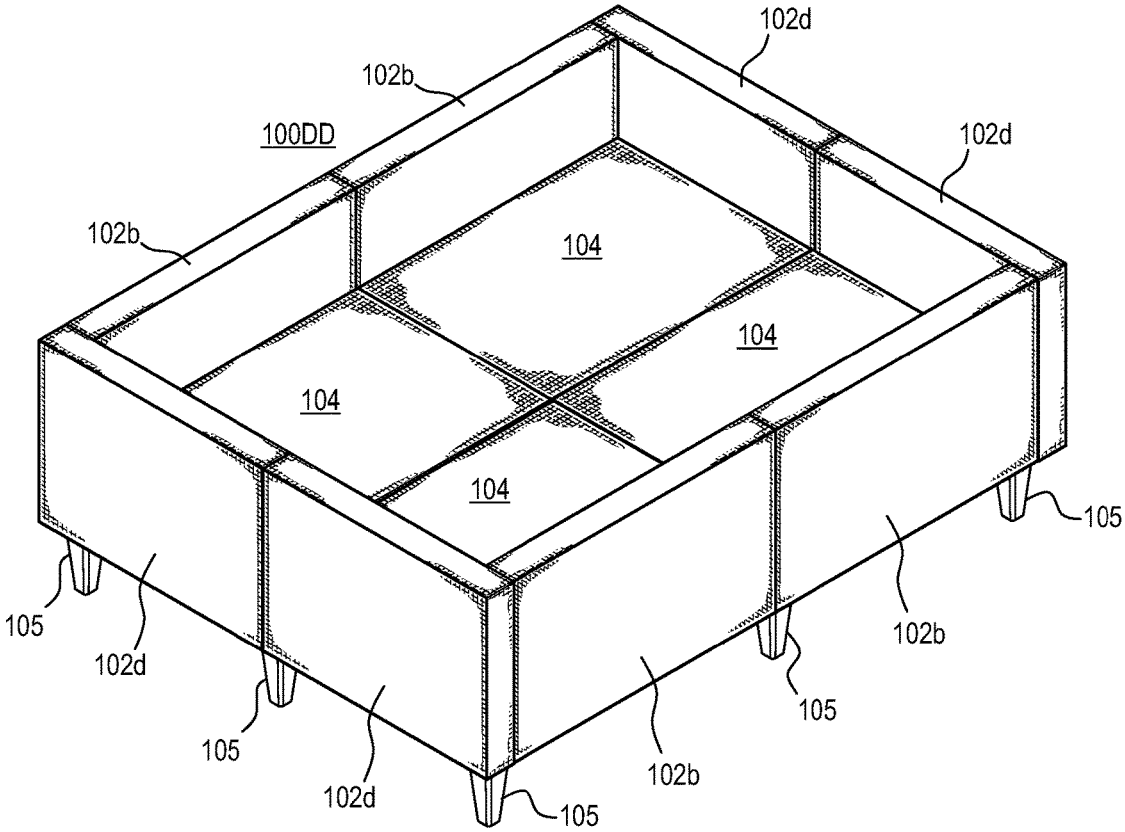
Figure 14J:
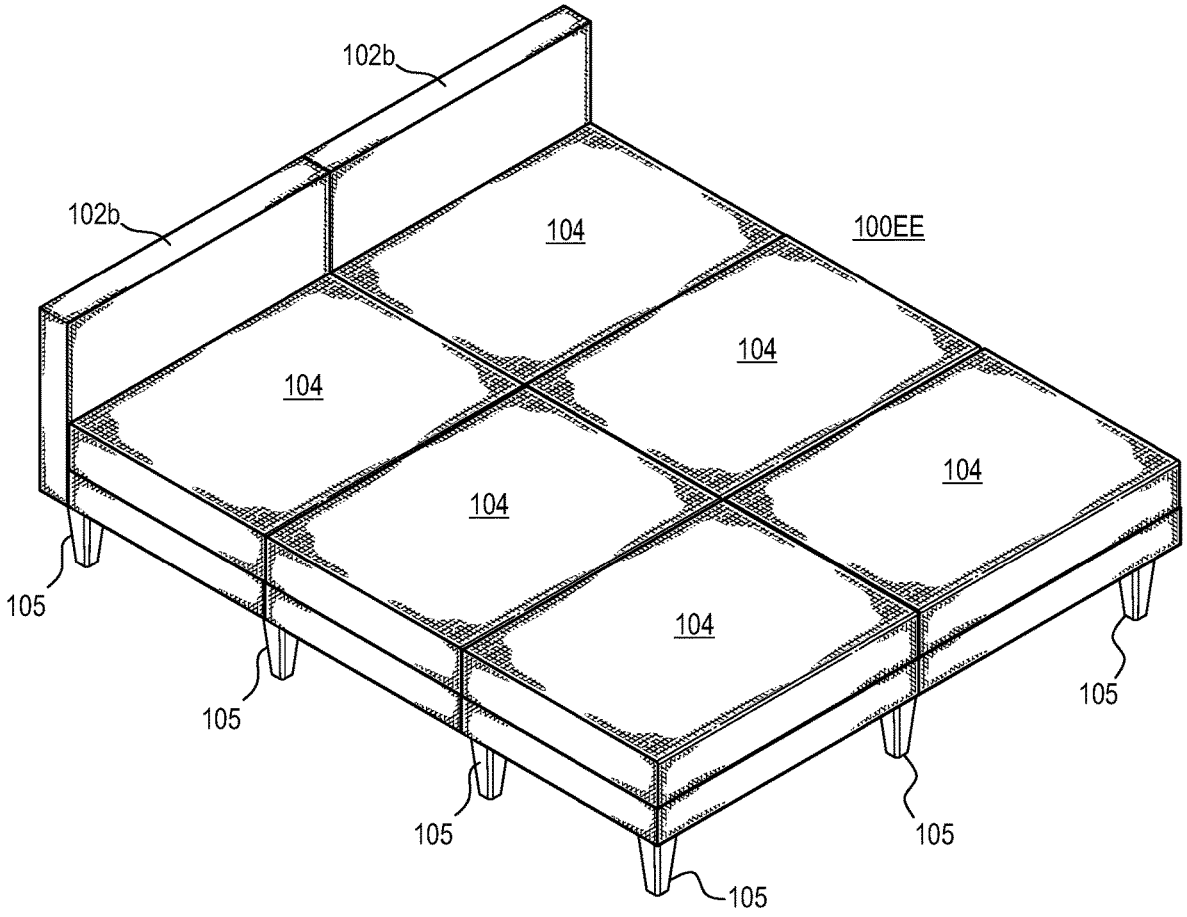

FIG. 14E illustrates a modular furniture assembly 100Z having a shallow-seated configuration where the long length (X) of the bases 104 is parallel to the upright members 102*b* used as backrests. In contrast, FIG. 14F illustrates a modular furniture assembly 100AA having a deep-seated configuration which is very similar to that of FIG. 9A, where the long length (X) of the bases is perpendicular to the upright members 102*d* positioned as backrests. FIG. 14G illustrates a modular furniture assembly 100BB with six bases 104, and various upright members, of varying lengths. FIG. 14H illustrates a modular furniture assembly 100CC with four bases 104, and various upright members, of varying lengths, and FIG. 14I illustrates a modular furniture assembly 100DD with four bases 104 and various upright members, of varying lengths. FIG. 14J illustrates yet a modular furniture assembly 100EE with six bases 104 and two upright members 102*b*.

Figure 15:
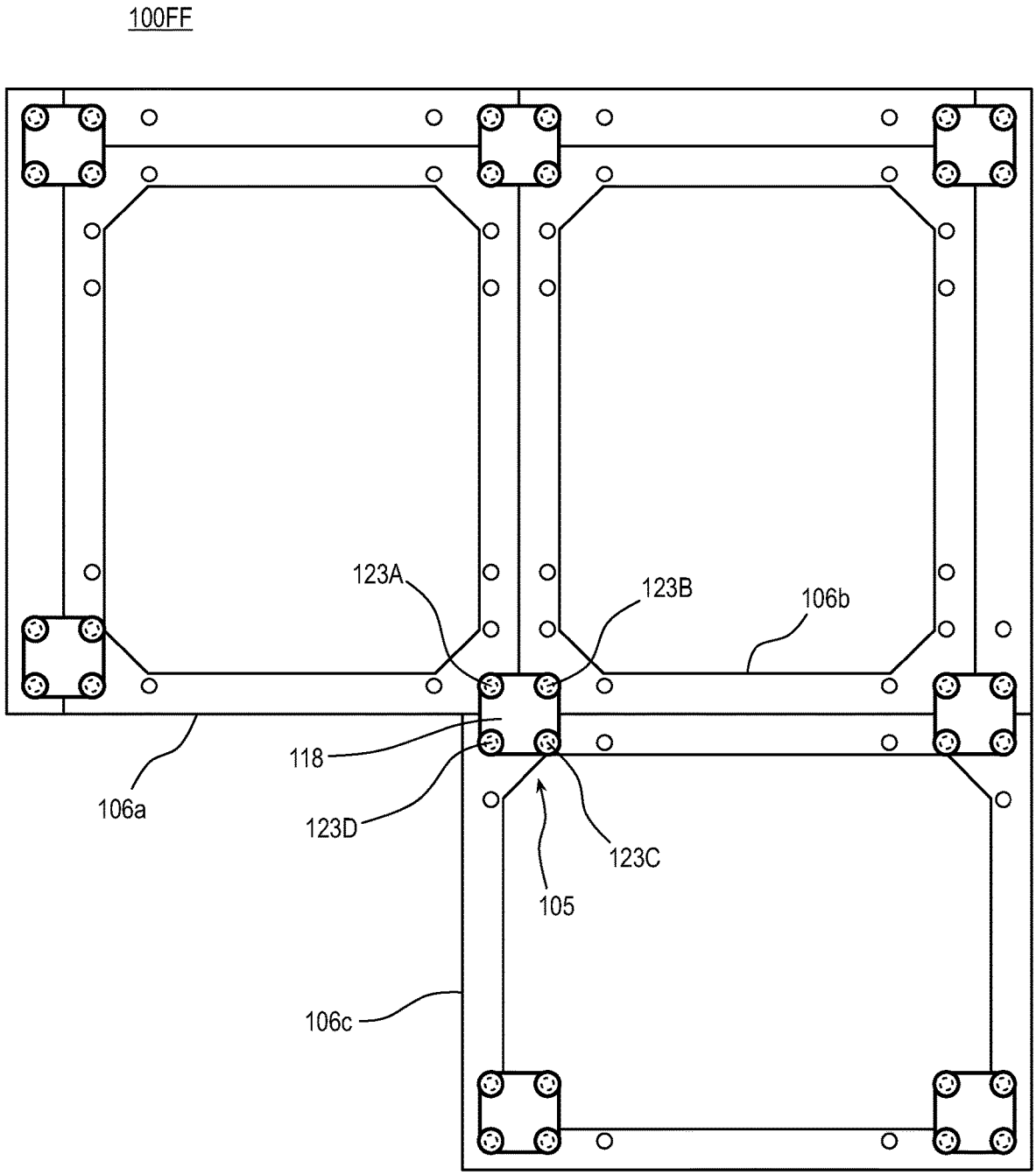
FIG. 15 illustrates an exemplary arrangement of the connector plates.

FIG. 15 illustrates an example assembly 100FF having three separate base frame assemblies, including frame assembly 106*a*, frame assembly 106*b*, and frame assembly 106*c*. These three frame assemblies 106*a*, 106*b*, and 106*c* are connected to one another via a connecter member or plate 118 (e.g., of a connector leg assembly 105 as described herein) that is configured to enable protruding members 108 of the connector leg assembly 105 and other connection members (e.g., a bolt, a snap member, etc.) to couple the various modular furniture components together. The portions 123A, 123B, 123C, and 123D correspond to areas where protruding members 108, holes 116, and other connection mechanisms are positioned to provide a secure connection, as described herein.

Figure 16A:
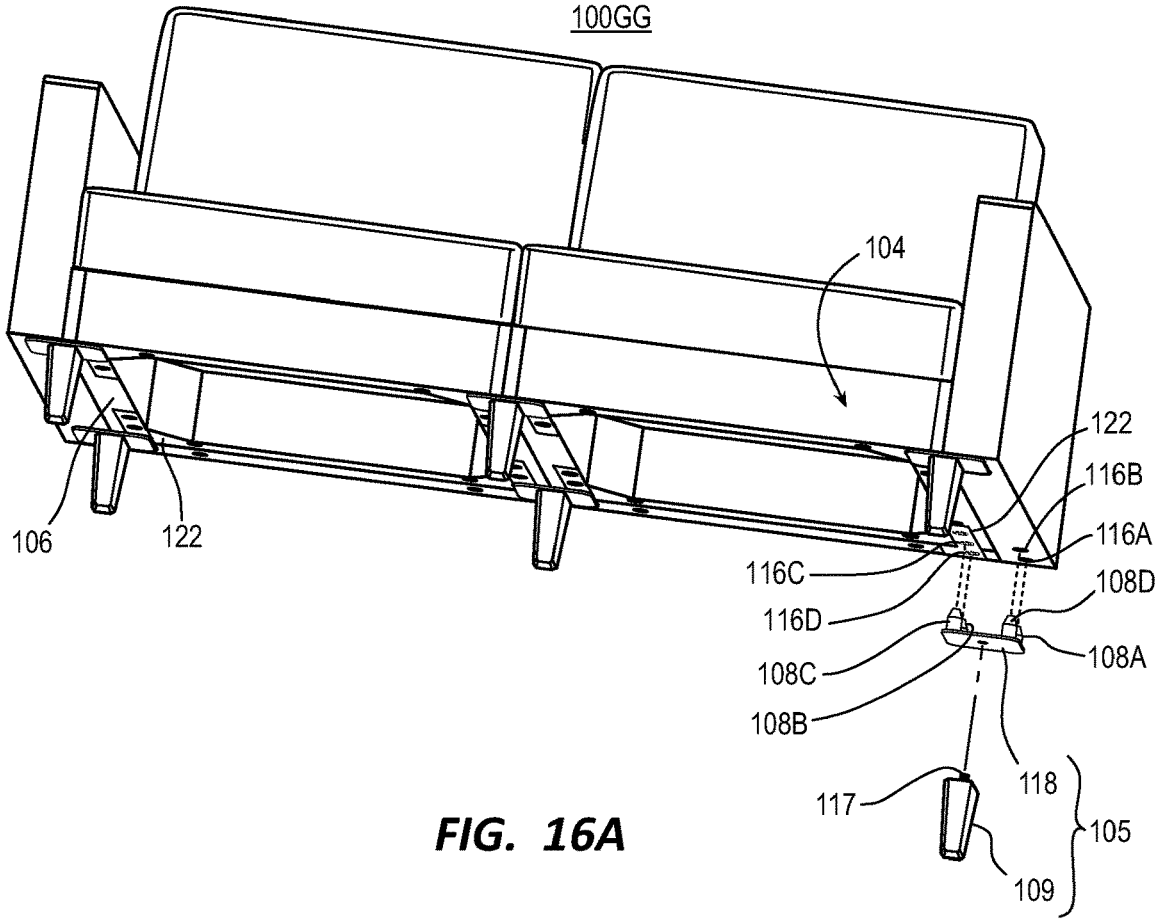
FIG. 16A illustrates a scenario in which a connector leg is being attached to a connector plate, for attachment into holes of the frame assembly and upright member frame assembly.
Figure 16B:
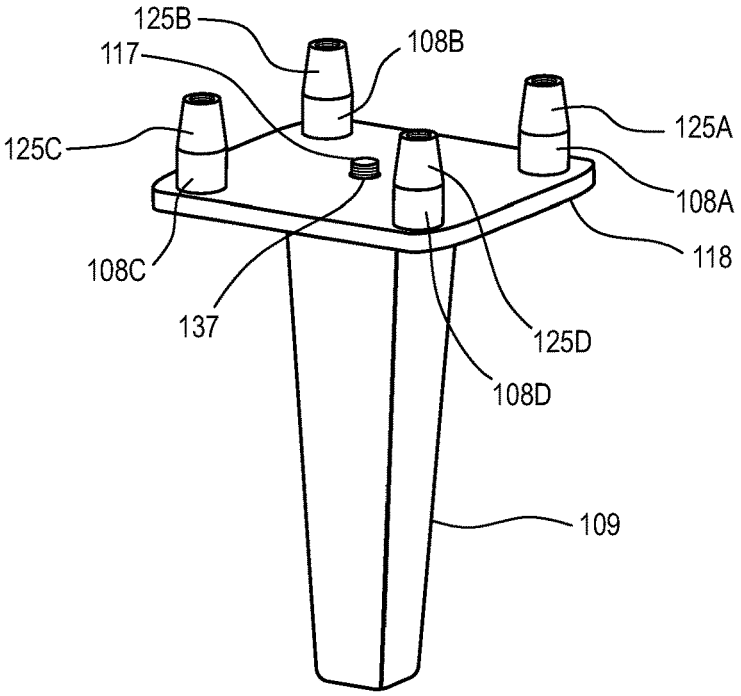
FIG. 16B illustrates exploded close up view of a connector leg and connector plate.

FIGS. 16A and 16B illustrate the modular furniture assembly 100GG from FIG. 9B and a connector leg assembly 105 disconnected from the base 104. The connector leg assembly 105 includes leg 109 with a pin 117, which is inserted into a hole 137 of the connector member or plate 118 including a number of protruding members, such as protruding members 108A, 108B, 108C, and 108D. These protruding members 108A, 108B, 108C, and 108D are inserted into corresponding holes provided within the corresponding frame assembly 106 of each base 104 in the manner described earlier. For instance, protruding member 108A is inserted into hole 116A, protruding member 108B is inserted into hole 116B, protruding member 108C is inserted into hole 116C, and protruding member 108D is inserted into hole 116D in the manner recited earlier. The holes 116A-116D are included within the frame assembly 106. In an embodiment, such holes 116A-116D may be aligned with the holes 124A-124D of the reinforcing member 122 or the holes 116A-116D and the holes 124A-124D can be formed as a part of a reinforcing member 122, where such reinforcing member 122 is affixed, coupled to, or otherwise forms a part of the remainder of the frame assembly 106 of the base or upright members within which such holes are provided. For example, FIGS. 8A-8B may illustrate the presence of such reinforcing members 122 that form a part of the base frame assembly (e.g., L-shaped plates that extend around and aid in defining and reinforcing the various coupling holes). Such reinforcing members 122 could also be provided as a part of the upright member frame assembly. The connector leg 109 may be screwed, snapped, or otherwise affixed to the connector member or plate 118 in a secure manner (such as cooperation of the pin 117 with the hole 137), and the protruding members 108A, 108B, 108C, and 108D of the connector member or plate 118 may be received into the desired holes of the base frame assembly and/or upright member frame assembly, and held in place with bolts or other fasteners as disclosed herein.

FIG. 16B illustrates a close up view of the connector leg 109, the connector member or plate 118, and the protruding members 108A-D. The protruding members 108A-D optionally have a chamfered or angled top portion or end 125A-125D. Some embodiments of the protruding members 108A-108D may not be angled. During assembly, it is often the case that one end of the base 104 is unsupported. The top portion or ends 125A-125D of the protruding members 108A-108D enable the supported end of the base 104 to tilt while that supported base 104 is supported on the connector leg assembly 105. This arrangement makes assembly easier and ensures the base 104, and the various coupling components do not get damaged. The connection also reduces the movement of the modular furniture pieces in the plane of the connector member or plate 118. Additional details regarding this tilting benefit are discussed hereafter.

Accordingly, some embodiments disclosed herein illustrate a modular furniture assembly, such as the modular furniture assemblies of FIGS. 8A-B and 16A-B, that includes two or more receiving holes (e.g., holes 124A and 124B in FIG. 8A) on a bottom portion of the base 104 (e.g., the frame assembly 106 in FIG. 8A). The modular furniture assembly also includes two or more receiving holes 124 on a bottom portion of the upright member 102*c*. Such holes 124 may be open at both ends, as shown in the various Figures, to allow insertion of the protruding members 108 into the bottom of such holes 124 and connecting fasteners, bolts, or the like into the top opening of such holes 124. For instance, the upright member 102*c* is shown as including two holes 124 (illustrated using dotted lines). The modular furniture assembly also includes a connector leg assembly 105 (e.g., the connector legs 109 in FIGS. 6A, 6B, 7A, and 7B form part of a connector leg assembly 105) configured to selectively secure the bottom portion of the base 104 to the bottom portion of the upright member 102*c*.

As mentioned previously, the connector leg assembly 105 includes a connector member or plate (e.g., plate or connector member 118) with its protruding members (members 108A-108D) and a leg (e.g., connector leg 109) which can be connected to (or is already provided fixedly attached to) a bottom surface of the connector member or plate 118. The leg 109 is configured to elevate at least a portion of the modular furniture assembly above a floor upon which the base 104 is supported. The connector leg assembly 105 includes two or more protruding members (e.g., protruding members 108A-108D) extending from a top surface of the connector member or plate 118. The two or more protruding members 108A-108D are configured to selectively attach to the corresponding receiving holes 124 of the base 104 and the upright member 102.

In some implementations, the two or more receiving holes 124A-124D of the base 104 are separated from one another by a distance equal to the thickness or width ($Z_1$) of the upright member 102, such that $Z_1=Z_2$. In some cases, the connector leg assembly 105 further includes a coupling plate (e.g., plate 113) configured to aid in selectively securing the two or more protruding members 108A-108D of the connector leg assembly 105 within the two or more receiving holes 124A-124D of the base 104 (or upright member 102). In some cases, the connector member or plate 118 coordinates with a top portion of the frame assembly 106 and selectively attaches to the two or more protruding members 108A-108D of the connector leg assembly 105 via a fastener, bolt, or the like in the two or more receiving holes 124A-124D of the base 104 (and/or upright member 102).

FIGS. 17A, 17B, 17C, 17D, and 17E illustrate various different implementations or structures of the protruding members discussed herein. The configurations illustrated in FIGS. 17A-17E are examples of coupling units or couplers that can be used to join adjacent bases and upright members. Like structures of other coupling units, couplers or connector leg assemblies described herein are identified with like reference numerals. For instance, the connector leg assemblies 105G-105K of FIGS. 17A-17E can have like structures and sub-structures as other described connector leg assemblies herein.

Figure 17A:
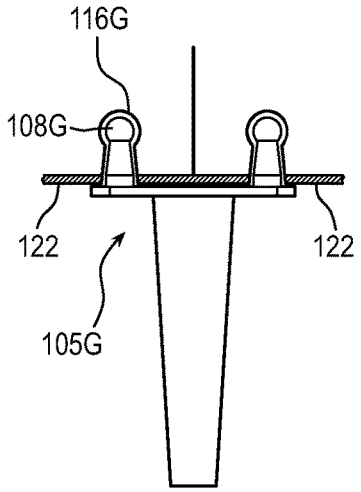
FIGS. 17A, 17B, 17C, 17D, and 17E illustrate different configurations of connector plates, and how they couple into corresponding holes of the frame assembly (or upright member frame assembly).

FIG. 17A illustrates a ball-in-socket implementation in which the protruding member 108G is a ball member and the corresponding hole 116G is a socket member, having a corresponding ball shaped opening. The protruding member 108G snaps inside of the hole 116G in a manner typical of a ball-in-socket configuration.

Figure 17B:
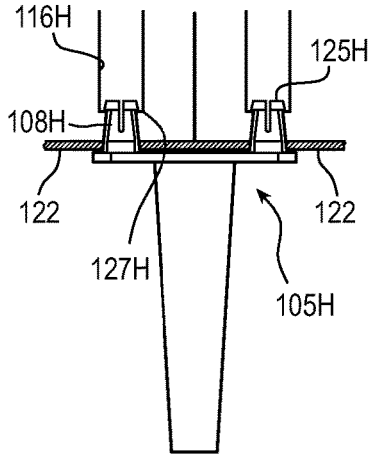

FIG. 17B shows a snap connection technique. Specifically, the protruding member 108H has a bifurcated top portion or end 125H that can act as a snapping member that, when inserted into the hole 116H, is initially compressed (e.g., radially or centrally compressed). Once the protruding member 108H is sufficiently pressed inside of the hole 116H, the protruding member 108H snaps back to its original expanded state as it engages with surfaces 127H, thereby locking the connector leg assembly 105H in place.

Figure 17C:
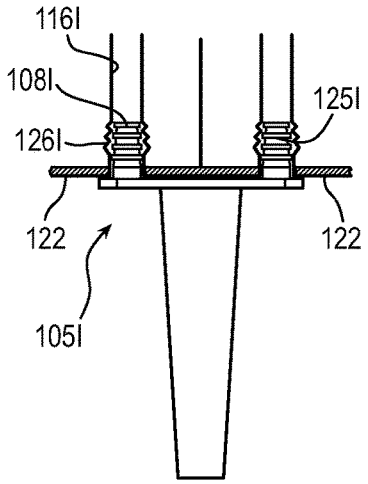

FIG. 17C illustrates an interference connection technique. Here, the protruding member 108I includes a number of wave-like structures 125I. The hole 116I also includes a number of corresponding wave-like structures 1261. The structures 125I of the protruding member 108I interconnect with the structures 1261 of the hole 116I to thereby lock the connector leg in place. For instance, the structures 1261 and 1261 can include a complementary teeth and groove or troughs that cooperate to securely, and selectively removably, couple or mount the protruding member 108I to the hole 116I.

Figure 17D:
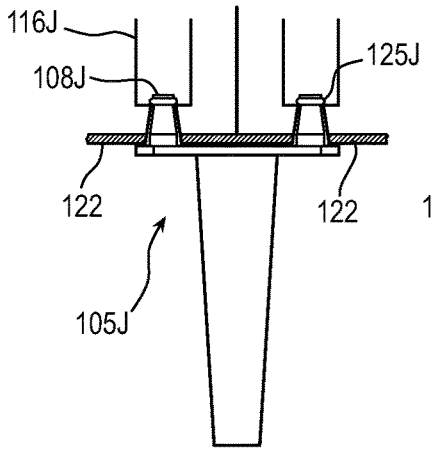

FIG. 17D illustrates a spring-loaded lock connection mechanism. Here, the protruding member 108J includes a spring-loaded head 125J that is compressed when inserted into the hole 116J, which has a tapered configuration. When inserted into the hole 116J a sufficient amount, the springs 125J decompress in a direction generally perpendicular to the insertion direction and lock the protruding member 108J in place.

Figure 17E:
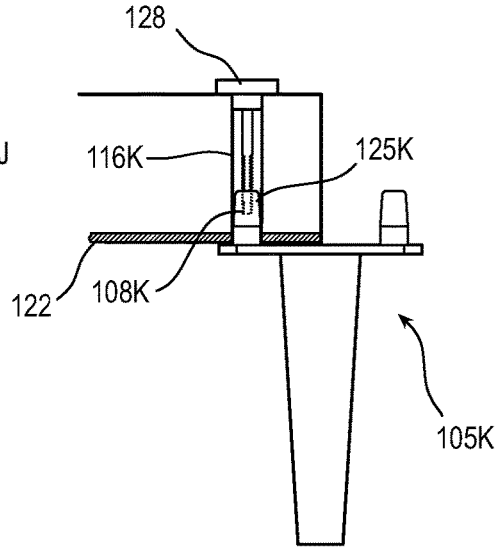

FIG. 17E illustrates a hole 116K, a protruding member 108K, and a fastener 128, which can be similar to the fastener 112 described herein. Here, the fastener 128 is inserted into the hole 116K and the protruding member 108K is also inserted into the hole 116K. The fastener 128 then screws into a receiving connection part 125K at the top of the protruding member 108K. In some embodiments, the upright member may further include one or more coupling structures (e.g., any of the couplers mentioned in FIGS. 17A-E) configured to detachably couple the upright member to one or more of the two or more protruding members of the connector leg assembly. For example, the frame assembly 106 and the frame assembly of the upright member 102 may include similar portions of the described coupling mechanisms, to allow coupling of a base 104 to an upright member 102, through the connector leg assembly 105.

Figure 18A:
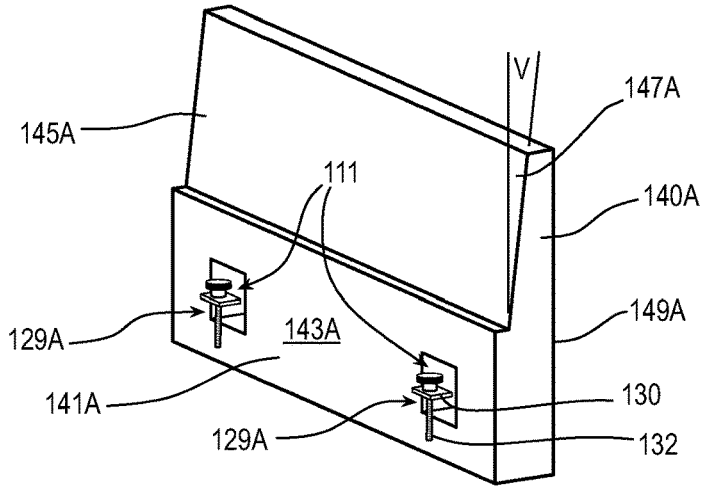
FIGS. 18A, 18B, and 18C are perspective views illustrating different couplers in relation to an upright member.

FIG. 18A illustrates an upright member 140A (representative of any of the upright members herein) and a connection mechanism 129A, having a plate 130 and a fastener 132 with a knob, the fastener 132 being similar to the fastener 112 described herein. The plate 130 and the fastener 132 are used to connect to receiving protruding members 108 of a connector leg assembly 105. In this example implementation, the upright member 140A includes a recessed portion or coupling hole 111 in the inside major planar face of the upright member 140A in which the plate 130 and the fastener 132 are to be at least partially placed in, where the fastener 132 will be inserted through a corresponding hole, as has been discussed already. The major planar face 143A is disposed in a lower portion 141A with an inclined portion 145A extending from the lower portion 141A. The inclined portion 145A inclines at an angle 147A in relation to a vertical direction V. The angle 147A is about 0 degrees to about 135 degrees, about 0 degrees to about 90 degrees, about 0 degrees to about 60, about 0 degrees to about 45, about 0 degrees to about 30, about 0 degrees to about 20, about 10 degrees to about 30 degrees, about 10 degrees to about 20 degrees, or about 20 degrees.

While the major planar face 143A is generally perpendicular to the base 104 or frame assembly 106 to which it attaches, such as being in a vertical plane, it can also be inclined in relation to the base 104 or frame assembly 106 such that an entirety of the upright member 140A is inclined at the angle 147A in relation to the base 104 or frame assembly 106. Additionally, while a back 149A of the upright member 140A is illustrates as being generally parallel to the vertical direction V, it will be understood that back 149A can be inclined at an angle the same as or different to the angle 147A. The other upright members described herein and also be inclined as described in relation to the upright member 140A.

Figure 18B:
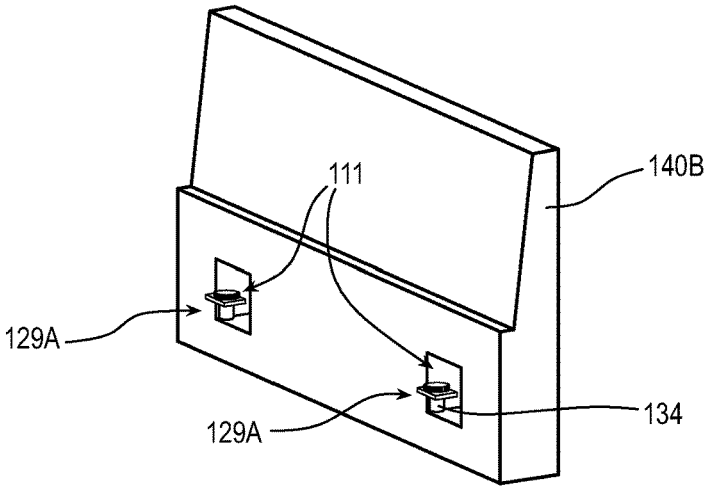
Figure 18C:
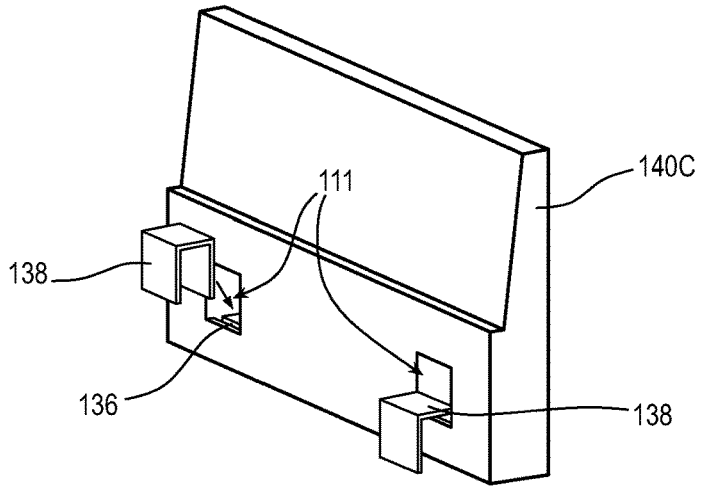

FIG. 18B illustrates another embodiment of an upright member 140B and a connection mechanism 129B having pins 134 that connect to holes in the horizontal seat member (i.e., the base 104). FIG. 18C illustrates an upright member 140C with a recessed coupling hole 111. A slot 136 and a clamping bar 138 (multiple bars are illustrated) are also illustrated. A corresponding slot can also be provided in an adjacent base being coupled (not illustrated). The clamping bar 138 connects or is inserted into the base's slot to thereby connect the horizontal seat member (i.e., the base) to the upright member 140C via the clamping bar 138 and the slots of the upright member and the base, which receives the arms of the clamping bar 138. Accordingly, in some cases, a coupler (e.g., any of the coupling mechanisms mentioned in FIGS. 18A-C) is configured to detachably couple the upright member to the base, and the base and the upright member each have an aperture, a recessed portion, or coupling hole that receives a portion of the coupler.

Figure 19A:
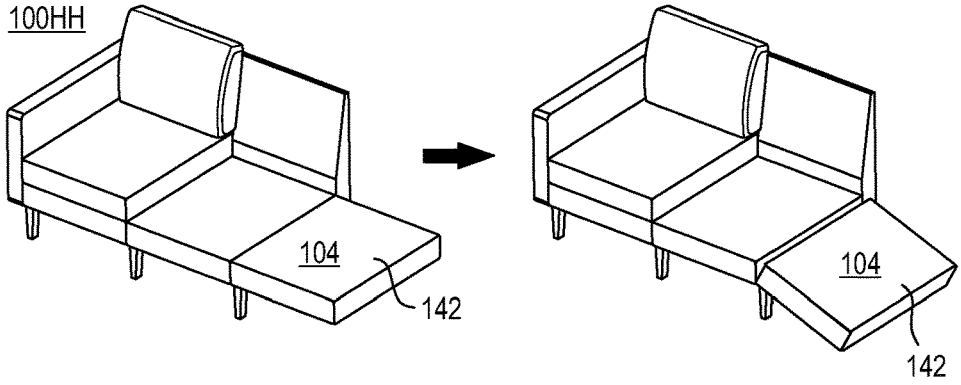
FIGS. 19A, 19B, 19C, and 19D illustrate a technique for assembling a modular furniture assembly via an improved tilting operation that minimizes or reduces damage to the modular furniture assembly components.
Figure 19B:
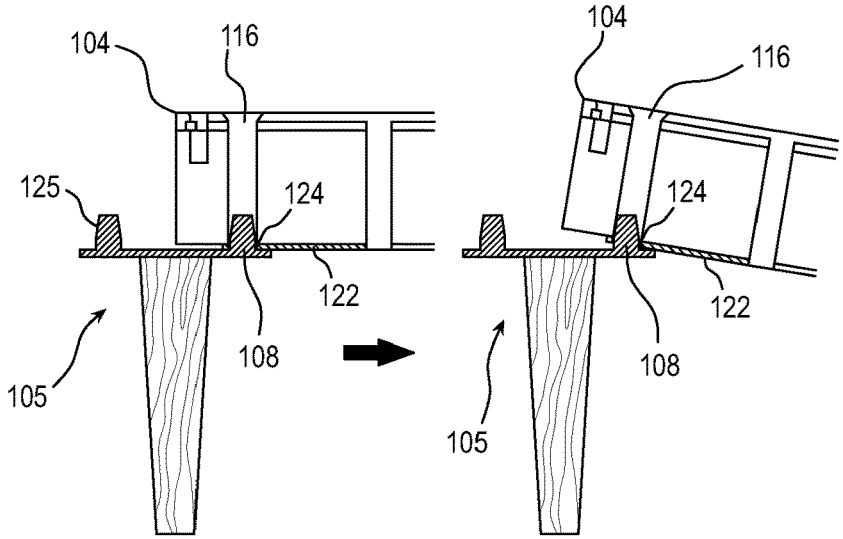
Figure 19C:
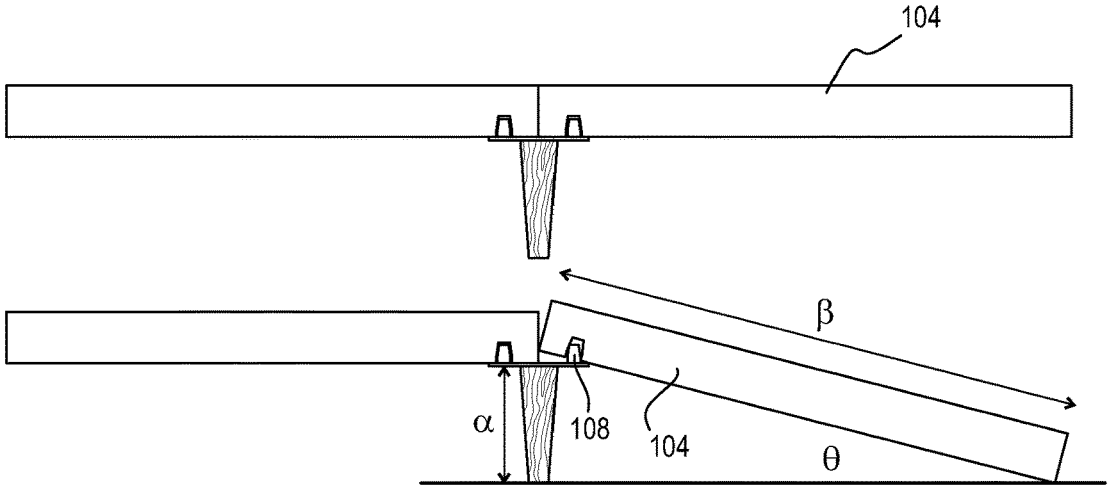

FIGS. 19A, 19B, and 19C illustrate an improved assembly technique that is provided by the disclosed embodiments. First, it is often the case that during assembly, one end of a modular furniture assembly 100HH, such as the end 142, is unsupported, cantilevered relative to the adjacent base, and the remainder of the seating surface being constructed. As a result of this unsupported state, the end is often tilted downward, as shown by tilted end 142 in FIG. 19A. Traditionally, this tilted state causes damage to the various components, such as components of the connector leg assemblies 105, the base 104, the frame assembly 106 and associated coupling components.

In accordance with the disclosed principles, however, at least some of the embodiments described herein provide structures that aid with tilting the base or upright member in relation to connector leg assembly without causing such damage. The structures can include modifications to the protruding member so that it includes a chamfered or tapered end, differently sized holes in the reinforcing plate, and/or differently sized holes in the base and upright member. One or more of these modified structures can aid with reducing damage to the components of the modular furniture assembly during use and rearrangement. Both the holes in the reinforcing plate and the holes within the base or upright can be larger in diameter than a diameter of the protruding member. In another configuration, the holes in the reinforcing plate can be substantially the same size as a diameter of the protruding member, while a diameter of at least a portion of the holes in the base or upright member are larger than the diameter of the protruding member. More generally, all or a portion of the holes in the reinforcing plate and/or the holes within the base or upright member can be oversized and have larger diameters than the diameter of the protruding member Generally, and with reference to FIG. 19A-19D, the top portion or end 125 of the protruding members 108 can be chamfered or include an inclined surface to allow angularly orientating the connector leg assembly 105 in relation to the base 104 or upright 102 (FIG. 3). In addition to, or as an alternate manner to aid with tilting of the base 104, the holes 124 in the reinforcing member 122 and/or the holes 116 within the base 104 or upright member 102 can be oversized to allow movement of the protruding member 108. These changes to the reinforcing member 122 allow the reinforcing member 122 to function as an aligner and spacer that aids with tilting, while also providing structural support to the connection between the connector leg assembly 105 and the base 104 or upright member 102. A thickness of the plate 122 can be selected to aid with tilting of adjacent bases 104, for instance.

Figure 19D:
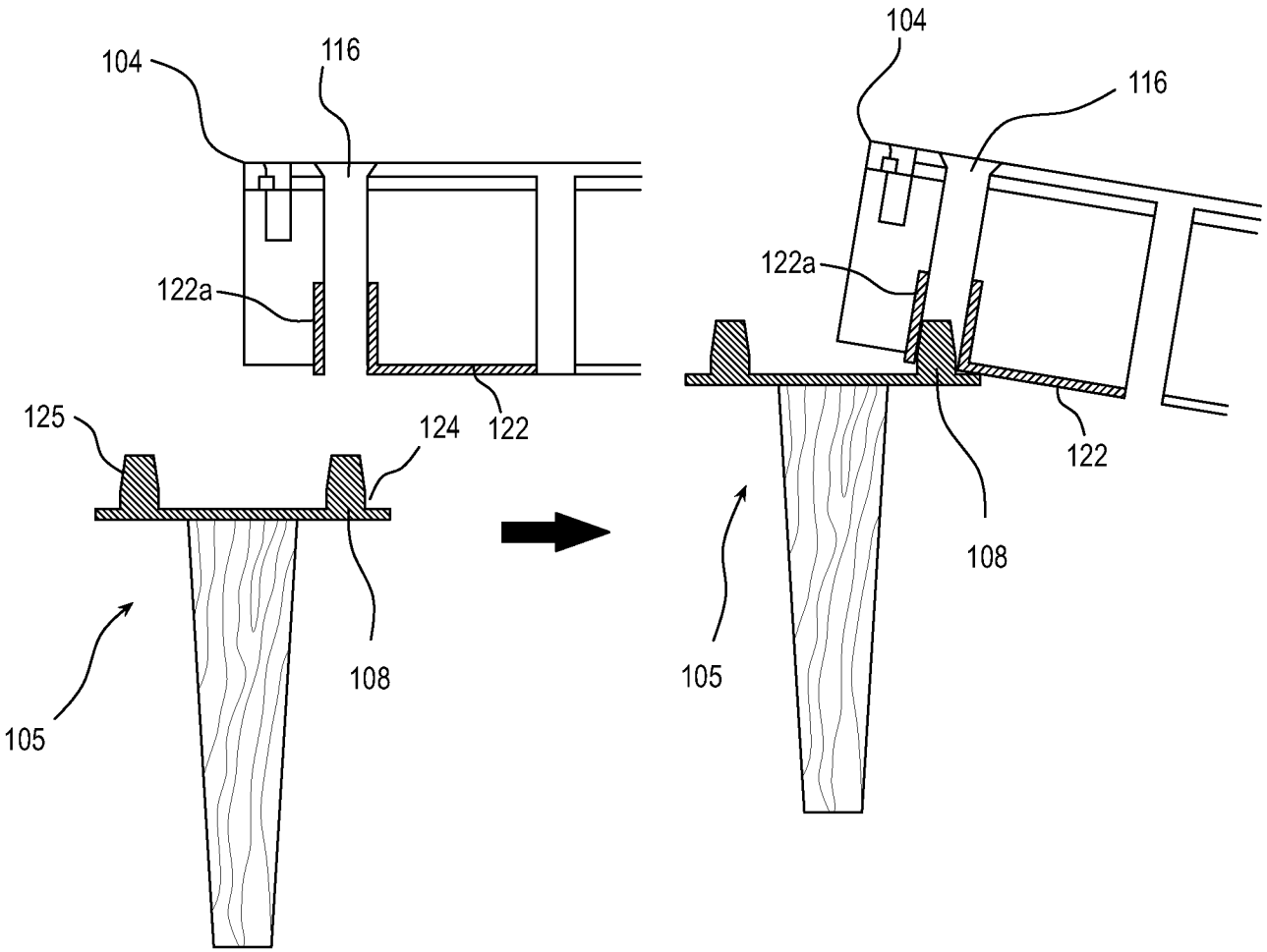

While the reinforcing member 122 is illustrated disposed on the lower or bottom surface of the base 104, it will be understood that a portion 122*a* of the reinforcing member 122, as an aligner and spacer, can be disposed within hole 116, such as illustrated in FIG. 19D. The portion 122*a* tapers outwardly from the bottom of the base 104, for instance, towards the top. This provides additional space for movement of the protruding member 108 to aid with tilting of the base 104, for instance. This tapering can also take the form of a chamfer in the reinforcing member 122 in the configurations of FIGS. 19B and 19C where the reinforcing member 122 is mounted to the base 104 without extending into the hole 116. The chamfer or inclined surface, in combination with a thickness of the reinforcing member 122, can be selected to aid with tilting the base. For instance, a thinner reinforcing member 122 in combination with an oversized hole 116 aids with tilting by providing more maneuverability of the protruding member 108 and the hole 116.

The reinforcing member 122 can be formed of a metal, alloy, polymer etc. and optionally molded to the base 104 or upright member 102 or otherwise coupled or fixably attached to the base 104 or upright member 102 to align and space adjacent bases and upright members.

Turing to FIG. 19B, illustrated is the base 104 and the hole 116. FIG. 19B also shows a protruding member 108 of a connector leg assembly 105. In this example configuration, the protruding member 108 includes a chamfered or angled top portion or end 125. In other embodiments, the protruding member 108 is narrower at the top than at the bottom, as will be discussed with respect to FIGS. 20A and 20B. Structuring the protruding member 108 in this manner allows the base 104 to tilt. For instance, the right side of FIG. 19B shows a tilted base 104, a hole 116, and a protruding member 108. The chamfered top portion or end 125 of the protruding members 108 is angled or designed to allow the tilted base 104 to tilt a sufficient angle to at least allow the other end 142 of the tilted base 104 to touch the ground, as shown in FIG. 19A. FIG. 19B illustrates the chamfer top portion or end 125, and chamfer angle of the protruding member 108, that allows such to occur. The amount of tilt which the disclosed embodiments may accommodate may, for example, be anywhere from 0 degrees to 25 degrees. In some cases, it is from about 8 degrees to about 22 degrees while in other cases it may be from about 11 degrees to about 19 degrees. These angles may also apply to the chamfer angle of the protruding member 108, relative to an otherwise vertical protruding member 108. The chamfering angle can be between about 1 degree to about 25 degrees to support the tilting of the base 104. The tilt angle can be dependent on the connector leg height and the seat or base width or length, whichever extends from the connection point to the tilted end that rests on the ground. In the illustrated deep-seat configuration, it is the base width that assumes this tilted orientation. In a shallow-seat configuration, it would be the base length. In any case, the chamfering or angling of the protruding member 108 is designed to support a tilt of the tilted base 104 of any angle up to and including about 25 degrees. In some cases, the chamfering may support a tilt that is beyond about 25 degrees, such about 30 degrees, about 45 degrees, or more than about 45 degrees.

Accordingly, in some embodiments, the modular furniture assembly further includes a connector leg that couples the base and the upright member together. The connector leg includes one or more protruding members that each (optionally) have a chamfered end or at least a narrower top end and a wider bottom end to allow tilting of the base when the modular furniture assembly is in a partially assembled state. When a chamfer angle of the chamfered end is present, that angle is between about 1 and about 25 degrees. When there is now angling and instead when the top end is simply narrower than the bottom end, then the proportional relationship between the narrower top and the wider bottom end is structured to allow the base to tile between about 0 and about 25 degrees. Accordingly, some embodiment refrain from using a chamfer and instead use a pocket in the seat frame in that area to allow for tilt, thereby providing the freedom to use whatever mating geometry is optimal for the connection.

FIG. 19C shows a base 104 in a non-tilted state and the same base 104 in a tilted state. The indicator β corresponds to the tilted dimension of the horizontal seat member 104 (i.e., either the dimension (X) or (Y), depending on the orientation) and the indicator θ is the tilt angle of the base 104. As indicated above, the chamfered portion of the protruding member 108 is designed to support tilt angles (e.g., represented by the indicator θ) up to about 25 degrees, though a higher tilt angle may be supported in some embodiments. The chamfering of the protruding member 108 and the tilt angle may depend on the leg height a, such as approximately 7 inches in this illustrated configuration, while it is understood that other leg heights are possible as taught herein or otherwise understood from the present disclosure, and the tilted seat dimension (e.g., represented by indicator θ). Accordingly, in some embodiments, the protruding members 108 of the leg assembly 105 each comprise a chamfered post. Consequently, each protruding member 108 is configured to permit tilting of the base 104 and the upright member 102, while minimizing or preventing damage to the associated components.

Accordingly, some embodiments of the modular furniture assembly described herein, or otherwise contemplated by the present disclosure, include a base configured to have a long side or length (X) in a horizontal plane and a short side or width (Y) in the horizontal plane. The modular furniture assembly also includes one or more upright members, which may be of varying dimensions (e.g., dimension (Y)), dimension (X), dimension (X+Z), or dimension (Y+Z)) in the horizontal plane and a width ($Z_1$) in the horizontal plane. The upright member is configured to be positioned such that a height ($H_U$) of the upright member is substantially greater than a height (H) of the base. The base and the upright member have a defined spatial relationship defined in the following manner:

The long side or length (X) of the base is substantially equal to the sum of the short side or width (Y) of the base and two times a dimension Z which can be the thickness or width ($Z_1$) of the upright member or a separation distance ($Z_2$) between adjacent receiving holes in the base 104 and/or the upright member 102. As a result of using this spatial relationship definition, different furniture configurations can be formed.

In some cases, the long side or length (X) of the base is substantially equal to the long side or length (X') of the upright member. In other cases, the upright member may have a different length, and upright members having such varying lengths may be used in the same assembly, as needed, for backrests and armrests. Some embodiments further comprise a coupler configured to detachably couple the upright member to the base. In some implementations, the height ($H_U$) of the upright member is perpendicular to the length of the upright member.

Optionally, some embodiments further include a connector leg assembly configured to selectively secure a bottom portion of the base to a bottom portion of the upright member. Here, the connector leg assembly includes a connector leg and two or more protruding members (e.g., on a plate member attached to the leg) configured to selectively attach to the bottom portions of the base and the upright member. In an embodiment, the protruding members of the connector leg are separated from one another in at least one direction by a distance substantially equal to the width (Z) of the upright member.

Figure 20A:
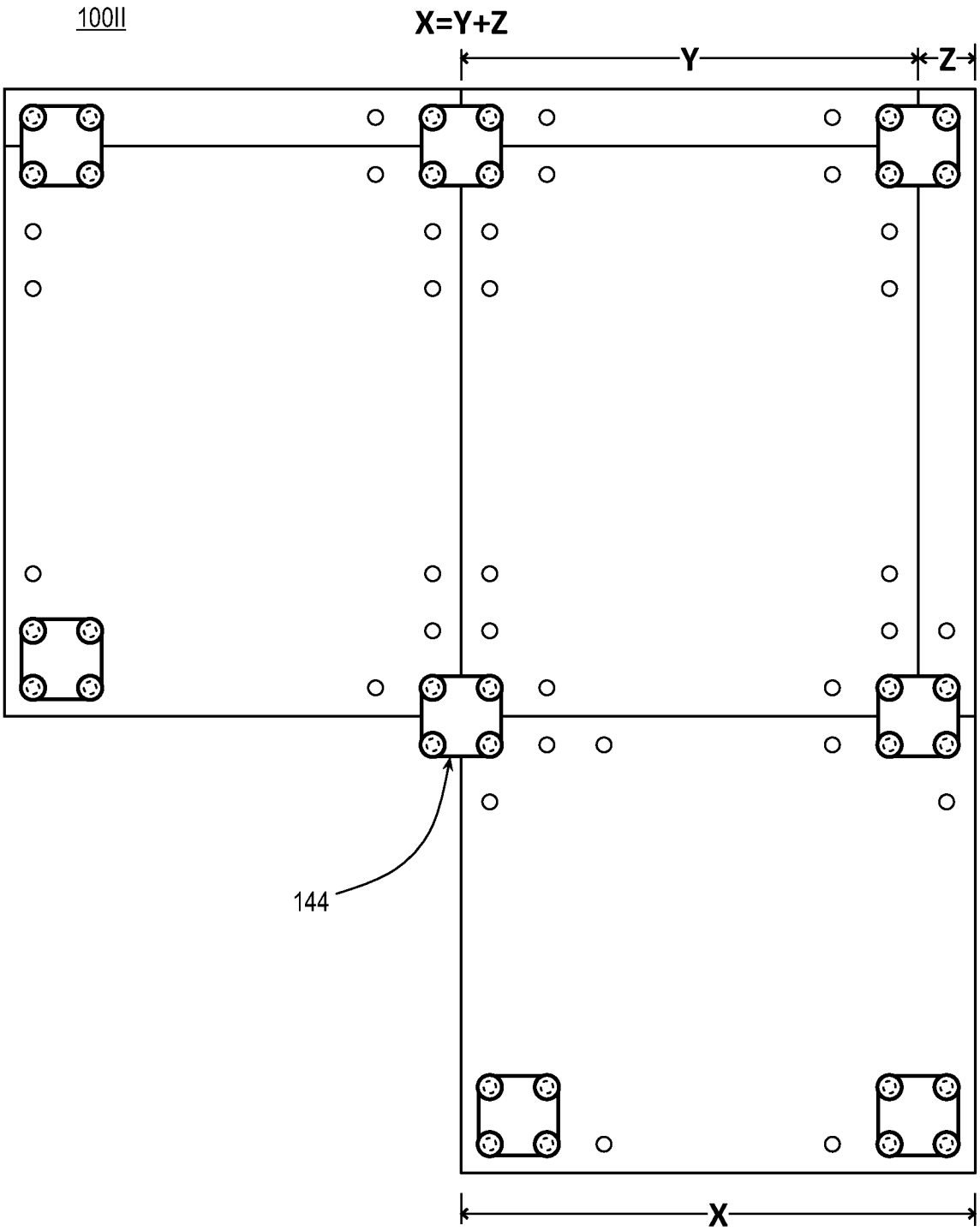
FIGS. 20A-20B demonstrate an advantage of the present modular furniture assembly having X=Y+2Z geometry, as compared to an assembly having X=Y+Z geometry.
Figure 20B:
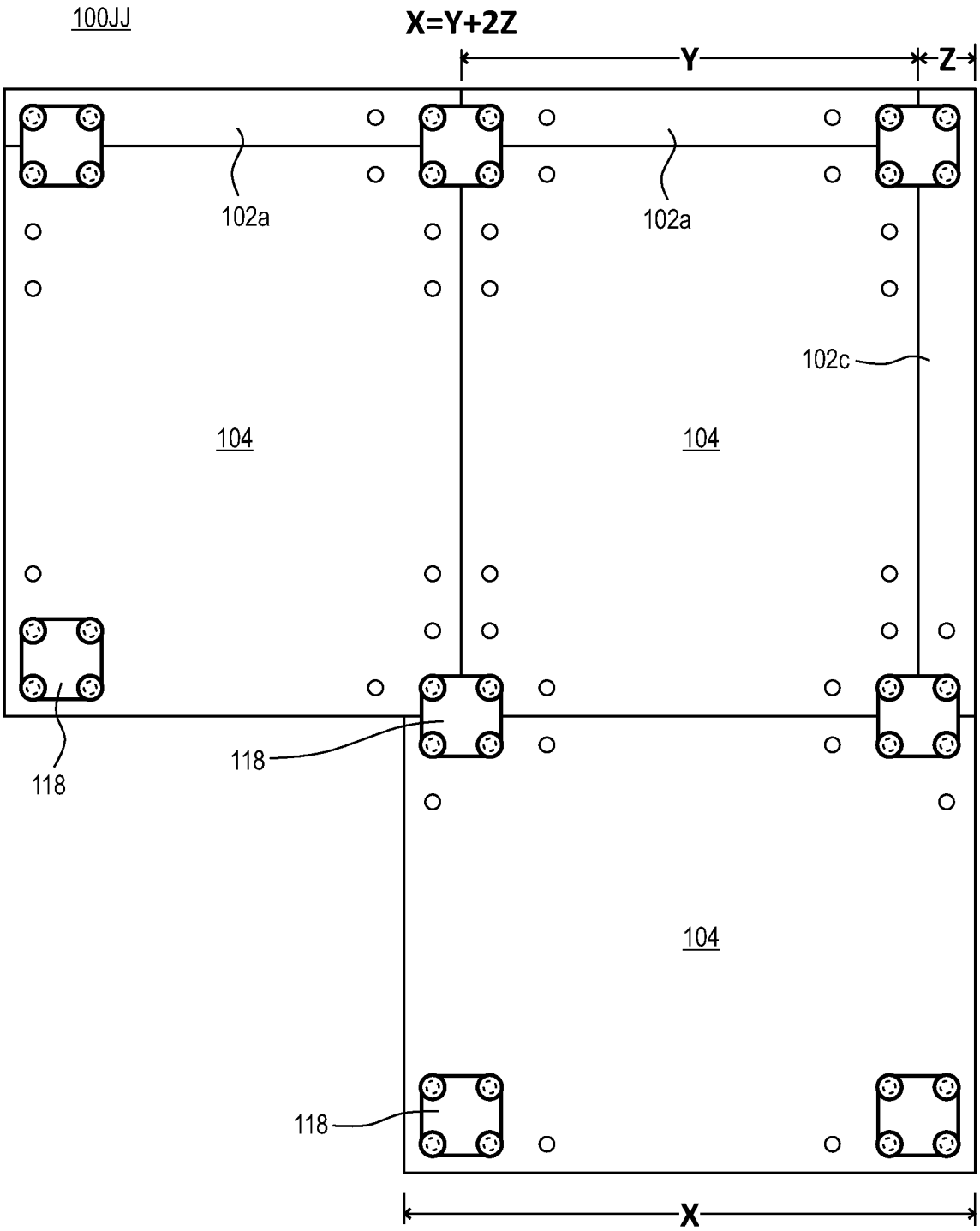

FIGS. 20A-20B illustrate an advantage of the present system, defined by the X=Y+2Z geometry, as compared to a X=Y+Z geometry (i.e., modular furniture assembly 100II of FIG. 20A). FIGS. 20A-20B illustrate similar 3-seat configurations, with FIG. 20A being based on an X=Y+Z geometry, and FIG. 20B showing the present X=Y+2Z geometry. The furniture assembly 100JJ of FIG. 20B includes 3 bases 104, two shorter upright members 102*a*, and a longer upright member 102*c*, as shown. With the X=Y+Z system of FIG. 20A, straight modular furniture assemblies require only square-shaped connector plates, but an L-shaped or U-shaped furniture assembly such as that shown requires an additional and specialized L-shaped connector plate at the interior corner location 144. The result is that a customer using the embodiment of FIG. 20A who wants to change from a straight couch to a U or L shaped sectional would have to purchase an additional component. With the X=Y+2Z configuration, shown in FIG. 20B, the included square connector plates are sufficient to construct a straight furniture assembly, or an L or U-shaped sectional, without the necessity to acquire any additional connector plate components of different configuration/shape.

The new X=Y+2Z geometry also better lends itself to slimmer, thinner upright members (for a unique and particular aesthetic appearance or style), while preserving a significant difference in seat depth between the shallow-seat orientation and the deep-seat orientation of the base. In other words, if using an X=Y+Z geometry with slim upright members, the difference between the X and the Y dimension of the base becomes far less pronounced (approaching a square), resulting in no significant difference between a resulting shallow-seat orientation and a deep-seat orientation of the bases. By way of contrast in the X=Y+2Z configuration, the (X) dimension remains significantly distinct from the (Y) dimension even when the (Z) dimension is relatively thin. Additionally, the X=Y+2Z geometry where Z is $Z_2$, or a separation distance of adjacent holes in the base and/or upright member lends itself to maintaining spacing of the components of the modular furniture assembly, such as but not limited to the bases, upright members, and connector leg assemblies, when uprights members are replaced or changed. For instance, by maintaining $X=Y+2Z_2$ when the $Z_1$ is larger than $Z_2$, for instance, the coupling locations for the connector leg assemblies with the base and the upright members remains substantially the same, thus allowing for enhanced interchangeability for the components of the modular furniture assembly.

In some embodiments, the furniture assembly includes at least one base and at least one upright member to form a couch and/or chair. In some embodiments, an upright member functions as a backrest or armrest when coupled to a base. In another embodiment, at least one base and one or more upright members can be used to form a bed with the one or more upright members functioning as a headboard or footboard. In one such embodiment, a base can be sized large enough to serve as a stand-alone bed and/or can serve as a box spring on which a cushion or mattress can be mounted. In some embodiments, one or more bases can form a bed or ottoman with or without the use of upright members. Accordingly, various assemblies can be formed using bases and/or upright members to form a couch, chair, bed, and/or other type of furniture piece of the present invention.

In some embodiments, each base and each upright member includes a frame assembly and a cover (e.g., a fabric or other cover) of similar or identical dimensions to the base frame assembly or upright member frame assembly, such that the cover of each base frame assembly has a length (X) that is substantially equal to the sum of a width (Y) of the base frame cover and two times a width (Z) of the upright member cover. A cover may of course also be provided for the cushion portion of the base, as well. In some embodiments, the covers are removable, washable, and can be interchanged with covers of substantially the same geometry. Such embodiments enable manufacturers to provide covers of various styles, materials, and colors that can be used interchangeably by consumers.

Figure 21A:
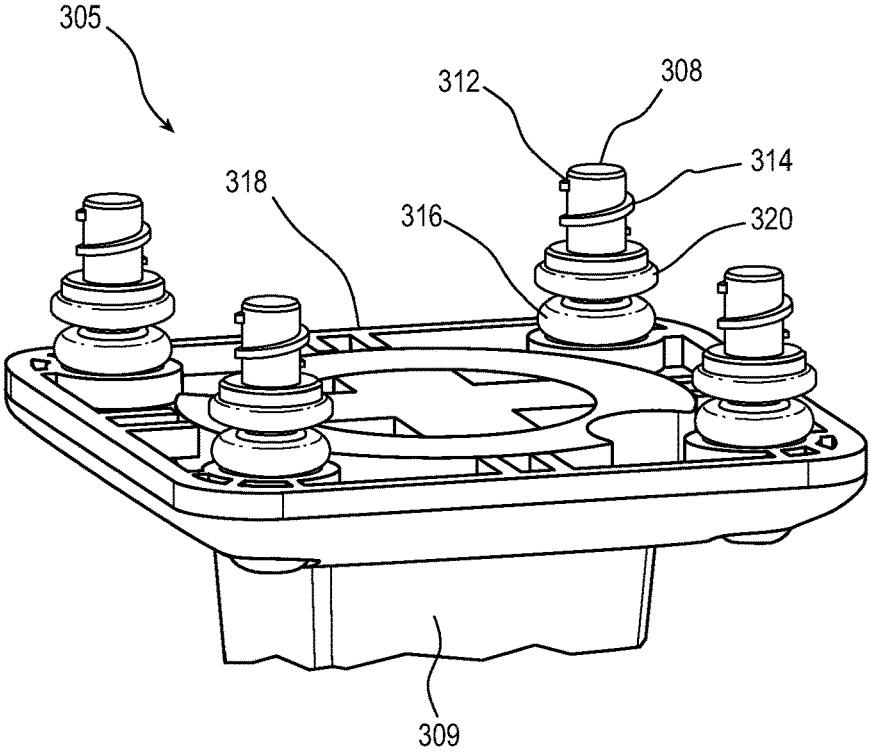
FIGS. 21A and 21B illustrate various additional configurations for the protruding members and how those members connect to the base.
Figure 21B:
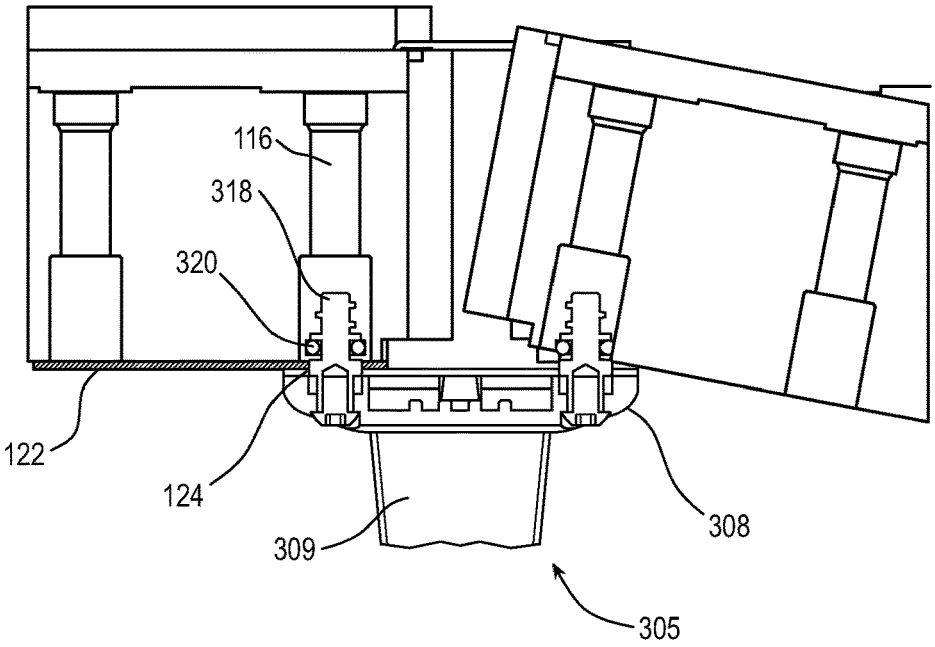

FIGS. 21A and 21B illustrate additional uses and configurations of the connector leg assemblies 305, which can be similar to the other connector leg assemblies described herein or otherwise contemplated by the disclosure presented herein. Specifically, FIG. 21A shows a connector leg assembly 305 having a leg 309, a connector leg plate 318, and a protruding member 308. In this example configuration, the protruding member 308 does not necessarily include a chamfering angle 310, as discussed in earlier embodiments. Here, the protruding member 308 includes top end 312 and a threaded portion 314 for connecting to a receiving hole 116A-116D. From FIG. 21A, one can observe how the top end 312 of the protruding member 308 is narrower than the base portion 316. The base portion 316 connects the protruding member 308 to the frame assembly 106 of the base 104. As will be discussed shortly, the frame assembly 106 has a larger diameter pocket in the area where the protruding member 308 is inserted, thereby allowing the frame assembly 106 to tip, as discussed earlier.

The protruding member 308 also includes an O-ring 320. The O-ring 320 operates to help retain the entire connector leg (which includes the protruding member 308) against the frame assembly 106 in the event that a customer lifts the end of the frame assembly 106. By structuring the protruding member 308 to include the O-ring 320, the connector leg 109 is prevented from falling out before the unit is fully assembled and even when the unit is fully assembled.

FIG. 21B again shows the connector leg assembly 105 including the leg 109, the connector member or plate 118, the protruding member 308, the top end 312, the threaded portion 314, the base portion 316, and the threaded portion 314. FIG. 21B also shows a hole 116, which has been described in detail in earlier figures. Notice, the protruding member 308 can be inserted into the hole 116 to form a secure connection between the base 104 and the connector leg 109. Optionally, as discussed in FIGS. 19A-D, when the modular furniture assembly is being assembled, a user can allow one end of the base 104 to be in a tilted state. Because of the narrower top end 312 of the protruding member 308, the tilted base 104 will not exert undue strain on the protruding member 308, as shown in the right hand side of FIG. 20B. The hole 116, and hole 124 or the reinforcing member 122, is sized to allow the O-ring 320 to tightly pass through the opening end of the hole 116 (e.g., the O-ring 320 can be compressed while passing through the opening end of the hole 116 and then decompressed once entirely through the opening end). When the base 104 is in the tilted state, the O-ring 320 may remain within the hole 116 while the base portion 316 is at least partially dislodged or separated from the hole 116. Accordingly, some embodiments structure the protruding member to have a chamfering angle while other embodiments structure the protruding member to have a narrower top end 312 and a larger base portion 316 to allow tilting of the base when the modular furniture assembly is in a partially assembled state.

The modular furniture components and methods disclosed in the present application may also be used in connection with numerous furniture assemblies, e.g., such as, but not limited to, any similar to those disclosed in (i) U.S. Pat. No. 9,277,826, entitled MOUNTING PLATFORM FOR MODULAR FURNITURE ASSEMBLY, (ii) U.S. Pat. No. 8,783,778, entitled MOUNTING PLATFORM FOR MODULAR FURNITURE ASSEMBLY, (iii) U.S. Pat. No. 7,963,612 entitled MODULAR FURNITURE ASSEMBLY, (iv) U.S. Pat. No. 7,547,073, entitled MODULAR FURNI- TURE ASSEMBLY, (v) U.S. Pat. No. 7,213,885 entitled MODULAR FURNITURE ASSEMBLY, (vi) U.S. Publication No. 2017/0367486 entitled MODULAR FURNITURE ASSEMBLY CORNER SEATING SYSTEM, (vii) U.S. Pat. No. 10,212,519 entitled ELECTRONIC FURNITURE SYSTEMS WITH INTEGRATED INTERNAL SPEAKERS, (viii) U.S. Pat. No. 10,236,643 entitled ELECTRICAL HUB FOR FURNITURE ASSEMBLIES, (ix) U.S. Pat. No. 10,143,307 entitled FURNITURE SYSTEM WITH RECLINER ASSEMBLY, and (x) U.S. Pat. No. 10,123,621 entitled FURNITURE SYSTEM RECLINER ASSEMBLY WITH SLED RAILS, each of which is incorporated herein by reference in its entirety.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

Following are some further example embodiments of the invention. These are presented only by way of example and are not intended to limit the scope of the invention in any way. Further, any example embodiment can be combined with one or more of the example embodiments.

Embodiment 1. A modular furniture assembly including a base having a first dimension (X) and a second dimension (Y), and an upright member having a third dimension (Z), wherein the base and the upright member have a defined spatial relationship, the defined spatial relationship being: the first dimension (X) of the base is substantially equal to a sum of the second dimension (Y) of the base and two times the third dimension (Z) of the upright member, such that different furniture configurations can be formed.

Embodiment 2. The modular furniture assembly of embodiment 1, wherein the third dimension (Z) is selected from a width of the upright member ($Z_1$) or a separation distance between two or more receiving holes ($Z_2$) formed in the upright member.

Embodiment 3. The modular furniture assembly of any of the embodiments 1-2, wherein the two or more receiving holes of the base are separated from one another by the separation distance ($Z_2$) that is equal to the third dimension (Z) of the upright member; the two or more receiving holes of the upright member are separated from one another by the separation distance ($Z_2$) that is equal to the third dimension (Z) of the upright member; and at least one of the two or more receiving holes of the base is separated from at least one of the two or more receiving holes of the upright member by a distance substantially equal to the third dimension (Z) of the upright member when the modular furniture assembly is assembled.

Embodiment 4. The modular furniture assembly of any of the embodiments 1-3, wherein the separation distance ($Z_2$) between two or more receiving holes can be larger or smaller than the third dimension (Z), so long as the separation distance ($Z_2$) for both the base and the upright member match.

Embodiment 5. The modular furniture assembly of any of the embodiments 1-4, wherein a fourth dimension of the upright member is (X'), and wherein the first dimension (X) of the base is substantially equal to the fourth dimension (X') of the upright member.

Embodiment 6. The modular furniture assembly of any of the embodiments 1-5, wherein a height ($H_U$) of the upright member is substantially greater than a height (H) of the base.

Embodiment 7. The modular furniture assembly of any of the embodiments 1-6, wherein a height ($H_U$) of the upright member is perpendicular to a length of the upright member.

Embodiment 8. The modular furniture assembly of any of the embodiments 1-7, wherein a length of the upright member is a length in a horizontal plane and the first dimension (X) of the base is a length in said horizontal plane, and wherein the second dimension (Y) of the base is in said horizontal plane and the third dimension (Z) of the upright member is in said horizontal plane.

Embodiment 9. The modular furniture assembly of any of the embodiments 1-8, further including at least one first coupling unit associated with at least one of the base and the upright member; at least one second coupling unit associated with a connector leg assembly, the at least one first coupling unit corresponding with and the at least one second coupling unit.

Embodiment 10. The modular furniture assembly of any of the embodiments 1-9, further comprising at least one fastener that cooperates with both the at least one first coupling unit and the at least one second coupling unit.

Embodiment 11. The modular furniture assembly of any of the embodiments 1-10, wherein the at least one first coupling unit is complementary with the at least one second coupling unit.

Embodiment 12. The modular furniture assembly of any of the embodiments 1-11, wherein the connector leg assembly comprises a connector plate; a leg connected or selectively connectable to the connector plate, the leg being configured to elevate at least a portion of the modular furniture assembly above a floor upon which the base is supported; and the at least one second coupling unit, the at least one second coupling unit comprising a receiving hole selectively alignable with the at least one first coupling unit.

Embodiment 13. The modular furniture assembly of any of the embodiments 1-12, wherein the at least one second coupling unit comprises at least one protruding member extending from a top surface of the connector plate, the at least one protruding member being configured to selectively be received into at least one receiving holes of the at least one first coupling unit.

Embodiment 14. The modular furniture assembly of any of the embodiments 1-13, further comprising two or more receiving holes on one of a bottom portion of the base or a bottom portion of the upright member; two or more receiving holes on the other of the bottom portion of the base or the bottom portion of the upright member; and a connector leg assembly configured to selectively secure the bottom portion of the base to the bottom portion of the upright member, the connector leg assembly comprising: a connector plate; a leg connected or selectively connectable to a bottom surface of the connector plate, the leg configured to elevate at least a portion of the modular furniture assembly above a floor upon which the base is supported; and two or more protruding members extending from a top surface of the connector plate, the two or more protruding members configured to selectively be received into the receiving holes of the base and the upright member.

Embodiment 15. The modular furniture assembly of any of the embodiments 1-14, wherein the two or more receiving holes of the base are separated from one another by a distance equal to a separation distance of the receiving holes of the upright member; the two or more receiving holes of the upright member are separated from one another by a distance substantially equal to the third dimension (Z) of the upright member; and at least one of the two or more receiving holes of the base is separated from at least one of the two or more receiving holes of the upright member by a distance substantially equal to the third dimension (Z) of the upright member when the modular furniture assembly is assembled.

Embodiment 16. The modular furniture assembly of any of the embodiments 1-15, further comprising a clamp assembly configured to selectively secure the two or more protruding members of the connector leg assembly within the two or more receiving holes of the base, wherein the clamp assembly coordinates with a top portion of the base and selectively attaches to the two or more protruding members of the connector leg assembly via the two or more receiving holes of the base.

Embodiment 17. The modular furniture assembly of any of the embodiments 1-16, wherein the two or more protruding members each comprise a narrower top portion and a wider base portion, such that each protruding member permits tilting of at least one of the base or the upright member.

Embodiment 18. The modular furniture assembly of any of the embodiments 1-17, wherein a diameter of the protruding members is smaller than a diameter of each of the two or more receiving holes.

Embodiment 19. The modular furniture assembly of any of the embodiments 1-18, further comprising a reinforcing member having a plurality of holes, the plurality of holes being selectively aligned with the two or more receiving holes, wherein the diameter of the protruding members is smaller than a diameter of the plurality of holes.

Embodiment 20. The modular furniture assembly of any of the embodiments 1-19, wherein the upright member further comprises one or more couplers configured to detachably couple the upright member to the connector leg assembly.

Embodiment 21. The modular furniture assembly of any of the embodiments 1-20, further comprising a coupler configured to detachably couple the upright member to the base, wherein the base and the upright member each have an aperture that receives a portion of the coupler.

Embodiment 22. A modular furniture assembly comprising a base having a length (X) in a horizontal plane, a width (Y) in said horizontal plane; and an upright member having a length in said horizontal plane, a width ($Z_1$) in said horizontal plane, and two receiving holes having a separation distance ($Z_2$), wherein the upright member is configured to be positioned such that a height ($H_U$) of the upright member is substantially greater than a height (H) of the base, wherein the base and the upright member have a defined spatial relationship, the defined spatial relationship being: the length (X) of the base is substantially equal to a sum of the width (Y) of the base and twice a dimension (Z) which is selected from the width ($Z_1$) of the upright member or the separation distance ($Z_2$), such that different furniture configurations can be formed.

Embodiment 23. The modular furniture assembly of embodiment 22, wherein the base comprises two receiving holes having the separation distance ($Z_2$).

Embodiment 24. The modular furniture assembly of any of the embodiments 22-23, wherein a distance between one of the two receiving holes of the base and one of the two receiving holes of the upright member is the separation distance ($Z_2$).

Embodiment 25. The modular furniture assembly of any of the embodiments 22-24, wherein the length of the upright member is (X'), and wherein the length (X) of the base is substantially equal to the length (X') of the upright member.

Embodiment 26. The modular furniture assembly of any of the embodiments 22-25, wherein the length of the upright member is one of: (X); (Y); or (X+Z).

Embodiment 27. The modular furniture assembly of any of the embodiments 22-26, further comprising a coupler configured to detachably couple the upright member to the base.

Embodiment 28. The modular furniture assembly of any of the embodiments 22-27, wherein the height ($H_U$) of the upright member is perpendicular to the length of the upright member.

Embodiment 29. The modular furniture assembly of any of the embodiments 22-28, wherein the upright member is inclined in relation to the upright member.

Embodiment 30. The modular furniture assembly of any of the embodiments 22-29, further comprising a connector leg assembly configured to selectively secure a bottom portion of the base to a bottom portion of the upright member, the connector leg assembly comprising two or more protruding members configured to selectively attach to the bottom portions of the base and the upright member.

Embodiment 31. The modular furniture assembly of any of the embodiments 22-30, wherein the two or more protruding members are separated from one another in at least one direction by a distance substantially equal to the width (Z) of the upright member.

Embodiment 32. The modular furniture assembly of any of the embodiments 22-31, wherein at least one of the upright members is configured to function as a backrest or armrest.

Embodiment 33. A modular furniture assembly comprising a base having a length (X), a width (Y), and a height (H); and a plurality of upright members, each upright member having a length, a width ($Z_1$), a height ($H_U$), and have two receiving holes having a separation distance ($Z_2$) wherein the height ($H_U$) of each upright member is substantially greater than the height (H) of the base, wherein the base and the plurality of upright members have a defined spatial relationship, the defined spatial relationship being: the length (X) of the base is substantially equal to a sum of the width (Y) of the base and two times a dimension (Z) which is selected from the width ($Z_1$) of the plurality of upright members or the separation distance ($Z_2$), such that different configurations can be formed.

Embodiment 34. The modular furniture assembly of the embodiments 33, wherein at least one of the plurality of upright members is configured to function as a backrest or armrest.

Embodiment 35. The modular furniture assembly of any of the embodiments 33-34, wherein the plurality of upright members include a first upright member having length (X'), wherein the length (X) of the base is substantially equal to the length (X') of the first upright member, wherein the plurality of upright members include a second upright member having a length that is one of: (Y); (X+Z); or (Y+Z).

Embodiment 36. A modular furniture assembly comprising a base having a length (X) and a width (Y); an upright member having a width (Z), wherein the base and the upright member have a defined spatial relationship, the defined spatial relationship being: the length (X) of the base is substantially equal to a sum of the width (Y) of the base and two times the width (Z) of the upright member, such that different furniture configurations can be formed; and a connector leg that couples the base and the upright member together, wherein the connector leg includes one or more protruding members that each include a top end and a base portion, the top end being narrower than the base portion to allow tilting of the base when the modular furniture assembly is in a partially assembled state.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular furniture assembly comprising:

a base having a top face and an opposing bottom face that each extend between a first side face and an opposing second side face and that also extend between a front face and an opposing back face, the base having a first dimension (X) extending between the front face and the opposing back face and a second dimension (Y) extending between the first side face and the opposing second side face; and an upright member removably mounted to the base so that the upright member upstands from the base, the upright member having an upstanding frontside face and an upstanding opposing backside face, the frontside face and backside face being spaced apart by a third dimension (Z), wherein the base and the upright member have a defined spatial relationship, the defined spatial relationship being:

a sum of the second dimension (Y) of the base and two times the third dimension (Z) of the upright member is equal to the first dimension (X) of the base or is within a 5% variance of the first dimension (X) of the base, such that different furniture configurations can be formed.

2. The modular furniture assembly as recited in claim 1, further comprising two or more receiving holes being formed in the upright member or the base, the two or more receiving holes being separated by a separation distance ($Z_2$) that is equal to the third dimension (Z).

3. The modular furniture assembly as recited in claim 2, wherein:

both the upright member and the base have the two or more receiving holes;

the two or more receiving holes of the base are separated from one another by the separation distance ($Z_2$) that is equal to the third dimension (Z) of the upright member;

the two or more receiving holes of the upright member are separated from one another by the separation distance ($Z_2$) that is equal to the third dimension (Z) of the upright member; and at least one of the two or more receiving holes of the base is separated from at least one of the two or more receiving holes of the upright member by the separation distance ($Z_2$) when the modular furniture assembly is assembled.

4. The modular furniture assembly as recited in claim 1, wherein a height ($H_U$) of the upright member is substantially greater than a height (H) of the base.

5. The modular furniture assembly as recited in claim 1, wherein a length of the upright member is a length in a horizontal plane and the first dimension (X) of the base is a length in said horizontal plane, and wherein the second dimension (Y) of the base is in said horizontal plane and the third dimension (Z) of the upright member is in said horizontal plane.

6. The modular furniture assembly as recited in claim 1, further comprising:

at least one first coupling unit associated with at least one of the base and the upright member;

at least one second coupling unit associated with a connector leg assembly, the at least one first coupling unit corresponding with the at least one second coupling unit;

further comprising at least one fastener that cooperates with both the at least one first coupling unit and the at least one second coupling unit.

7. The modular furniture assembly as recited in claim 6, wherein the connector leg assembly comprises:

a connector plate;

a leg connected or selectively connectable to the connector plate, the leg being configured to elevate at least a portion of the modular furniture assembly above a floor upon which the base is supported; and the at least one second coupling unit comprising a receiving hole selectively alignable with the at least one first coupling unit.

8. The modular furniture assembly as recited in claim 7, wherein the at least one second coupling unit comprises at least one protruding member extending from a top surface of the connector plate, the at least one protruding member being configured to selectively be received into at least one receiving hole of the at least one first coupling unit.

9. The modular furniture assembly as recited in claim 1, further comprising:

two or more receiving holes on a bottom portion of the base;

two or more receiving holes on the bottom portion of the upright member; and a connector leg assembly configured to selectively secure the bottom portion of the base to the bottom portion of the upright member, the connector leg assembly comprising:

a connector plate;

a leg connected or selectively connectable to a bottom surface of the connector plate, the leg configured to elevate at least a portion of the modular furniture assembly above a floor upon which the base is supported; and two or more protruding members extending from a top surface of the connector plate, the two or more protruding members configured to selectively be received into the receiving holes of the base and the upright member.

10. The modular furniture assembly as recited in claim 9, wherein:

the two or more receiving holes of the base are separated from one another by a distance equal to a separation distance of the receiving holes of the upright member;

the two or more receiving holes of the upright member are separated from one another by a distance substantially equal to the third dimension (Z) of the upright member; and at least one of the two or more receiving holes of the base is separated from at least one of the two or more receiving holes of the upright member by a distance substantially equal to the third dimension (Z) of the upright member when the modular furniture assembly is assembled.

11. The modular furniture assembly as recited in claim 9, further comprising a clamp assembly configured to selectively secure the two or more protruding members of the connector leg assembly within the two or more receiving holes of the base, wherein the clamp assembly cooperates with a top portion of the base and selectively attaches to the two or more protruding members of the connector leg assembly via the two or more receiving holes of the base.

12. The modular furniture assembly as recited in claim 9, wherein the two or more protruding members each comprise a narrower top portion and a wider base portion, such that each protruding member permits tilting of at least one of the base or the upright member.

13. The modular furniture assembly as recited in claim 12, wherein a diameter of the protruding members is smaller than a diameter of each of the two or more receiving holes.

14. The modular furniture assembly as recited in claim 13, further comprising a reinforcing member having a plurality of holes, the plurality of holes being selectively aligned with the two or more receiving holes, wherein the diameter of the protruding members is smaller than a diameter of the plurality of holes.

15. The modular furniture assembly as recited in claim 1, further comprising a plurality of legs outwardly projecting from the bottom face of the base.

16. The modular furniture assembly as recited in claim 15, further comprising the frontside face of the upright member being disposed directly adjacent to the first side face of the base or the back face of the base.

17. The modular furniture assembly as recited in claim 1, further comprising:

the upright member comprising a backrest disposed adjacent to the back face of the base; and an armrest member removably mounted to the base so as to be disposed adjacent to the first side face of the base, the armrest member having an upstanding frontside face and an upstanding opposing backside face, the frontside face and backside face of the armrest member being spaced apart by the third dimension (Z).

18. The modular furniture assembly as recited in claim 1, further comprising:

a first recess formed on the frontside face of the upstanding member; and a first coupler having a first end received within the first recess and secured to the upstanding member and having an opposing second end disposed outside of the first recess and secured to the base.

19. The modular furniture assembly as recited in claim 18, further comprising:

the base comprising a base frame having the top face and the opposing bottom face with a first hole extending therebetween;

a plate having a leg extending therefrom; and a fastener passing through the first hole in the base frame, the fastener being secured to the second end of the first coupler at the top face of the base frame and secured to the plate at the bottom face of the base frame.

20. A modular furniture assembly comprising:

a base having a top face and an opposing bottom face that each extend between a first side face and an opposing second side face and that also extend between a front face and an opposing back face, the base having a length (X) in a horizontal plane extending between the front face and the opposing back face and a width (Y) in said horizontal plane extending between the first side face and the opposing second side face; and an upright member removably mounted to the base so that the upright member upstands from the base, the upright member having an upstanding frontside face and an upstanding opposing backside face, the upright member having a length in said horizontal plane, a width ($Z_1$) in said horizontal plane extending between said upstanding frontside face and said upstanding opposing backside face, and two receiving holes having a separation distance ($Z_2$), wherein the upright member is configured to be positioned such that a height ($H_u$) of the upright member is substantially greater than a height (H) of the base, wherein the base and the upright member have a defined spatial relationship, the defined spatial relationship being:

a sum of the width (Y) of the base and twice a dimension (Z) which is selected from the width ($Z_1$) of the upright member or the separation distance ($Z_2$) is equal to the length (X) of the base or is within a 5% variance of the length (X) of the base, such that different furniture configurations can be formed, the width ($Z_1$) of the upright member being equal to the separation distance ($Z_2$).

21. The modular furniture assembly as recited in claim 20, wherein the length of the upright member is one of:

(X):

(Y); or (X+Z).

22. The modular furniture assembly as recited in claim 20, further comprising a connector leg assembly configured to selectively secure a bottom portion of the base to a bottom portion of the upright member, the connector leg assembly comprising two or more protruding members configured to selectively attach to the bottom portions of the base and the upright member, wherein the two or more protruding members are separated from one another in at least one direction by a distance substantially equal to the width (Z) of the upright member.

23. A modular furniture assembly comprising:

a base comprising base frame having a top face and an opposing bottom face that each extend between a first side face and an opposing second side face and that also extend between a front face and an opposing back face, the base frame having a length (X) extending between the front face and the opposing back face and a width (Y) extending between the first side face and the opposing second side face, a first hole passing through the base frame from the top face to the opposing bottom face;

an upright member removably mounted to the base so that the upright member upstands from the base, the upright member having an upstanding frontside face and an upstanding opposing backside face that each extend between an upper face and an opposing lower face, the frontside face and backside face being spaced apart by a width (Z), a second hole being formed on the lower face and projecting toward the upper face, wherein the base and the upright member have a defined spatial relationship, the defined spatial relationship being:

a sum of the width (Y) of the base and two times the width (Z) of the upright member) is equal to the length (X) of the base or is within a 5% variance of the length (X) of the base, such that different furniture configurations can be formed; and a connector leg assembly that couples the base and the upright member together, wherein the connector leg assembly includes a plate having a first side and an opposing second side, a leg outwardly projecting from the first side of the plate, and a first protruding member and a spaced apart second protruding member outwardly projecting from the second side of the plate, the first and second protruding members each including a top end and a base portion, the top end being narrower than the base portion to allow tilting of the base frame when the modular furniture assembly is in a partially assembled state, a threaded opening being formed in the top end of the first and second protruding members, wherein the first protrusion is received within the first hole of the base frame at the bottom face and the second protrusion is received within the second hole of the upright member at the lower face, a first fastener passing into the first hole of the base frame from the top face, and threadedly engaging with the threaded opening formed in the top end of the first protruding member.

24. The modular furniture assembly as recited in claim 23, wherein the first protruding member and the second protruding member are disposed in parallel alignment.

25. The modular furniture assembly as recited in claim 23, further comprising:

a first recess formed on the frontside face of the upstanding member, the second hole extending to the first recess;

a first coupler having a first end and an opposing second end, the second end being received within the first recess of the upstanding member;

the first fastener passing through the first end of the first coupler, passing into the first hole of the base frame from the top face, and threadedly engaging with the threaded opening formed in the top end of the first protruding member; and a second fastener passing through the second end of the first coupler, passing into the second hole of the upstanding member at the first recess, and threadedly engaging with the threaded opening formed in the top end of the second protruding member.

* * * * *